US012613084B2

(12) United States Patent
Rastegar

(10) Patent No.: US 12,613,084 B2
(45) Date of Patent: Apr. 28, 2026

(54) INERTIAL DELAY MECHANISMS FOR LOW-G AND LONG-DURATION ACCELERATION EVENT DETECTION AND FOR INITIATION DEVICES IN MUNITIONS AND IMPULSE SWITCHES AND THE LIKE

(71) Applicant: Omnitek Partners LLC, Ronkonkoma, NY (US)

(72) Inventor: Jahangir S. Rastegar, Stony Brook, NY (US)

(73) Assignee: OMNITEK PARTNERS LLC, Ronkonkoma, NY (US)

( * ) Notice: Subject to any disclaimer, the term of this patent is extended or adjusted under 35 U.S.C. 154(b) by 0 days.

(21) Appl. No.: 18/951,590

(22) Filed: Nov. 18, 2024

(65) Prior Publication Data

US 2025/0189285 A1 Jun. 12, 2025

Related U.S. Application Data

(63) Continuation of application No. 18/123,282, filed on Mar. 19, 2023, now Pat. No. 12,146,731.

(60) Provisional application No. 63/322,549, filed on Mar. 22, 2022.

(51) Int. Cl.
*F42C 15/24* (2006.01)

(52) U.S. Cl.
CPC ..... *F42C 15/24* (2013.01)

(58) Field of Classification Search
CPC ..... F42C 15/24
USPC ..... 102/248
See application file for complete search history.

(56) References Cited

U.S. PATENT DOCUMENTS

| | | | | |
|---|---|---|---|---|
| 9,160,009 | B2 * | 10/2015 | Rastegar | F42C 15/24 |
| 9,476,684 | B2 * | 10/2016 | Rastegar | F42C 15/24 |
| 10,234,254 | B2 * | 3/2019 | Rastegar | F42C 1/04 |
| 11,662,192 | B2 * | 5/2023 | Rastegar | F42C 1/04 102/247 |

* cited by examiner

*Primary Examiner* — Samir Abdosh

(57) ABSTRACT

An inertial mechanical delay mechanism including: a first member rotatable about a first axis in a first direction. The first member having a first center of mass offset from a line parallel to a direction of acceleration and perpendicular from the first axis. A first elastic material exerts a first biasing force to the first member to bias the first member in a second direction. A second member is rotatable about a second axis in a third direction. The second member rotatable in a third direction by at least indirect interaction with the first member when the first member rotates a first angle in the first direction. A second elastic material exerts a second biasing force to the second member to bias the second member in a fourth direction. The first member is configured to rotate the first angle when the acceleration is greater than a predetermined magnitude and duration.

7 Claims, 43 Drawing Sheets

INERTIAL DELAY MECHANISMS FOR LOW-G AND LONG-DURATION ACCELERATION EVENT DETECTION AND FOR INITIATION DEVICES IN MUNITIONS AND IMPULSE SWITCHES AND THE LIKE

CROSS-REFERENCE TO RELATED APPLICATION

This application is a Continuation Application of U.S. patent application Ser. No. 18/123,282, filed on Mar. 19, 2023, which claims the benefit of U.S. Provisional Patent Application 63/322,549, filed on Mar. 22, 2022, the entire contents of each of which is incorporated herein by reference.

BACKGROUND

1. Field

The present disclosure relates generally to mechanical inertial delay mechanisms, and particularly for compact and reliable inertially activated initiation devices for munitions and for low-G and long duration event detection devices.

2. Prior Art

Inertially operated mechanical delay mechanisms are used to initiate or are used in devices that perform certain tasks after certain amount of time has elapsed from the time of detection of a prescribed acceleration event. Such delay mechanisms have been used in various inertial igniters (initiation devices) for munitions to activate reserve batteries or initiation trains. Examples of such inertial igniters for initiation of reserve batteries and initiation trains once a prescribed acceleration event defined as a minimum acceleration level that continues for a minimum amount of time (its duration) are described in U.S. Pat. Nos. 9,160,009, 8,550,001, 8,931,413, 7,832,335 and 7,437,995, the contents of which are hereby considered included by reference).

It is appreciated that inertially operated mechanical delay mechanisms are used in many devices, a few of which are described in this disclosure. However, the method of operation of the present novel inertially operated mechanical delay mechanisms are herein described mainly in its application of developing inertially activated inertial igniters for initiating reserve batteries in munitions.

Reserve batteries are inactive and inert when manufactured and become active and begin to produce power only when they are activated. Reserve batteries have the advantage of very long shelf life of up to 20 years that is required for munitions applications.

Reserve batteries of the electrochemical type are well known in the art for a variety of uses where storage time before use is extremely long. Reserve batteries are in use in applications such as batteries for gun-fired munitions including guided and smart, mortars, fusing mines, missiles, and many other military and commercial applications. The electrochemical reserve-type batteries can in general be divided into two different basic types, thermal reserve batteries and liquid reserve batteries.

The first type includes the so-called thermal batteries, which are to operate at high temperatures. Unlike liquid reserve batteries, in thermal batteries the electrolyte is already in the cells and therefore does not require a release and distribution mechanism such as spinning. The electrolyte is dry, solid, and non-conductive, thereby leaving the battery in a non-operational and inert condition. These batteries incorporate pyrotechnic heat sources to melt the electrolyte just prior to use to make them electrically conductive and thereby making the battery active. Thermal batteries utilize a molten salt to serve as the electrolyte upon activation. The electrolytes are usually mixtures of alkali-halide salts and are used with the Li(Si)/$FeS_2$ or Li(Si)/$CoS_2$ couples. Insulation and internal heat sinks are used to maintain the electrolyte in its molten and conductive condition during the time of use.

Thermal batteries have long been used in munitions and other similar applications to provide a relatively large amount of power during a relatively short period of time, mainly during the munitions flight. Thermal batteries have high power density and can provide a large amount of power as long as the electrolyte of the thermal battery stays liquid, thereby conductive.

The second type includes the so-called liquid reserve batteries in which the electrodes are fully assembled for cooperation, but the liquid electrolyte is held in reserve in a separate container until the batteries are desired to be activated. In these types of batteries, by keeping the electrolyte separated from the battery cell, the shelf life of the batteries is essentially unlimited. The battery is activated by transferring the electrolyte from its container to the battery electrode compartment (hereinafter referred to as the "battery cell").

Thermal batteries generally use some type of initiation device (igniter) to provide a controlled pyrotechnic reaction to produce output gas, flame, and hot particles to ignite the heating elements of the thermal battery. There are currently two distinct classes of igniters that are available for use in thermal batteries. The first class of igniter operates based on electrical energy. Such electrical igniters, however, require electrical energy, thereby requiring an onboard battery or other power sources with related shelf life and/or complexity and volume requirements to operate and initiate the thermal battery. The second class of igniters, commonly called "inertial igniters," operate based on the firing acceleration. The inertial igniters do not require onboard batteries for their operation and are thereby often used in munitions applications such as in gun-fired munitions and mortars.

Inertial igniters are also used to activate liquid reserve batteries through the rupture of the electrolyte storage container or membrane separating it from the battery core.

Inertial igniters used in munitions must be capable of activating only when subjected to the prescribed minimum setback acceleration levels and durations (the so-called all-fire condition) and not when subjected to any of the so-called no-fire conditions such as accidental drops or transportation vibration or the like. This means that safety in terms of prevention of accidental ignition is one of the main concerns in inertial igniters.

Mechanical inertial igniters have been developed for many munitions applications in which the munitions are subjected to relatively high firing setback accelerations of generally over 1,000 Gs with long enough duration that provides enough time for the inertial igniter to activate the igniter percussion primer or appropriate pyrotechnic material.

In some munition applications, the setback acceleration duration is not long enough for inertial igniters without preloaded springs to either activate or to provide the required percussion impact to initiate the pyrotechnic material of the device (such as a percussion primer or directly applied pyrotechnic materials).

In some other munition applications, the setback acceleration level is not high enough and/or the striker mass of the inertial igniter cannot be made large (massive) enough due to the inertial igniter size limitations and/or the striker mass cannot be provided with long enough travel path due to the inertial igniter height limitations so that the striker mass cannot gain enough speed (kinetic energy) to impact the percussion primer or the directly applied pyrotechnic material with the required mechanical energy to initiate them. For such applications, the mechanical inertial igniter must be provided with a source of mechanical energy to accelerate the striker element of the inertial igniter to gain enough kinetic energy to initiate the provided percussion primer or the directly applied pyrotechnic material of the device.

In some other munition applications, the prescribed minimum setback acceleration level is low, sometimes in the order of 10-20 G and its duration is relatively long, sometimes of the order of 50-100 msec or more that must be differentiated from other accidental no-fire conditions.

Inertia-based igniters must provide two basic functions. The first function is to provide the capability to differentiate accidental events, such as drops over hard or soft surfaces or transportation vibration or the like, i.e., all no-fire events, from the prescribed firing setback acceleration (all-fire) event. It is appreciated that such accidental acceleration events may have levels that are significantly higher than the prescribed minimum acceleration levels by are significantly shorter in duration. In current inertial igniters, this function is generally performed by keeping the device striker mass fixed to the device structure during all no-fire events until the prescribed firing setback acceleration event is detected. At which time, the device striker is then released.

The second function of an inertia-based igniter is to provide for the acceleration of the device striker mass to the kinetic energy level that is needed to initiate the provided percussion primer or other device pyrotechnic material as it (hammer element) strikes an "anvil" over and around which the pyrotechnic material is provided. In general, the striker mass is provided with a relatively sharp point which strikes the provided percussion primer or the pyrotechnic material covering a raised surface over the anvil, thereby allowing a relatively thin pyrotechnic layer to be pinched to achieve a reliable ignition mechanism. In many applications, percussion primers are directly mounted on the anvil side of the device and the required initiation pin is machined or attached to the striker mass to impact and initiate the primer. In either configuration, exit holes are provided on the inertial igniter structure to allow the reserve battery activating flames and sparks to exit.

Two basic methods are currently available for accelerating the device striker mass to the needed velocity (kinetic energy) level. The first method is based on allowing the setback acceleration to accelerate the striker mass following its release. This method requires the setback acceleration to be relatively high and have long enough duration to allow for the time that it takes for the striker mass to be released and for the striker mass to be accelerated to the required velocity before percussion primer or pyrotechnic material impact. In addition, the striker mass must have enough space to travel so that it could gain the required velocity, which means that the inertial igniter must be allowed to have the required height (here, height is intended to be measured in the direction of the firing acceleration). As a result, this method is generally applicable to larger caliber and mortar munitions in which the setback acceleration is high, and duration is relatively long and in the order of 10-15 milliseconds. This method is also suitable for impact induced initiations in which the impact induced decelerations are high and have relatively long duration.

The second method relies on potential energy stored in a spring (elastic) element, which is then released upon the detection of the aforementioned prescribed all-fire conditions. This method is suitable for use in munitions that are subjected to very low firing acceleration levels, such as in the order of 10-20 G, or very short setback accelerations, such as those of the order of 1-2 milliseconds, or when the setback acceleration level is low and space constraints does now allow the use of relatively large striker mass or where the height limitations of the available space for the inertial igniter does not provide enough travel distance for the inertial igniter striker to gain the required velocity and thereby kinetic energy to initiate the pyrotechnic material.

Inertia-based igniters must therefore comprise two components so that together they provide the mechanical safety in terms of activation only when the prescribed (all-fire) minimum acceleration level and duration are detected, i.e., the capability to differentiate the prescribed all-fire condition from all no-fire conditions, and to provide the required striking action to achieve ignition of the provided percussion primer or pyrotechnic elements. The general function of the safety system is to keep the striker mass element in a relatively fixed position until the prescribed all-fire condition (or the prescribed impact induced deceleration event) is detected or prevent it from striking the device percussion primer or other provided pyrotechnic material, at which time the striker mass is to be released, allowing it to accelerate toward its target under the influence of the remaining portion of the setback acceleration or the potential energy stored in its spring (elastic) element of the device. The ignition itself may take place because of striker mass impact, or simply contact or proximity. For example, the striker mass may be akin to a firing pin and the target akin to a standard percussion cap primer. Alternately, the striker-target pair may bring together one or more chemical compounds whose combination with or without impact will set off a reaction resulting in the desired ignition.

The shortcomings of the prior art mechanical inertial igniters are related to their following limitations for the following applications in munitions and the like:

1. They are not capable of detecting relatively long duration firing accelerations of the order of 50-100 milliseconds or longer.
2. Their required height and overall size are generally significantly larger than are desired for munitions applications, particularly when the firing acceleration is low.

The primary reason for the above shortcomings is the current lack of availability of inertially operated mechanical delay mechanisms that can provide relatively long time delays from the time that the prescribed minimum acceleration level has been detected to the time that the initiator striker mass is released and is accelerated to the required kinetic energy by the provided preloaded spring elements to initiate the provided percussion primer or pyrotechnic material to be ignited. Such delay inertially operated delay mechanisms can then be integrated with an appropriate striker mass assembly with preloaded springs, i.e., a source of stored mechanical potential energy, to that once the prescribed minimum time (duration) of the prescribed minimum acceleration level has elapsed, the device striker mass is released to initiate the percussion primer or other provided pyrotechnic material as indicated above and an example of which is provided below.

It is appreciated by those skilled in the art that in many applications, inertial mechanical delay mechanisms and other devices that use them in their construction, such as reserve liquid or reserve thermal batteries, are packaged in enclosures that prevents inspection of their status unless, for example, the device is x-rayed. In such applications, it is highly desirable if the device can be configured to enable the user to determine the status of the device, i.e., whether the delay mechanism has partially or fully activated as well as if the device in which the delay mechanism is integrated has been activated.

An example of the above second method of initiating the inertial igniter that relies on potential energy stored in a spring (elastic) element, which is then released upon the detection of the prescribed all-fire conditions, is the prior art inertial igniter embodiment 300 of FIGS. 1-5.

The full isometric view of the prior art inertial igniter embodiment 300 is shown in FIG. 1. The inertial igniter 300 is constructed with igniter body 301 and the cap 302 (FIG. 3), which is attached to the body 301 with the screws 303 (FIG. 3) through the tapped holes 336. When needed, an access hole 304 is provided for an arming pin to prevent accidental activation of the inertial igniter while handling or accidental drop or the like before assembly into the intended reserve battery or the like.

The top view of the inertial igniter 300 of FIG. 1 with its cap 302 removed is shown in the schematic of FIG. 2. The cross-sectional view B-B (FIG. 2) of the inertial igniter 300 is also shown in the schematic of FIG. 3. In the cross-sectional view of FIG. 3, the cap 302 of the inertial igniter 300 is also shown. In the top view of FIG. 2, the release lever 318 and its rotary joint pin 319 (shown in FIGS. 1 and 3) and striker mass engagement pin 321 as shown engaged with the provided surface on the striker mass 305 (see also FIG. 3) are shown.

As can be seen in the top view of FIG. 3 of the inertial igniter with the cap 302, the inertial igniter is provided with the striker mass 305, which is rotatable about the axis of the shaft 307. The striker mass 305 and shaft 307 assembly is shown in the cross-sectional view A-A (see FIG. 2) of FIG. 4. As can be seen in the cross-sectional view A-A of FIG. 4, the striker mass 305 is free to rotate about the shaft 307 by the provided clearance in the passing hole 313 in the body of the striker mass 305. On both sides of the striker mass 305, bushings 306 are provided to essentially fill the gap between the shaft 307 and both wound sides of the torsion spring 309. The bushings 306 are provided with enough clearance with the torsion spring 309 to allow its free rotational movement with minimal friction. The bushings 306 are also provided to constrain radial movement of the torsion spring 309 as it is preloaded and released to activate the inertial igniter as described later.

The shaft 307 is mounted onto the inertial igniter body 301 through the holes 308 in the wall 314 of the inertial igniter body, FIGS. 1 and 4. The shaft 307 is fitted in the holes 308 tightly to prevent it from sliding out of the inertial igniter body.

The two wound halves of the torsional spring 309 are mounted over the shaft 307 over the sleeves 306 as can be seen in the top view of FIG. 2 and the cross-sectional view of FIG. 4, with the "U" section 310 of the torsion spring 309 engaging the provided mating surface 311 of the striker mass 305 as can be seen in the top view of FIG. 2 and more clearly in the cross-sectional view of FIG. 3. The free legs 312 of the torsion spring 309 rests against the bottom surface 315 as the torsion spring 309 is preloaded in its pre-activation state as shown in FIG. 4. Alternatively, the free legs 312 of the torsion spring 309 may be positioned to rest against the inside surface of the cap 302 (not shown).

In the cross-sectional view of the inertial igniter 300 shown in its pre-activation state in FIG. 3, the striker mass release lever 318 and its striker mass engagement pin 321 are shown in their pre-loaded state. It is appreciated by those skilled in the art that in the configuration shown in FIG. 3, the clockwise rotation of the striker mass (as seen in the view of FIG. 3) by the preloaded torsional spring 309 is prevented by the striker mass engagement pin 321 of the release lever 318 as described later. It is noted that in the pre-activation configuration shown in the cross-sectional view of FIG. 3, the free-ends 312 of the torsional spring 309 are pressing against the bottom surface 315 of the inertial igniter body 301, FIG. 4, on one end and tend to rotate the striker mass 305 in the clockwise direction about the shaft 307 as viewed in the schematic of FIG. 3 via its "U" shaped portion, which is engaged with matching surfaces 311 of the striker mass 305, FIG. 2, on the other end. In the pre-activation configuration of FIG. 3, the striker mass engagement pin 321 of the release lever 318 is shown to prevent clockwise rotation of the striker mass 305 as described below, thereby forcing the striker mass 305 to remain in it illustrated configuration, thereby keeping the torsional spring 309 in its pre-loaded state.

As can be seen in the cross-sectional schematic of FIG. 3, which shows the state of the inertial igniter 300 in its pre-activation state, the inertial igniter is provided with a release lever 318. The release lever 318 is connected to the inertial igniter body 301 via the rotary joint provided by the pin 319 passing through the hole 320 across the length of the release lever 318—along the line perpendicular to the plane of the cross-sectional view of FIG. 3. The pin 319 is firmly mounted in the holes 328 (FIG. 1), while the mating hole 320 in the release lever 318 is provided with minimal clearance to allow for unimpeded rotation (clockwise and counterclockwise as viewed in the cross-sectional view of FIG. 3). Alternatively, ball bearings or low friction bushings may be used at this joint.

The striker mass engagement pin 321 is mounted onto the release lever 318 as shown in the schematic of FIG. 1, in which the protruding sides 329 of the release lever is provided with the holes 322, in which the striker engagement pin 321 is assembled. In the schematic of FIG. 1, the striker mass engagement pin 321 in shown to be mounted in the provided holes 322 of the release lever 318 via ball bearings 323 to minimize resistance to its rotation relative to the release lever 318. As it is described later in this enclosure, the striker engagement pin 321 rotation relative to the release lever 318 is desired to generate minimal resistance due to friction between their mating surfaces to minimize variation in the inertial igniter activation acceleration levels.

In the pre-activation configuration of the inertial igniter 300 shown in the schematic of FIG. 3, the striker engagement pin 321 of the release lever 318 is shown to be positioned over the provided curved surfaces 316 (FIG. 3 and under pin 321 in FIG. 2), resisting the force applied by the preloaded torsional spring 309 via the striker mass 305, thereby keeping the inertial igniter in its pre-activation state shown in FIG. 3.

The force applied by the striker mass 305 to the striker mass engagement pin 321 via the striker mass surfaces 316 is prevented from rotating the release lever in the counterclockwise direction and thereby pushing the striker mass engagement pin 321 to the left as seen in the cross-sectional view of FIG. 3, which would then release the striker mass 305 to rotate in the clockwise direction by the preloaded torsional spring 309. This is accomplished using one or more of the following methods. The features enabling these methods to maintain the striker mass 305 in its pre-activation state shown in FIG. 3 are also used to configure inertial igniters to the prescribed no-fire and all-fire condition requirements of each application.

The first method that can be used to keep the inertial igniter in its pre-activation state is based on the use of the curvature of the striker mass surfaces 316 that engages the striker mass engagement pin 321 of the release lever 318, FIG. 3. In this method, lips 317 are provided on the striker mass surfaces 316 as shown in the schematic of FIG. 3. As a result, for the striker mass engagement pin 321 of the release lever 318 to disengage the striker mass surfaces 316, i.e., to rotate in the counterclockwise direction as viewed in FIG. 3, the striker mass engagement pin must force rotation of the striker mass 305 in the counterclockwise direction as viewed in FIG. 3, i.e., it must increase the preloading level of the torsional spring 309. As a result, the inertial igniter would stay in its pre-activation state shown in FIG. 3.

The second method that can be used to keep the inertial igniter in its pre-activation state is based on the provision of at least one elastic element (spring) element to bias the release lever 318 in the direction of clockwise rotation. As an example, the biasing preloaded compressive spring 325 may be positioned between the release lever 318 and the bottom surface 315 of the inertial igniter body 301 as shown in the schematic of FIG. 3. The spring 325 can be positioned in a pocket 324 to keep from moving out of position. It is appreciated by those skilled in the art that many different spring types may also be used for the indicated clockwise rotation biasing of the release lever 318 as seen in the view of FIG. 3.

It is noted that the acceleration of the inertial igniter 300 in the direction of the arrow 330 shown in FIG. 3 would act on the inertia of the release lever 318 and apply a downward force at its center of mass equal to the product of its mass and the acceleration in the direction of the arrow 330, which would tend to rotate the release lever 318 in the counterclockwise direction. The rotation of the release lever 318 is, however, resisted by the biasing force of the preloaded compressive spring 325 and the required counterclockwise rotation of the striker mass 305 for the striker mass engagement pin 321 to be able to travel leftward due to the rotation of the release lever 318 about the pin 319. It is appreciated that for the pin 321 to move to the left in the direction of releasing the striker mass 305, it must push the lips 317 of the striker mass surfaces 316 downwards, thereby forcing the striker mass 305 to undergo the required amount of counterclockwise rotation, which would in turn provide resistance to counterclockwise rotation of the release lever 318.

It is therefore appreciated that the level of acceleration of the inertial igniter 300 that is needed for the release lever 318 to rotate the required amount in the counterclockwise direction for the striker mass engagement pin 321 to disengage the striker mass 305 and thereby allow it to be freely accelerated in the clockwise direction can be varied by varying one or more of the following parameters to match a prescribed all-fire acceleration level and duration thresholds. The all-fire acceleration level threshold can be reduced by varying one or more of the following inertial igniter parameters: (a) reducing the preloading of the compressive spring 325 and its rate, (b) increasing the moment of inertia of the release lever 318 about the axis of the 319, (c) reducing the extent of the lips 317, i.e., the amount of counterclockwise rotation of the striker mass 305 that is required for striker mass engagement pin 321 to release the striker mass; and (d) by positing the pin 319 laterally relative to the striker mass engagement pin 321 as viewed in FIG. 3 in the pre-activation configuration of the inertial igniter 300 to minimize the amount of counterclockwise rotation of the striker mass 305 that is required for the striker mass engagement pin 321 to release the striker mass. The all-fire duration threshold for the activation of the inertial igniter 300 at a prescribed acceleration level can be reduced by varying one or more of the following inertial igniter parameters: (a) by reducing the preloading of the compressive spring 325 and its rate; (b) by increasing the moment of inertia of the release lever 318 about the axis of the 319; and (3) varying the striker mass engagement pin 321 and the striker mass surfaces 316 and the lips 317 geometries to reduce the amount of counterclockwise rotation of the release lever 318 that is required for the striker mass 305 to be released. The opposite changes in the inertial igniter 300 parameters would have the opposite effect.

Now, when the inertial igniter 300 is accelerated in the direction of the arrow 330, FIG. 3, as the prescribed acceleration level threshold and duration is reached, the release lever 318 is rotated in the counterclockwise direction until the striker mass engagement pin 321 moves far enough to the left and pass over the lips 317, thereby releasing the striker mass 305. At this point, the stored mechanical (potential) energy in the torsional spring 309 would begin to rotationally accelerate the striker mass 305 in the clockwise direction about the axis of the shaft 307. The striker mass 305 is thereby accelerated in the clockwise direction until the percussion pin 331 strikes the percussion primer 332 and causing it to initiate as shown in the cross-sectional view of FIG. 5. It is noted that in the cross-sectional view of FIG. 5, the inertial igniter cap 302 containing the percussion primer 332 with the provided flame exit hole 333 are shown. The release lever 318, FIG. 3, in its released position as indicated by the numeral 337 is also shown in the cross-sectional view of FIG. 5, thereby providing a complete cross-sectional view of the inertial igniter 300 in its post-activation state. In this state, the biasing elastic element (spring) 325, FIG. 3, is shown to be compressively deformed and indicated by the numeral 328.

Once the percussion primer 332 is initiated, the flames and sparks generated by the initiation of the primer 332 would then exit from the hole 333 in the inertial igniter cap 302, FIGS. 3 and 5. The cross-sectional view of the inertial igniter 300 in this post-activation configuration is shown in FIG. 5. The hole 333 at the center of the cap 302, FIG. 3, is provided for the exiting primer or other pyrotechnic material generated flames and sparks upon the inertial ignite activation.

It is appreciated that the pre-activation torsional preloading level of the torsional spring 309 and its spring rate must be high enough and the range of rotation of the striker mass 305 from its pre-activation (FIG. 3) to its post-activation positions must be large enough so that the striker mass 305 would gain enough kinetic energy after its release so that as it impacts the percussion primer 332 (FIG. 5) as was previously described it would initiate the percussion primer.

It is also appreciated by those skilled in the art that the percussion primer or other pyrotechnic material that is to be initiated to activate the reserve battery must be kept sealed from elements to ensure proper operation of the percussion primer or the pyrotechnic material that is used and to ensure the require shelf life of the assembled reserve battery and the striker mechanism.

In addition to the aforementioned shortcomings of the prior art mechanical inertial igniters, due to the unavoidable friction related forces, the difference between the no-fire impulse due to the acceleration level and duration acting on the striker mass release mechanism and the all-fire impulse due to the setback acceleration level and its duration acting on the striker mass release mechanism must be large enough to ensure the high reliability that is required for the proper operation of the inertial igniters. In most munitions, operational reliability requirement of sometimes over 99.9 percent at 95 percent confidence level is common and in certain cases must be even higher. In munitions in which the difference between no-fire and all-fire acceleration levels acting on the striker mass release mechanism is relatively small, the friction forces between the relevant moving parts of the inertial igniter must therefore be minimized.

It is also highly desirable for novel miniature inertial mechanical delay mechanisms for the development of mechanical inertial igniters and other similar devices to be capable of satisfying no activation requirement (e.g., no-fire conditions in munitions, i.e., no initiation) upon drops that may impart very high-G accelerations with relatively long durations in any direction to the device in which the inertial igniter is mounted, including high-G acceleration levels that may be as high as 5000-10000 G and even higher with durations that may be as long as 1-3 msec and sometimes more. Then following such drops, the device (inertial igniter for the case of munitions) may be required to be operational and activate when subjected to the previously indicated prescribed low-G and long duration acceleration thresholds (all-fire condition in munitions). Alternatively, following such drops, the device may be required to become inert, i.e., become incapable of being activated when subjected to any acceleration event, including the prescribed acceleration and duration thresholds.

It is also appreciated by those skilled in the art that currently available G-switches of different type that are used for opening or closing an electrical circuit are configured to perform this function when they are subjected to a prescribed acceleration level without accounting for the duration of the acceleration level. As such, they suffer from the shortcoming of being activated accidentally, e.g., when the object in which they are used is subjected to short duration shock loading such as could be experienced when dropped on a hard surface as was previously described for the case of inertial igniter used in munitions.

When used in applications such as in munitions, it is highly desirable for G-switches to be capable to differentiate the accidental and short duration shock (acceleration) events such as those experienced by dropping on hard and soft surfaces, i.e., all no-fire conditions, from significantly longer duration firing setback (shock) accelerations, i.e., all-fire condition. Such G-switches should activate when firing setback (all-fire) acceleration and its duration results in an impulse level threshold corresponding to the all-fire event has been reached, i.e., they must operate as an "impulse switch". This requirement necessitates the employment of safety mechanisms such as the one constructed with the inertial mechanical delay mechanisms, which would allow switch activation only when the prescribed minimum acceleration level and duration thresholds (e.g., all-fire condition in munitions) have been reached. The safety mechanism can be thought of as a mechanical delay mechanism, after which a separate electrical switch mechanism is actuated or released to open or close at least one electrical circuit.

When used in applications such as in munitions, it is highly desirable for G-switches to be capable to differentiate the accidental and short duration shock (acceleration) events such as those experienced by dropping on hard and soft surfaces, i.e., all no-fire conditions, from significantly longer duration firing setback (shock) accelerations, i.e., all-fire condition.

SUMMARY

A need therefore exists for inertial mechanical delay mechanisms that can be used in applications such as mechanical inertial igniters for munitions and the like in which the setback acceleration levels are low, sometimes in the order of 10-20 Gs, while its duration is long, sometimes in the order of 50-100 milliseconds or more, and due to space limitations, the device (inertial igniters for munitions applications) must be relatively compact and small. In addition, the inertial igniters are required to be highly reliable, for example, have better than 99.9 percent reliability with 95 percent confidence level.

A need also exists for inertial mechanical delay mechanisms that can be used in applications such as mechanical inertial igniters that are developed based on the above methods and that can satisfy the safety requirement of munitions, i.e., the no-fire conditions, such as accidental drops and transportation vibration and other similar events.

A need therefore exists for novel miniature inertial mechanical delay mechanisms for the development of mechanical inertial igniters for reserve batteries such as thermal and liquid reserve batteries used in munitions such as rockets and missiles and gun-fired munitions and mortars and the like, that could be used in fuzing and other similar applications, that are safe (i.e., satisfy the munitions no-fire conditions), are small, and that can be used in applications in which the setback acceleration level is low (for example, tens of Gs) and/or the setback acceleration duration is long (for example, in the order of 50-100 milliseconds or more).

A need also exists for novel miniature inertial mechanical delay mechanisms for the development of mechanical inertial igniters based on the above methods and that can satisfy the safety requirement of munitions, i.e., the no-fire conditions, such as accidental drops and transportation vibration and other similar events, and that once subjected to such accidental conditions, its mechanisms remains functional and reset to or close to its configuration prior to experiencing such accidental (no-fire) events.

A need also exists for novel miniature inertial mechanical delay mechanisms for the development of mechanical inertial igniters based on the above methods and that can satisfy no-fire conditions that require no initiation upon drops that may impart very high-G accelerations with relatively long durations in any direction to the device in which the inertial igniter is mounted, including high-G acceleration levels that may be as high as 5000-10000 G and even higher with durations that may be as long as 1-3 msec. Then following such drops, the inertial igniter may be required to be operational and initiate when subjected to the previously indicated prescribed low-G and long duration all-fire acceleration. Alternatively, following such drops, the inertial igniter may be required to become inert, i.e., become incapable of being initiated when subjected to any acceleration event, whether all-fire or any of the no-fire acceleration events.

To ensure safety and reliability, inertial mechanical delay mechanisms must be capable of being used to develop devices such as the aforementioned mechanical inertial igniters such that the inertial igniters would not initiate during acceleration events which may occur during manufacture, assembly, handling, transport, accidental drops, etc. Additionally, once under the influence of an acceleration profile particular to the intended firing of ordinance, the device should initiate with high reliability.

In addition, devices such as inertial igniters developed based on the novel inertial mechanical delay mechanisms for use in munitions are generally required to have a shelf life of better than 20 years and could generally be stored at temperatures of sometimes in the range of −65 to 165 degrees F. The novel inertial mechanical delay mechanisms configurations must also consider the manufacturing costs and simplicity in their configuration to make them cost effective for munitions applications.

Accordingly, fully mechanical inertial delay mechanisms that can be used in various devices, including inertial igniters that can satisfy the prescribed no-fire requirements while satisfying relatively low all-fire setback acceleration levels and long duration requirements. For initiation of percussion primer or other provided pyrotechnic materials, the inertial igniters would rely on potential energy stored in a spring (elastic) element, which is then released upon the detection of the prescribed all-fire conditions by the inertial mechanical delay mechanism of the device. These methods are particularly suitable for use in munitions that are subjected to very low setback accelerations with very long durations, particularly in the presence of available space constraints.

Also provided are fully mechanical inertial delay mechanisms (also referred to as inertial mechanical delay mechanisms) that can be used in various devices, including inertial igniters that can satisfy the prescribed no-fire requirements while satisfying relatively low all-fire setback acceleration levels and long duration requirements. For initiation of percussion primer or other provided pyrotechnic materials, the inertial igniters would rely on potential energy stored in a spring (elastic) element, which is then released upon the detection of the prescribed all-fire conditions by the inertial mechanical delay mechanism of the device. These methods are particularly suitable for use in munitions that are subjected to very low setback accelerations with very long durations, particularly in the presence of available space constraints.

The inertial mechanical delay mechanisms can also be provided with a safety pin that prevents its activation for the purpose of safety during transportation and assembly in the reserve battery or the like.

Also provided are inertial mechanical delay mechanisms that would reset to their initial configuration if the applied acceleration does not satisfy the prescribed minimum acceleration level and duration. In the case that following experiencing an aforementioned high G acceleration (e.g., as high as 5000-10000 G and even higher with durations that may be as long as 1-3 msec) the requirement is to render the device (for example an inertial igniter) to which the inertial mechanical delay mechanism inoperative, then inertial mechanical delay mechanism can be made to assume a configuration post such events that would prevent the device to function (e.g., render an inertial igniter inert).

Also provided are fully mechanical igniters that utilize inertial mechanical delay mechanisms that are configured based on the above methods that can satisfy the prescribed no-fire requirements while satisfying relatively low all-fire firing setback acceleration level and long duration requirements.

Accordingly, also provided are fully mechanical inertial delay mechanisms that can be used in various devices, including inertial igniters, that can satisfy the prescribed no-fire requirements consisting of high G accelerations in any direction that may be as high as 5000-10000 G and even higher with durations that may be as long as 1-3 msec, while satisfying relatively low all-fire setback acceleration levels and long duration requirements. For initiation of percussion primer or other provided pyrotechnic materials, the inertial igniters would also rely on potential energy stored in a spring (elastic) element, which is then released upon the detection of the prescribed all-fire conditions by the inertial mechanical delay mechanism of the device. These methods are particularly suitable for use in munitions that are subjected to very low setback accelerations with very long durations, particularly in the presence of available space constraints and that may be subjected to accidental drops from relatively high heights over hard surfaces.

Also provided are fully mechanical igniters that utilize inertial mechanical delay mechanisms that are configured based on the above methods that can satisfy no-fire requirements consisting of high G accelerations in any direction that may be as high as 5000-10000 G and even higher with durations that may be as long as 1-3 msec, while satisfying relatively low all-fire firing setback acceleration level and long duration requirements.

For initiation of percussion primer or other provided pyrotechnic materials, the above fully mechanical inertial igniters that utilize inertial mechanical delay mechanisms based on the above methods rely on potential energy stored in a spring (elastic) element, which is then released upon the detection of the prescribed all-fire conditions. These methods are particularly suitable for use in munitions that are subjected to very low setback accelerations with very long durations, particularly in the presence of available space constraints.

Also provided is a method for initiating reserve thermal batteries with the above fully mechanical inertial igniters that utilize inertial mechanical delay mechanisms. The method comprising: releasing a striker mass upon an acceleration duration and magnitude greater than a prescribed threshold; and transferring potential energy stored in an elastic element (spring element) to the striker mass to gain enough kinetic energy to strike and initiate the provided percussion cap or pyrotechnic material.

The method also comprises a mechanism that releases the striker mass only upon detection of minimum acceleration level and duration (all-fire condition in munitions) and not if the device in which the inertial igniter is mounted is subjected to high G accelerations in any direction that may be as high as 5000-10000 G and even higher with durations that may be as long as 1-3 msec.

Those skilled in the art will appreciate that the inertial igniters that utilize the disclosed novel inertial mechanical delay mechanisms may provide one or more of the following advantages over prior art inertial igniters:

- Provide inertial igniters that are safe and can differentiate no-fire conditions from all-fire conditions based on the prescribed all-fire setback acceleration level (target impact acceleration level when used for target impact activation) and its prescribed duration.
- Provide inertial igniters that can be activated by low G setback acceleration levels with relatively long durations.
- Provide inertial igniters that would not initiate if subjected to high acceleration levels in any direction that may be as high as 5000-10000 G and even higher with durations that may be as long as 1-3 msec.
- Provide compact inertial igniters that are very short in height to minimize the space that is occupied by the inertial igniter in the reserve battery and other locations that they are used.

Provide inertial igniters that allow the use of standard off-the-shelf percussion cap primers.

Accordingly, an inertial igniter is provided. The inertial igniter comprising: an inertial mechanical delay mechanism; a striker mass movable towards one of a percussion primer or pyrotechnic material; a striker mass release element for releasing the striker mass to strike the percussion primer or pyrotechnic material as detected by the provided inertial mechanical delay mechanism upon detection of the prescribed minimum acceleration level and its duration.

The inertial mechanical delay mechanism of the inertial igniter is configured to reset to its initial configuration in the case that the prescribed minimum acceleration level and duration requirement for ignition is not satisfied. However, when required, when the device in which the inertial igniter is mounted is subjected to high G accelerations (for example, as high as 5000-10000 G and even higher with durations that may be as long as 1-3 msec), the inertial igniter may also be configured not to initiate and stay inoperative after experiencing such an event.

The inertial igniter further comprises an elastic element (such as a torsion spring) that is preloaded to provide the required amount of potential energy to accelerate the striker mass to the required velocity to achieve reliable percussion cap or pyrotechnic material initiation upon impact.

The inertial igniter striker mass and the release element may be rotationally movable to minimize the effects of friction on the operation of the inertial igniter.

The striker mass release element can be configured to be returnable from the path of releasing the striker mass when the acceleration duration and magnitude (all-fire condition) threshold is not reached.

The inertial igniter can also be provided with a safety pin that prevents its activation for the purpose of safety during transportation and assembly in the reserve battery or the like.

The inertial igniter can also be provided with an arm/disarm switch that when is set to the disarm position, it prevents its activation for the purpose of safety during transportation and assembly in the reserve battery or the like.

Also provided is a method for initiating a thermal battery. The method comprising: releasing a striker mass upon an acceleration duration and magnitude greater than a prescribed threshold; and transferring potential energy stored in an elastic element (spring element) to the striker mass to gain enough kinetic energy to strike and initiate the provided percussion cap or pyrotechnic material.

The method can further comprise returning the striker mass release element to its original (zero acceleration condition) position when the acceleration duration and magnitude (all-fire condition) threshold is not reached.

A need therefore exists for novel miniature impulse switches for use in munitions and the like that can differentiate accidental short duration shock loading (so-called no-fire events for munitions) from generally high but longer duration, i.e., high impulse threshold levels, that correspond to all-fire conditions in gun fired munitions or the like. Such impulse switches must be small in size and volume to make them suitable for being integrated into electronic circuit boards or the like. They must also be readily scalable to different all-fire and no-fire conditions for different munitions, particularly for low G setback acceleration with relatively long duration. Reliability is also of much concern since most munitions are required to have a shelf life of up to 20 years and could generally be stored at temperatures of sometimes in the range of −65 to 165 degrees F. This requirement is usually satisfied best if the device is in a sealed compartment. The impulse switch must also consider the manufacturing costs and simplicity of configuration to make it cost effective for munitions applications.

The need also exits for novel miniature impulse switches that when the device in which the inertial igniter is mounted is subjected to very high G accelerations (for example, as high as 5000-10000 G and even higher with durations that may be as long as 1-3 msec), the impulse switch would not activate.

A need also exists for inertial mechanical delay mechanisms that are installed in spaces that make them visually not visible to the user for inspection, for example when they are used to construct inertial igniters used in thermal reserve batteries, to enable the user to determine their activation status before, during, and after acceleration events, whether intended or accidental.

Accordingly, inertial mechanical delay mechanisms, alone or as integrated in the construction other devices such as inertial igniters, are provided that enables the user to determine its partial and full activation status.

It is appreciated by those skilled in the art that the disclosed inertial mechanical delay mechanisms may also be used to construct electrical impulse switches, which are activated like the so-called electrical G switches but with the added time delays to account for the activation shock level duration requirement, i.e., when a prescribed minimum shock loading (acceleration) level is experienced for a prescribed minimum length of time (duration). The electrical "impulse switches" may be configured as normally open or closed and with or without latching mechanisms. Such impulse switch embodiments that combine such safety mechanisms with electrical switching mechanisms are described herein together with alternative methods of their construction.

Also disclosed are inertial igniters with the capability to open or close an electrical switch, which can then be used by the user to determine the activation status of the inertial igniter as assembled in the reserve battery or the like. This capability may also be used for all-fire event detection in munitions or the like.

Those skilled in the art will appreciate that the compact impulse-based electrical impulse switches disclosed herein may provide one or more of the following advantages over prior art electrical G-switches:

Provide impulse-based electrical G-switches that are relatively small in both height and volume, Provide impulse-based electrical switches that differentiate all-fire conditions from all no-fire conditions, even those no-fire conditions that result in low setback acceleration levels with relatively long duration, thereby eliminating the possibility of accidental activation, Provide electrical impulse switches that are modular in configuration and can therefore be readily customized to different no-fire and all-fire requirements, Provide impulse switches that may be normally open or normally closed and that are modular in configuration and can be readily customized for opening or closing or their combination of at least one electric circuit.

Accordingly, impulse-based impulse switches with modular configuration for use in electrical or electronic circuitry are provided that activate upon a prescribed acceleration profile threshold. In most munition applications, the acceleration profile is usually defined in terms of firing setback acceleration and its duration.

BRIEF DESCRIPTION OF THE DRAWINGS

These and other features, aspects, and advantages of the apparatus will become better understood with regard to the following description, appended claims, and accompanying drawings where:

DETAILED DESCRIPTION

The inertial mechanical delay mechanisms are herein described through the following exemplary embodiments. The configuration of a delay mechanism that can be used in devices such as inertial igniters or impulse switches to actuate their release/actuation mechanisms only after the prescribed minimum setback acceleration threshold and duration (all-fire condition in munitions) has been detected is described by its application to the inertial igniter embodiment 10 shown in the schematic of FIG. 6A.

It is appreciated by those skilled in the art that the delay mechanisms alone or as integrated, for example, with the striker mass and its release mechanism of an inertial igniter device, must ensure that the inertial igniter is initiated only after the prescribed minimum setback acceleration threshold and its duration (all-fire condition) has been detected.

Figure 1:
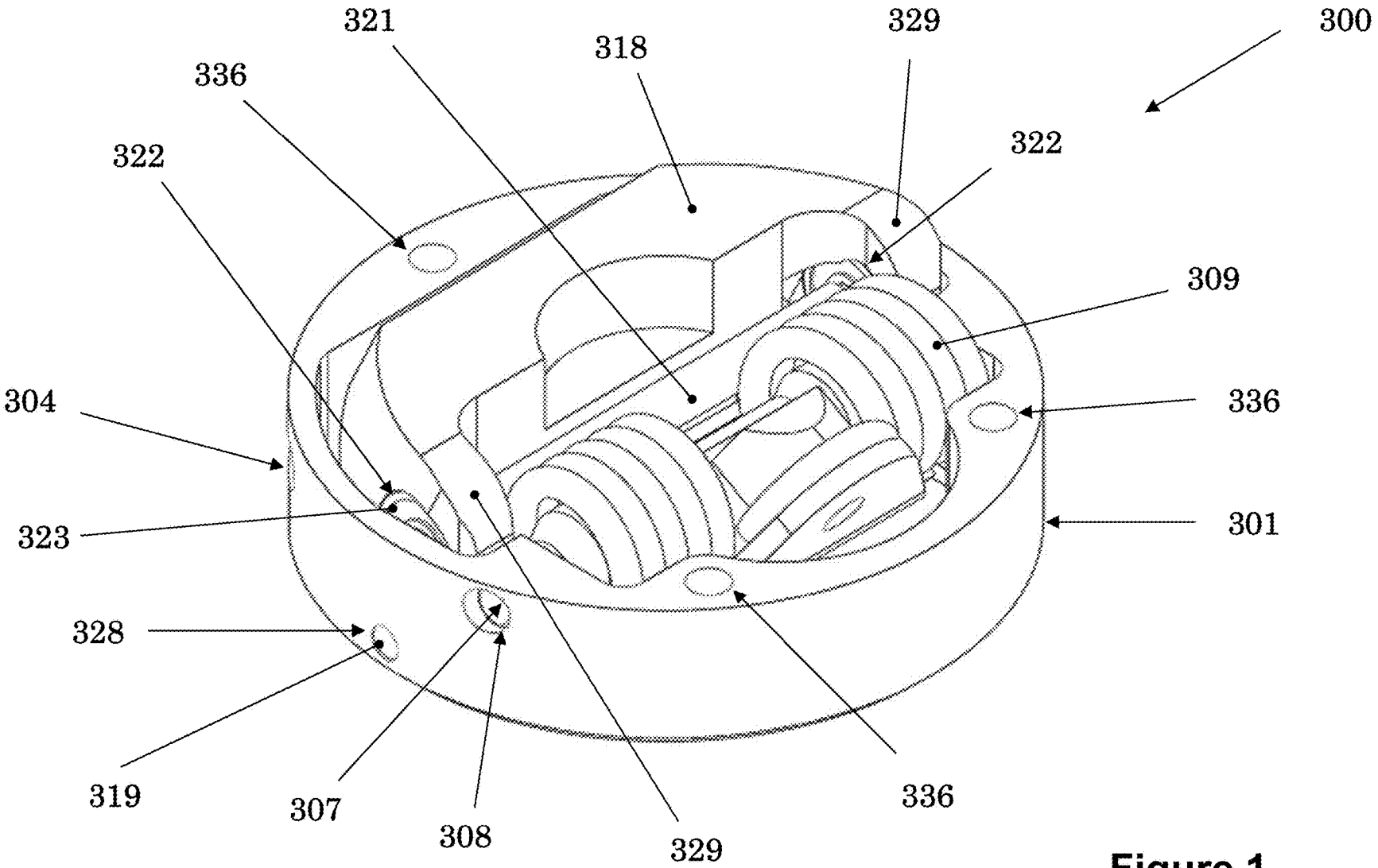
Figure 1 (PRIOR ART)
FIG. 1 illustrates a schematic of the isometric drawing of a prior art inertial igniter operating with stored potential energy.
Figure 2:
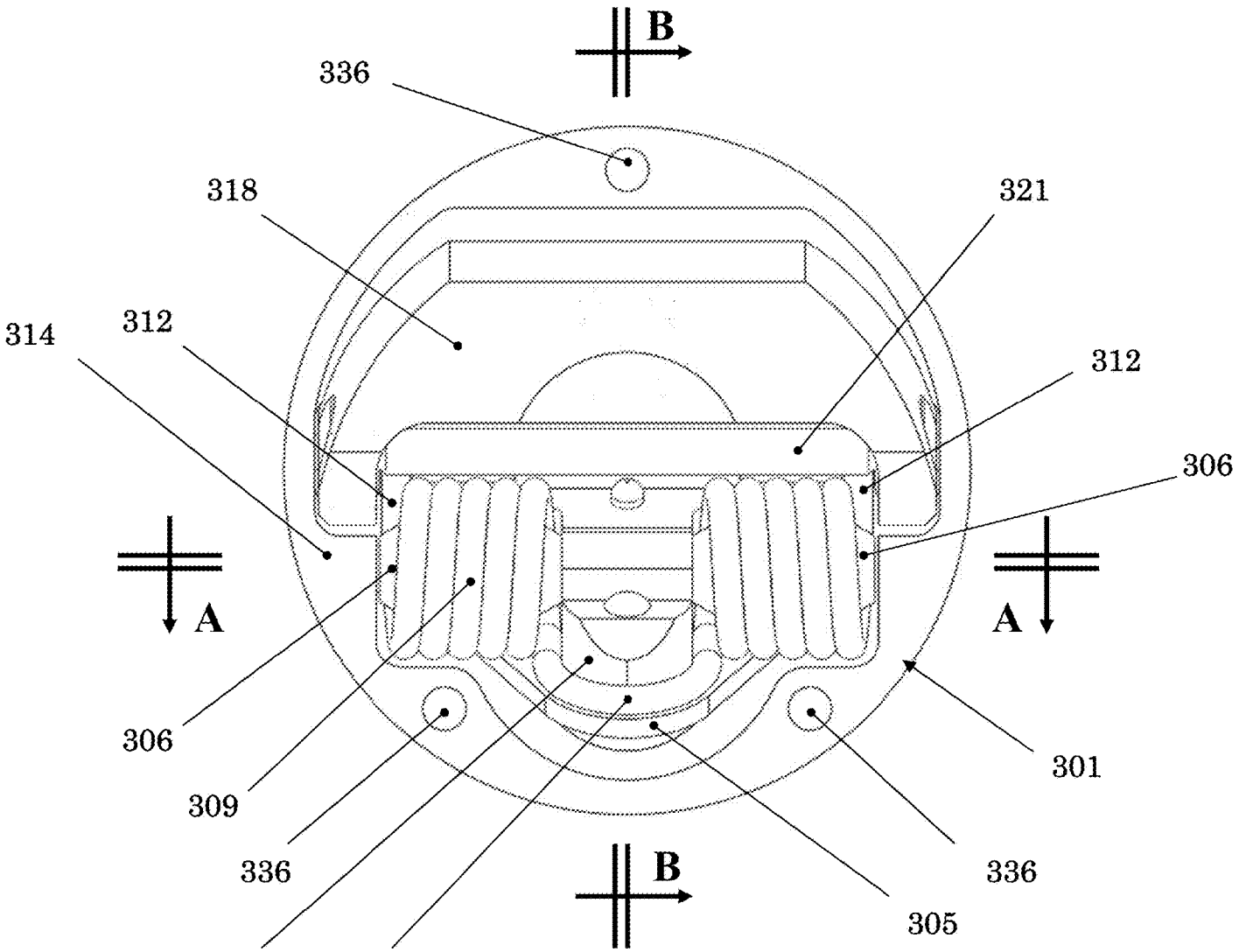
Figure 2 (PRIOR ART)
FIG. 2 illustrates a schematic of the top view of the prior art inertial igniter of FIG. 1 with its cap removed to show the internal components of the device. The striker mass element release arm and its inertial igniter body attached shaft are also removed for clarity.
Figure 3:
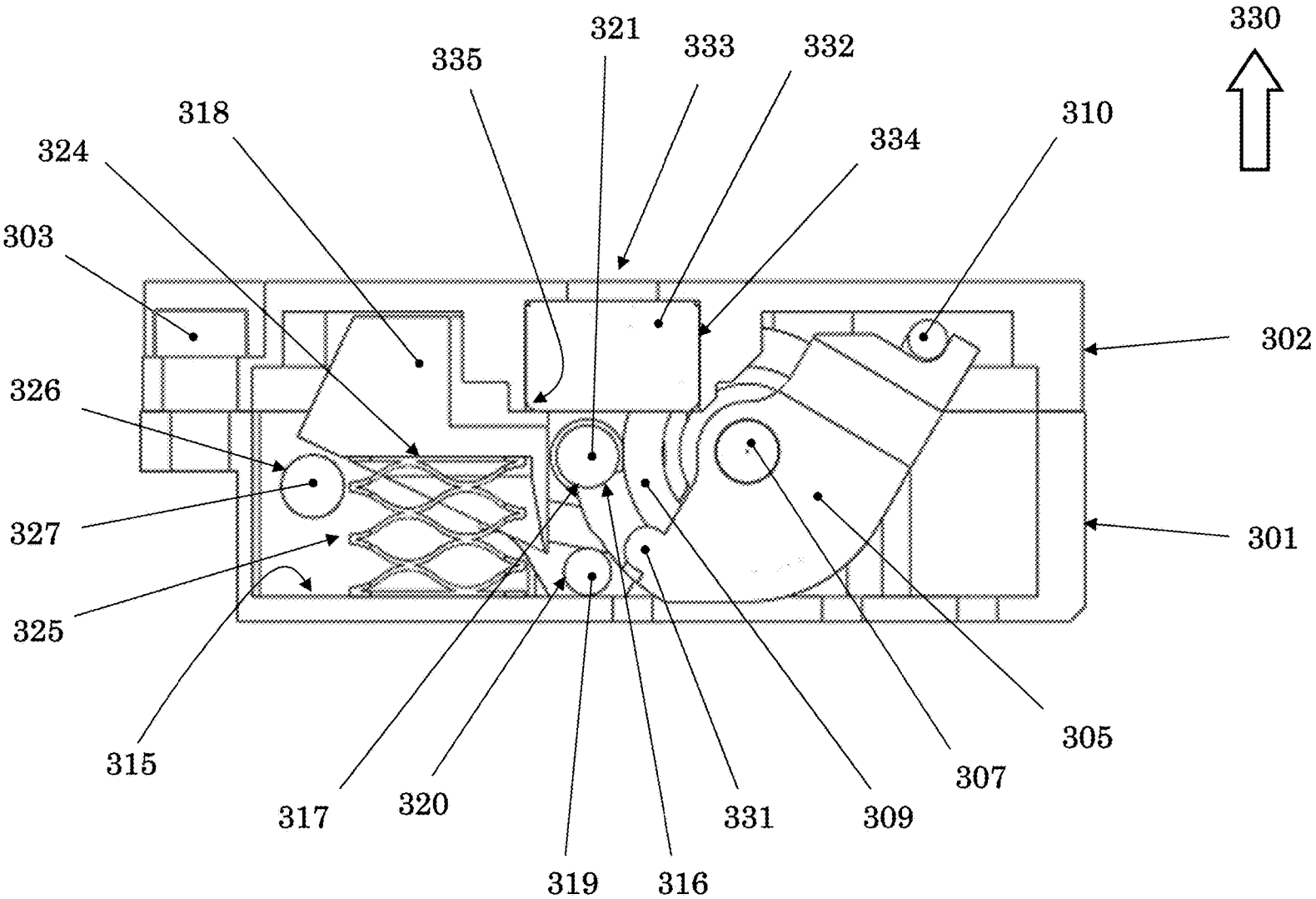
Figure 3 (PRIOR ART)
FIG. 3 illustrates a schematic of a cross-sectional view of the prior art inertial igniter of FIG. 1 in its pre-activation state with the inertial igniter cap assembly removed for clarity.
Figure 4:
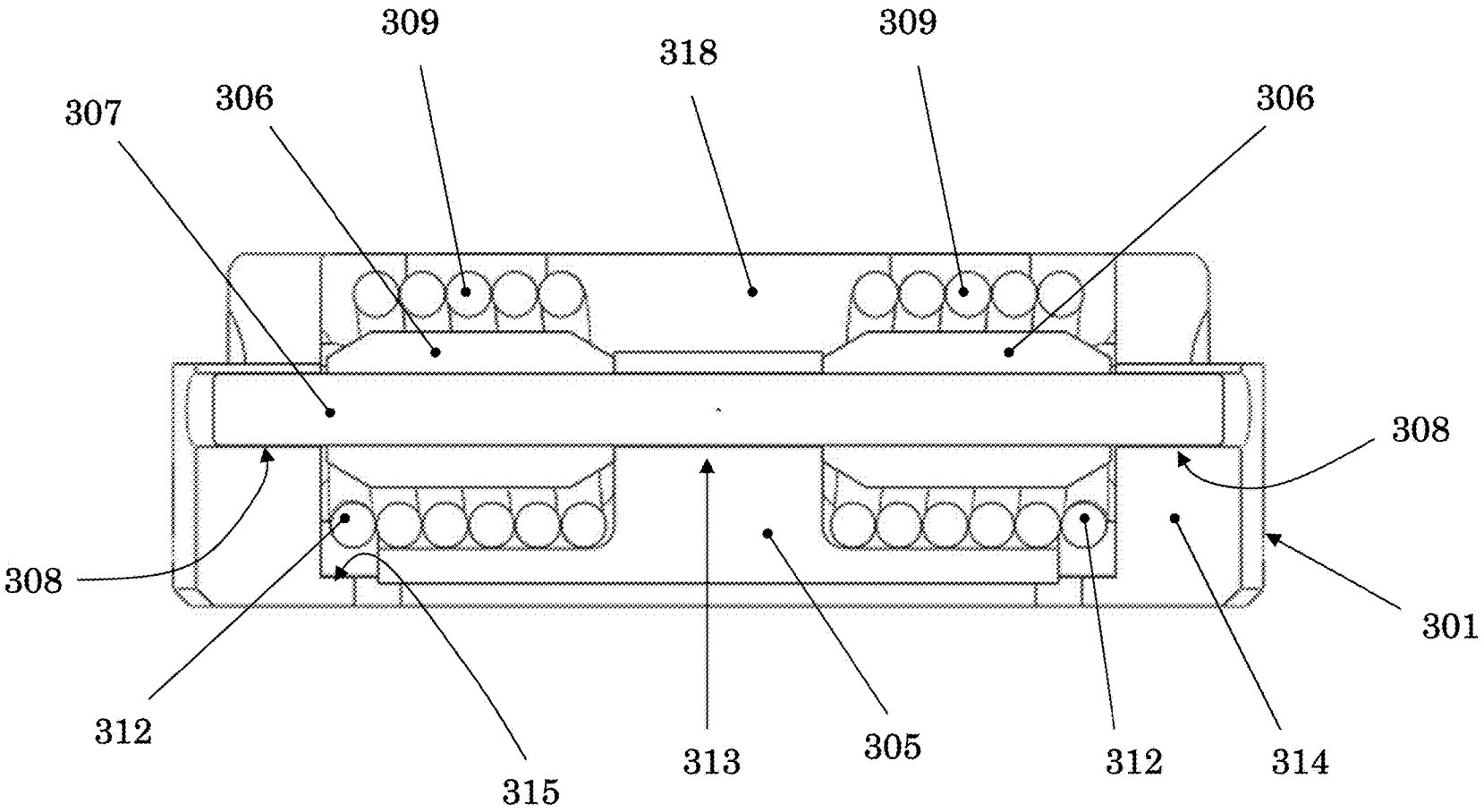
Figure 4 (PRIOR ART)
FIG. 4 illustrates the cross-sectional view A-A indicated in the top view of FIG. 2 of the inertial igniter.
Figure 5:
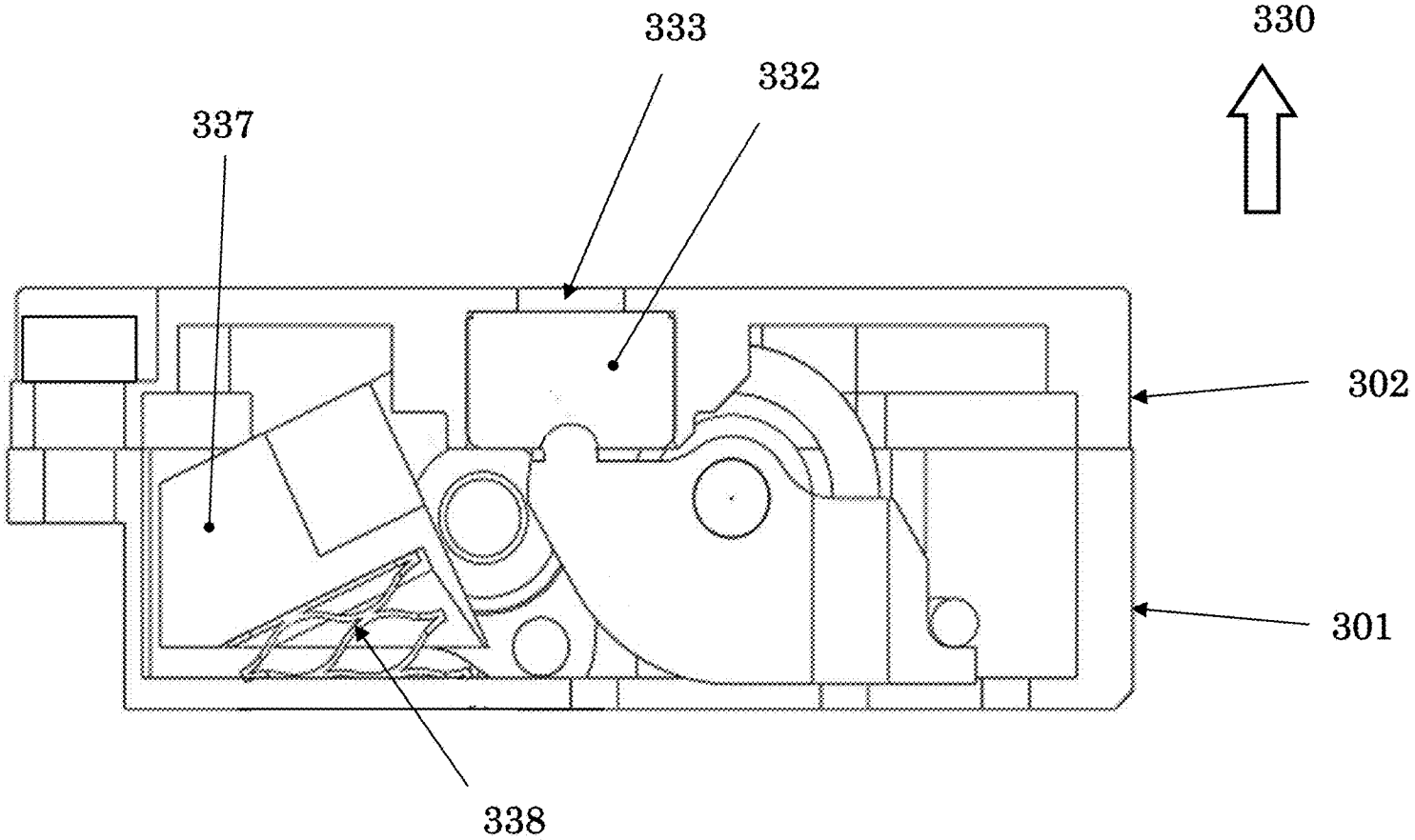
Figure 5 (PRIOR ART)
FIG. 5 illustrates the schematic of the cross-sectional view of the prior art inertial igniter of FIG. 1 in its post-activation state.
Figure 6A:
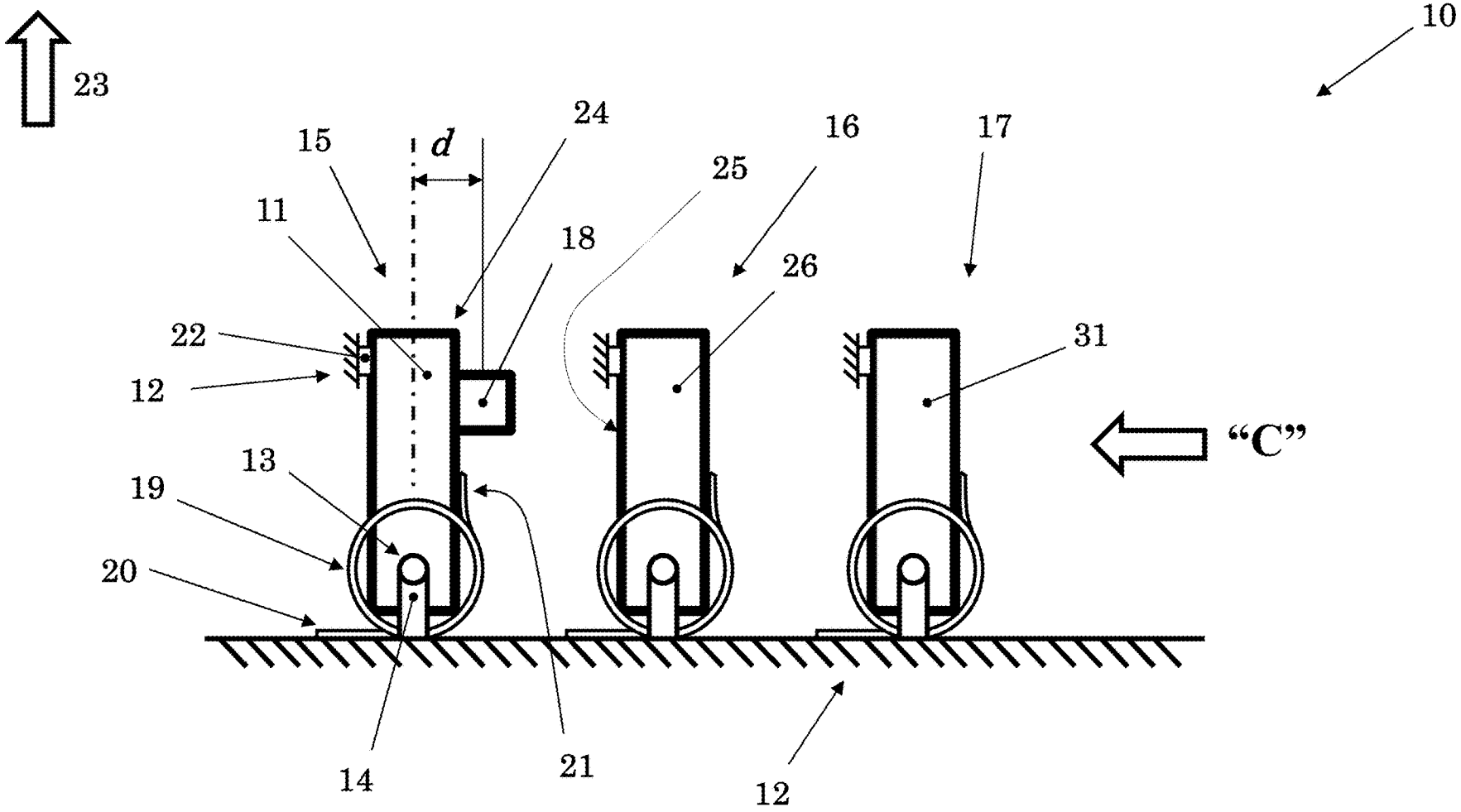
FIG. 6A illustrates the schematic side view of the first inertial mechanical delay mechanism embodiment for generating long duration delays in various devices in its pre-activation state.

In the schematic of FIG. 6A, the inertial mechanical delay mechanism embodiment 10 is shown in its resting configuration (pre-activation state). The inertial mechanical delay mechanism embodiment 10 is illustrated having three rotary beam assemblies 15, 16 and 17. It is, however, appreciated that the inertial mechanical delay mechanism may be constructed with fewer or more such rotary beam assemblies.

In the inertial mechanical delay mechanism embodiment 10 of FIG. 6A, the three rotary beam assemblies are identical, except for the first one (rotary beam assembly 15), which is provided with an additional offset mass 18, the function of which is described later. It is appreciated, however, that the individual rotary beam assemblies may be configured differently in shape, size, etc., to achieve different performance characteristics for the resulting inertial mechanical delay mechanism as described below.

The inertial mechanical delay mechanism embodiment 10 of FIG. 6A includes a first rotary beam assembly 15, which is constructed with a beam element 11, which is attached to the mechanism base structure 12 by the rotary joint 13, which is provided in the support member 14. The beam assembly is also provided with a slightly preloaded torsion spring 19, which is positioned to apply a torque to the beam 11 about the axis of the joint 13. One end 20 of the torsion spring 19 is held against the inertial mechanical delay mechanism base structure 12 and the other end 21 rests against the surface of the beam element 11, thereby the slight preloading of the torsion spring 19 in the configuration shown in FIG. 6A would bias the beam element 11 to stay in contact against the stop 22 by the application of a relatively small counterclockwise torque to the beam element 11. The beam element 11 is configured such that its center of mass (not shown) lies in the direction parallel to the direction of the prescribed acceleration (shown by the arrow 23) to which the inertial mechanical delay mechanism embodiment 10 is configured to respond.

It is noted that for the sake of simplicity, the torsion spring 19 of the rotary beam assembly 15 and the torsion springs of the rotary beam assemblies 16 and 17 are considered to have constant torque, particularly for their limited range of utilized motions in the present inertial mechanical delay mechanisms. It is, however, appreciated by those skilled in the art that when configuring such inertial mechanical delay mechanisms, the increase in their applied torque to the assembly beam elements must be considered.

As a result, when the inertial mechanical delay mechanism embodiment 10 is subjected to an acceleration in the direction of the arrow 23, the dynamic forces generated by the mass of the beam elements of the rotary beam assembly units 16 and 17 would pass through their rotary joints (13 in the rotary beam assembly 15), thereby it would not tend to rotate their beam elements in either clockwise or counterclockwise direction. It is also appreciated that any slight deviation of the centers is mass from the lines parallel to the direction of the arrow 23 that passes through their rotary joints are configured to be counteracted by preloaded torsion springs (19 in the rotary beam assembly 15), thereby keeping the beam elements of these rotary beam assemblies biased against their stops (22 in the rotary beam assembly 15).

In the inertial mechanical delay mechanism embodiment 10 of FIG. 6A, the beam element 11 of the first rotary beam assembly 15 is provided with an "offset" mass 18, which is intended to shift the center of mass of the beam element 11 a certain amount to the right (as viewed in FIG. 6A) of the line parallel to the direction of the arrow 23 that passes through the center of the rotary joint 13. As a result, when the inertial mechanical delay mechanism embodiment 10 is subjected to an acceleration in the direction of the arrow 23, the offset mass 18 generate a net downward dynamic force, which being a certain distance (d in FIG. 6A) to the right of the said line (parallel to the direction of the arrow 23 and passing through the center of the rotary joint 13), would generate a torque in the direction perpendicular to the plane of the FIG. 6A, which would tend to rotate the beam element 11 in the clockwise direction.

Now, if the device to which the inertial mechanical delay mechanism embodiment 10 of FIG. 6A is attached is accelerated in the direction of the arrow, the dynamic force generated by the acceleration acting on the inertia of the offset mass 18 of the first rotary beam assembly 15 generates an initial clockwise torque $\tau$ $$\tau = mad \tag{1}$$

where m is the mass of the offset mass 18, a is the device acceleration in the direction of the arrow 23, and d is the aforementioned distance of the center of mass of the offset mass 18 from the centerline of the link element as indicated previously and shown in FIG. 6A. The generated clockwise torque $\tau$ would then tend to rotate the beam member 11 in the clockwise direction but must first overcome the counterclockwise torque provided by the preloaded torsion spring 19.

Therefore, if the acceleration a in the direction of the arrow 23 is not enough to generate a torque $\tau$ that would overcome the preloading torque of the spring 19, then the beam element 11 would stay stationary in its position shown in FIG. 6A, resting against the stop 22. However, if the acceleration a in the direction of the arrow 23 is high enough to overcome the preloading torque of the spring 19, then the beam element 11 would begin to rotate in the clockwise direction.

Now if the magnitude of the acceleration a in the direction of the arrow 23 is relatively low and/or its duration is relatively short, then the beam element 11 is accelerated in the clockwise direction a relatively small angle and is then returned to its starting position shown in FIG. 6A.

Figure 6B:
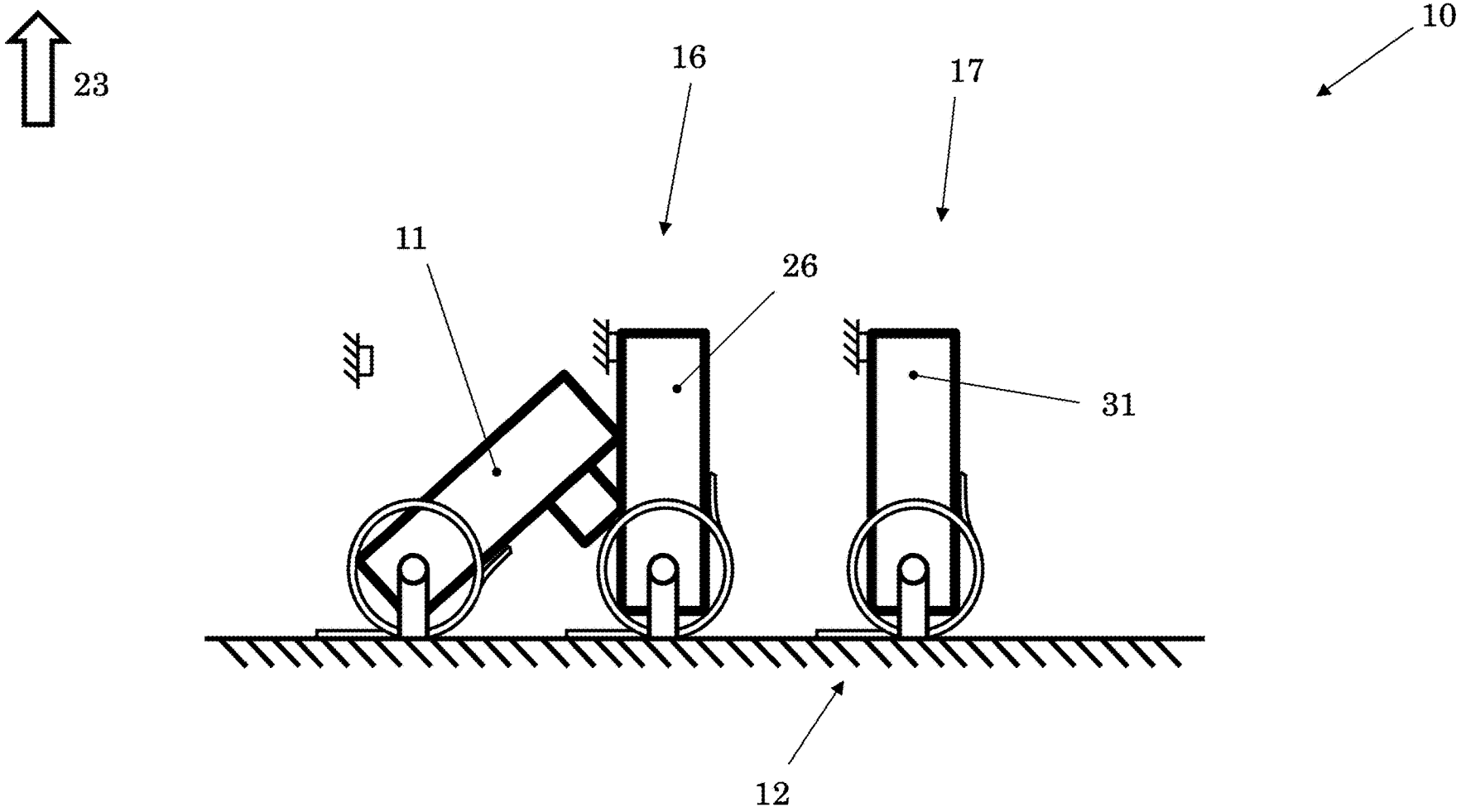
FIG. 6B illustrates the schematic of the inertial mechanical delay mechanism of FIG. 6A when subjected to a prescribed acceleration level and duration and rotation of its first rotary beam assembly unit before activating the second rotary beam assembly unit of the inertial mechanical delay mechanism.
Figure 6C:
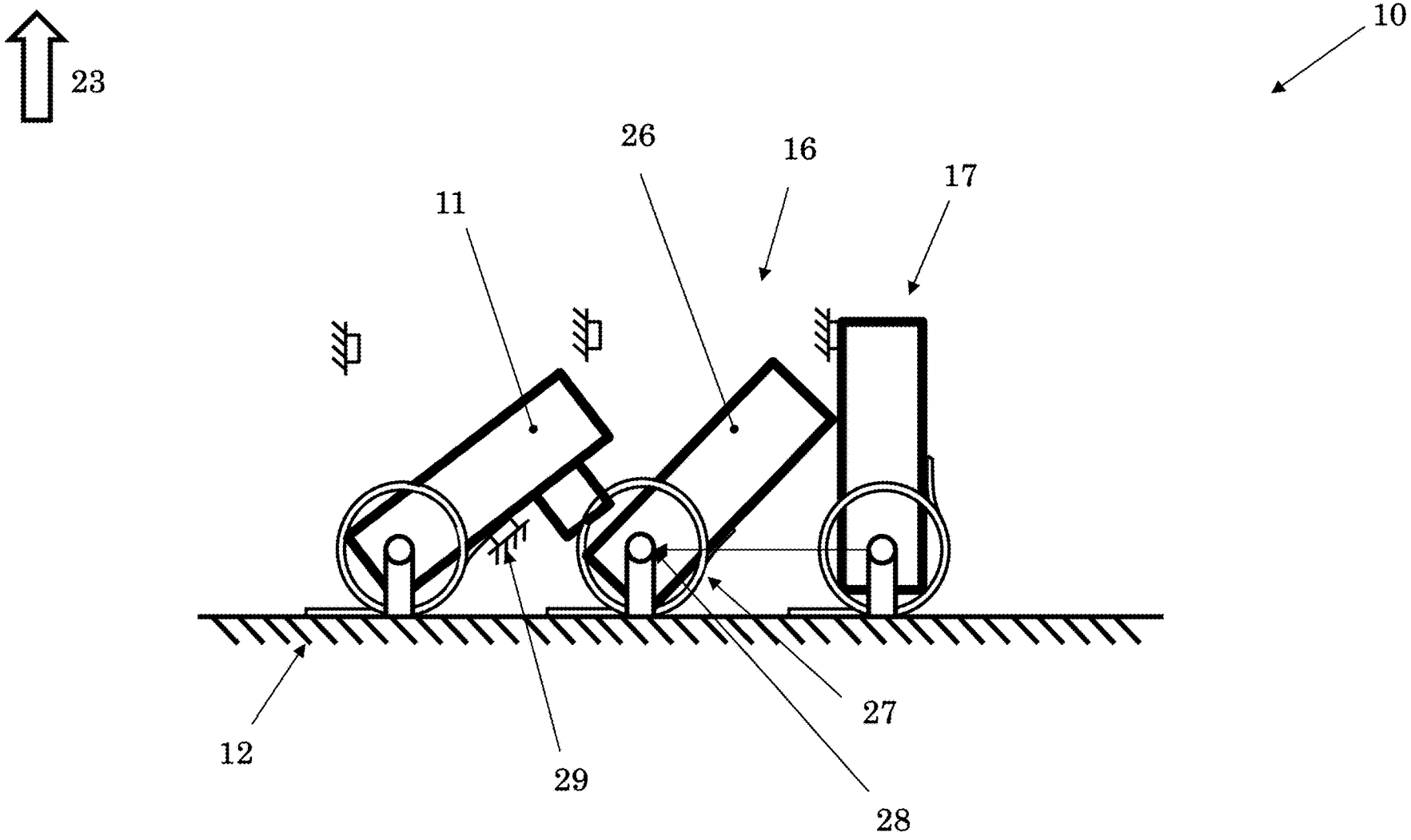
FIG. 6C illustrates the schematic of the inertial mechanical delay mechanism of FIG. 6A when subjected to a prescribed acceleration level and duration and sequential rotation of its first two rotary beam assembly units and before activating the third rotary beam assembly unit of the inertial mechanical delay mechanism.

However, if the magnitude of the acceleration a in the direction of the arrow 23 is high enough and its duration is long enough, then the beam element 11 is rotationally accelerated in the clockwise direction until the tip 24 strikes the side 25 of the beam element 26 (FIG. 6A) of the second rotary beam assembly 16 as shown in the schematic of FIG. 6B. The beam member 16 would thereby tend to rotate in the clockwise direction. Then if the force applied by the beam element 11 to the side 25 of the beam element is large enough to overcome the preloading torque of the torsional spring 27 of the rotary beam assembly 16, then the beam element 26 would begin to rotate in the clockwise direction as viewed in FIG. 6C. Now if the beam element 26 is rotated in the clockwise direction enough to move its center of mass to the right of its rotary joint 28 (as indicated from a line parallel to the direction of the arrow 23 and passing through the joint 28) so that the dynamic force acting on its center of mass would generate a torque that would overcome the (aforementioned assumed constant) preloading torque of the torsion spring 27, then if the applied acceleration in the direction of the arrow 23 persists, then the beam element 26 would continue to be rotationally accelerated in the clockwise direction.

It is appreciated by those skilled in the art that as a beam element of a rotary beam assembly (e.g., beam element 11 of the rotary beam assembly 15) is rotated in the clockwise direction due to the applied acceleration in the direction of the arrow 23 as was previously described, its center of mass shifts to the right as viewed in FIGS. 6A-6D, and thereby the dynamic force acting on its center of mass gains increased moment arm and generates an increasing amount of clockwise torque to the beam element. As a result, its clockwise rotational acceleration is increased. This is obviously the case only with the aforementioned assumption of the preloaded torsion springs (e.g., the torsion spring 19 in FIG. 6A) being of a constant torsion type.

However, if the preloaded torsion springs (e.g., torsion spring 19 in FIG. 6A) is not a constant torque type spring, then as the beam of the rotary beam assembly rotates in the clockwise direction, the torsion spring would apply an increasing amount of counterclockwise toque to the beam. In general, the spring rate of the torsion springs of the rotary beam assemblies can be used as a parameter to control the clockwise motion of each beam of each rotary beam assembly of an inertial mechanical delay mechanism and the force and impulse that they impart on the beam element of the next rotary beam assembly. In addition, higher spring rates is also used to provide for higher minimum acceleration magnitude that would cause the first (or even intermediate) rotary beam assembly to activate the next rotary beam assembly, i.e., to rotate it to point from which it would continue its accelerated clockwise rotation.

Figure 6D:
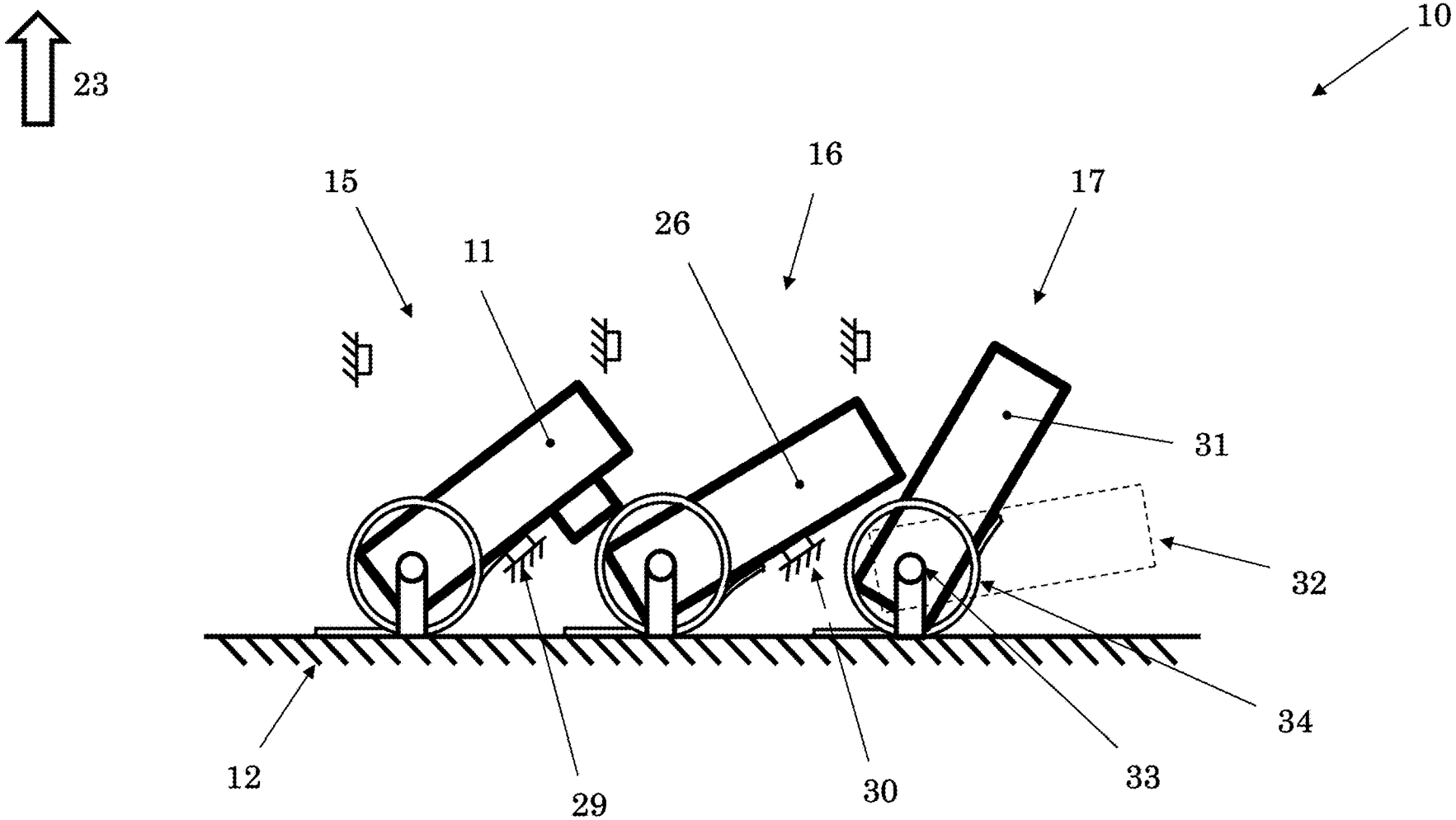
FIG. 6D illustrates the schematic of the inertial mechanical delay mechanism of FIG. 6A when subjected to a prescribed acceleration level and duration and sequential rotation of its first three rotary beam assembly units of the inertial mechanical delay mechanism.

It is also appreciated that when it is desired to limit the amount of force that the beam element of one rotary beam assembly applies to the beam element of the next rotary beam assembly, the beam element can be provided with a stop member limiting its clockwise rotation as viewed in the schematics of FIGS. 6A-6D. For example, as can be seen in the schematic of FIG. 6D, the beam elements 11 and 26 are provided with stops 29 and 30, respectively, to limit their clockwise rotations as the inertial mechanical delay mechanism embodiment 10 is subjected to acceleration in the direction of the arrow 23 with the prescribe magnitude and duration.

Again, if the magnitude of the acceleration a in the direction of the arrow 23 stays high enough and its duration also stays long enough, then the beam element 31 is similarly rotationally accelerated in the clockwise direction, as shown by dashed lines in FIG. 6D and indicated by the numeral 32, until it interacts with any element provided in the device in which the inertial mechanical delay mechanism embodiment 10 is integrated, examples of which are provided later in this disclosure. This obviously occurs as previously described for the rotary beam assembly 16, i.e., if the beam element 31 is rotated in the clockwise direction enough to move its center of mass to the right of its rotary joint 33 (as indicated from a line parallel to the direction of the arrow 23 and passing through the joint 33) so that the dynamic force acting on its center of mass would generate a torque that would overcome the (aforementioned assumed constant) preloading torque of the torsion spring 34, then if the applied acceleration in the direction of the arrow 23 persists, the beam element 31 would continue to be rotationally accelerated in the clockwise direction.

It is appreciated that once the applied acceleration in the direction of the arrow 23 has ceased, the rotary beam assembly units 15, 16 and 17 would reset, returning to their initial configuration shown in FIG. 6A.

It is appreciated by those skilled in the art that in the process of activation of the rotary beam assembly units 15, 16 and 17 of the inertial mechanical delay mechanism embodiment 10 of FIGS. 6A-D, the three rotary beam units are considered to be identical except for the offset mass 18 of the unit 15. However, each unit may be configured with different geometrical, inertial and torsion spring rate and preloading level, etc., so that they would respond differently to different acceleration magnitudes and durations. For example, the first rotary beam assembly unit 15 may be configured with small offset mass but high moment of inertia about the joint 13 and with high torsion spring 19 preload so that it would begin its clockwise rotation at a high magnitude of acceleration in the direction of the arrow 23 and rotates clockwise slowly before it activates the second rotary beam assembly 16.

It is appreciated by those skilled in the art that the inertial mechanical delay mechanism embodiment 10 of FIG. 6A-6D may be provide with more or fewer rotary beam assemblies. It is also appreciated that by increasing the number of properly configured rotary beam units, the delay time of the mechanism can be increased to the desired level.

It is noted that the beam members rotary beam assemblies of the inertial mechanical delay mechanism of the embodiment 10 of FIG. 6A are attached to the delay mechanism base structure by rotary joints using shafts and sleeve or ball or the like bearings. It is appreciated by those skilled in the art that one or all the beam element joints may also be living joints, which are well known in the art.

Figure 7:
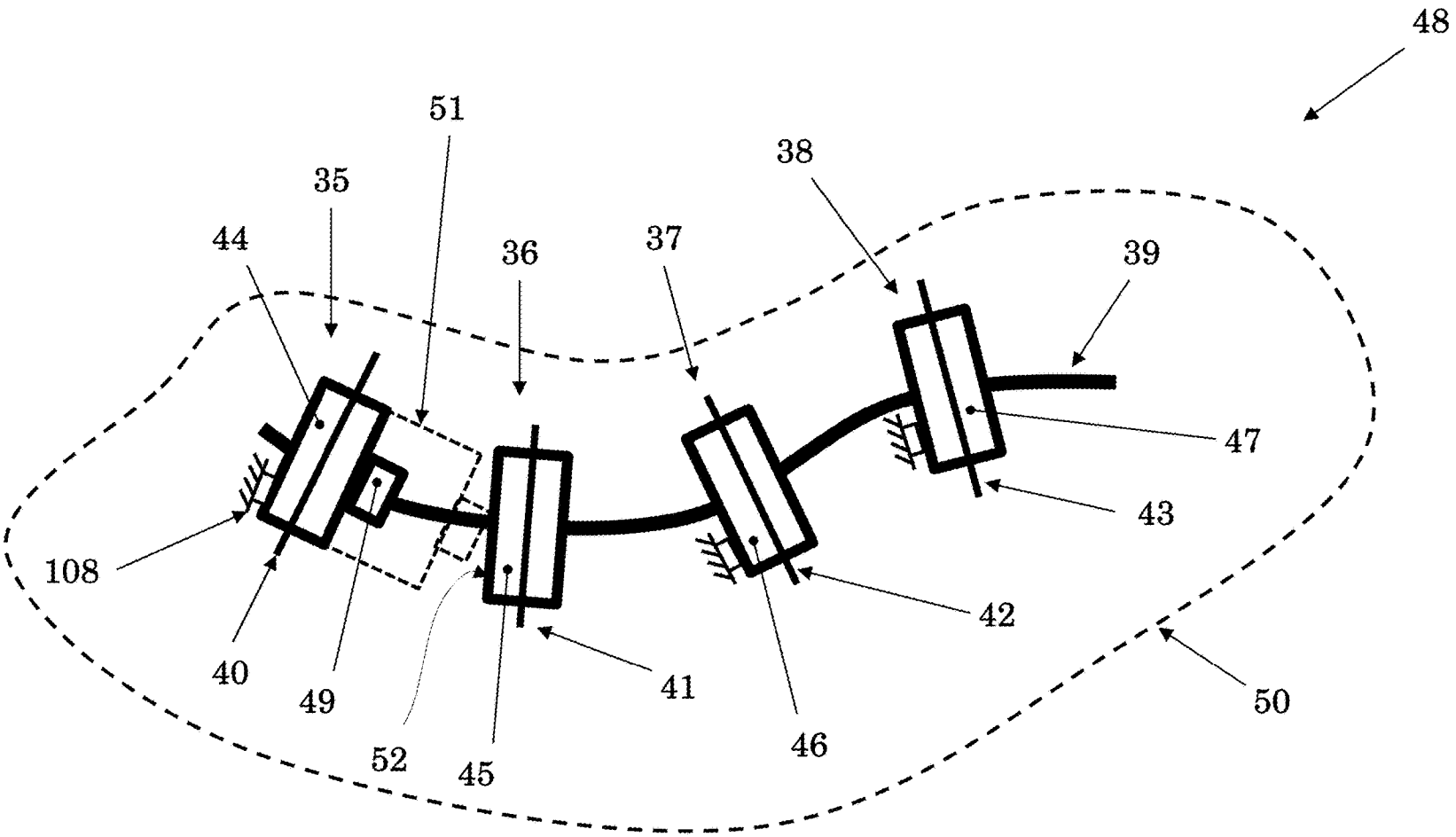
FIG. 7 illustrates the top view of an inertial mechanical delay mechanism of the type of the embodiment of FIG. 6A, in which its rotary beam assembly units are arranged along a curved path configuration.

It is also noted that in the inertial mechanical delay mechanism of the embodiment 10 of FIG. 6A, the beam elements of the rotary beam assemblies 11, 26 and 31 of the rotary beam assembly units 15, 16 and 17, respectively, move rotationally in parallel and essentially coincident planes. It is, however, appreciated that that the rotary beam assemblies may be "arranged" in over the inertial mechanical delay mechanism base structure 12 in many different configurations, if they can be sequentially activated when the delay mechanism is subjected to the prescribed activation acceleration profile in the direction of the arrow 23. In one such alternative configuration of the rotary beam assembly units, top view of which is shown in the schematic of FIG. 7 and the resulting inertial mechanical delay mechanism indicated as the embodiment 48, four rotary beam assemblies, indicated by the numerals 35, 36, 37 and 38 are seen to be arranged along a curved line 39. In the top view of FIG. 7, the axes of the rotary joints (e.g., 13 in FIG. 6A) of the beam elements 44, 45, 46 and 47 of the rotary beam assemblies 35, 36, 37 and 38 are shown as lines 40, 41, 42 and 43, respectively.

In the alternative configuration of the rotary beam assembly units of the embodiment 48 of FIG. 7, all rotary beam assembly units are considered to be identical and like those of the embodiment 10 of FIG. 6A, except for the first rotary beam assembly unit 35, which is provided with the offset mass 49, like the offset mass 18 of the rotary beam assembly unit 15 of the embodiment 10 of FIG. 6A.

In the embodiment 48 of FIG. 7, the support members (14 in FIG. 6A for the rotary beam assembly 15) of the rotary beam assemblies 35, 36, 37 and 38 (not visible in the top view of FIG. 7) are considered to be fixedly attached to the base structure 50 of the inertial mechanical delay mechanism, which is shown by the dashed line in the schematic of FIG. 7. All beam elements of the rotary beam assembly units are also provided with stops on the base structure 50 of the inertial mechanical delay mechanism (e.g., the stop 108 for the beam element 44 of the rotary beam assembly unit 35—similar to the stop 22 for the beam element 11 of the rotary beam assembly 15 of the embodiment of FIG. 10).

In this embodiment, the inertial mechanical delay mechanism is configured to be activated when subjected to a prescribed minimum acceleration magnitude and duration in the direction perpendicular to and out of the plane of the of the FIG. 7. As a result of such an acceleration profile, the beam element 44 of the first rotary beam assembly 35 is rotated forward as shown by the dashed lines and indicated by the numeral 51, causing its offset mass 49 to engage back surface 52 of the second rotary beam assembly 36 and cause it to activate by similarly rotating it forward and as was previously described for the embodiment 10 of FIG. 6A, sequentially activate the following rotary beam assemblies.

In the inertial mechanical delay mechanism embodiment 48 of FIG. 7, the rotary beam assemblies 35, 36, 37 and 38 are seen to be effectively positioned along the curved path 39. It is, however, appreciated by those skilled in the art that the curve can be almost any shape, as long as the rotary beam assemblies can interact and sequentially be activated as was described for the embodiment 10 of FIG. 6A, i.e., as long as the beam element of one unit can be rotated and reach the back surface of the beam of the next rotary beam assembly to cause it to be activated.

Figure 8:
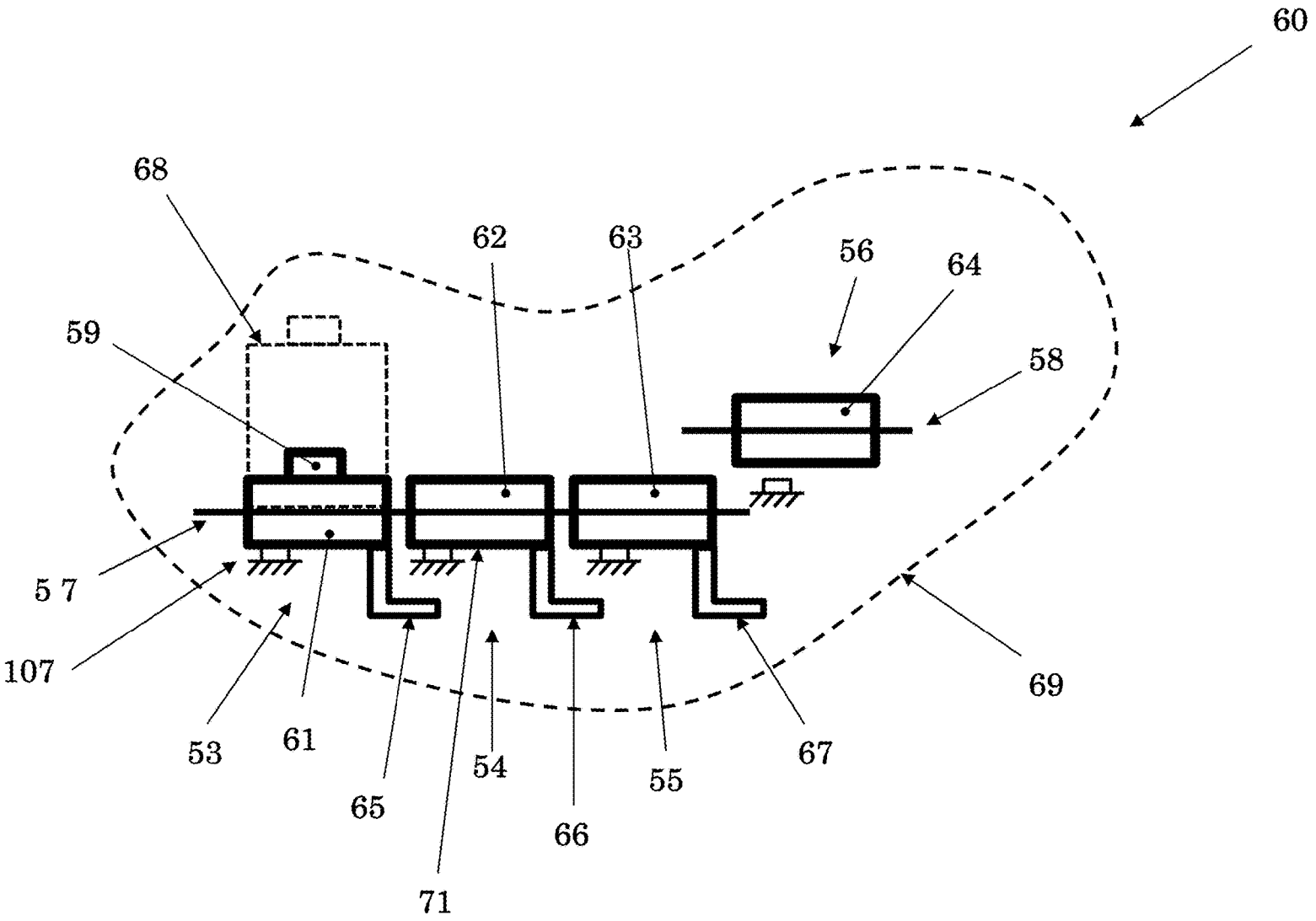
FIG. 8 illustrates the top view of an inertial mechanical delay mechanism of the type of the embodiment of FIG. 6A, in which its rotary beam assembly units are arranged side by side.

In another alternative configuration of the rotary beam assembly units, top view of which is shown in the schematic of FIG. 8 and the resulting inertial mechanical delay mechanism indicated as the embodiment 60, four rotary beam assemblies, indicated by the numerals 53, 54, 55 and 56 are shown to be used. In this arrangement, at least three rotary beam assembly units are positioned side by side, with their rotary joint shafts 57 that could be in one piece. The fourth rotary beam assembly 56 is positioned in front of the other three units as shown in FIG. 8, with its rotary joint shaft 58 being parallel to the shaft 57. It is, however, is appreciated that the rotary beam assembly 56 may be oriented in any arbitrary direction, as long as it can be reached to be activated by its previous rotary beam assembly unit, in this case the unit 55.

In the schematic of FIG. 8, the beam elements of the rotary beam assemblies 53, 54, 55 and 56 are indicated by the numerals 61, 62, 63 and 64, respectively.

In the alternative configuration of the rotary beam assembly units of the embodiment 60 of FIG. 8, all rotary beam assembly units are considered to be identical and like those of the embodiment 10 of FIG. 6A, except for the first rotary beam assembly unit 61, which is provided with the offset mass 59, like the offset mass 18 of the rotary beam assembly unit 15 of the embodiment 10 of FIG. 6A, and for the added activation appendages 65, 66 and 67 of the beam elements 61, 62 and 63 of the rotary beam assemblies 53, 54 and 55.

In the inertial mechanical delay mechanism embodiment 60 of FIG. 8, the support members (14 in FIG. 6A for the rotary beam assembly 15) of the rotary beam assemblies 53, 54, 55 and 56 (not visible in the top view of FIG. 8) are considered to be fixedly attached to the base structure 69 of the inertial mechanical delay mechanism, which is shown by the dashed line in the schematic of FIG. 8. All beam elements of the rotary beam assembly units are also provided with stops on the base structure 69 of the inertial mechanical delay mechanism (e.g., the stop 107 for the beam element 61 of the rotary beam assembly unit 53—similar to the stop 22 for the beam element 11 of the rotary beam assembly 15 of the embodiment of FIG. 10).

In this embodiment, the inertial mechanical delay mechanism is configured to be activated when subjected to a prescribed minimum acceleration magnitude and duration in the direction perpendicular to and out of the plane of the of the FIG. 8. As a result of such an acceleration profile, the beam element 61 of the first rotary beam assembly 53 is rotated forward as was described for the first rotary beam assembly 15 of the embodiment 10 of FIG. 6A and shown by the dashed line in FIG. 8 and indicated by the numeral 68, causing its appendages 65 to engage back surface 71 of the second rotary beam assembly 54 and cause it to activate by similarly rotating it forward and as was previously described for the embodiment 10 of FIG. 6A, sequentially activate the following rotary beam assemblies.

It is appreciated that as it was described for the inertial mechanical delay mechanism 10 of FIG. 6A, when it is desired to limit the amount of force that the beam element of one rotary beam assembly applies to the beam element of the next rotary beam assembly in the inertial mechanical delay mechanism embodiments 48 and 60 of FIGS. 7 and 8, the beam element can be provided with stop members (like stop member 29 for the beam element 11 of the rotary beam assembly 15, FIGS. 6A-6D) to limit their rotation following activation of the next rotary beam assembly.

It is appreciated that in many applications, an inertial mechanical delay mechanism must operate the device that it is integrated to only when the device is subjected to the prescribed minimum acceleration magnitude and duration (all-fire condition in munitions) in a given direction (direction of the arrow 23 in the embodiment of FIG. 6A and perpendicular and out of the plane of the views of the embodiments 48 and 60 of FIGS. 7 and 8, respectively). It is appreciated that the rotary beam assemblies of the above inertial mechanical delay mechanism embodiments also respond to lateral acceleration (right to left as viewed in the plane of FIG. 6A, downward direction and parallel to the plane of view of FIG. 8, and almost any such lateral directions in the embodiment of FIG. 7). For example, as can be seen in the schematic of FIG. 6A, if the inertial mechanical delay mechanism embodiment 10 is accelerated to the left as viewed in FIG. 6A, since the centers of mass of the links 11, 26 and 31 are located above the rotary joints (13 for the beam 11), the generated dynamic force acting at the centers of mass of the links would generate a clockwise torque that would tend to rotate the links in the clockwise direction. The following modification in the configuration of the link members of the rotary beam assemblies of the above embodiments would eliminate this shortcoming of these embodiments for such applications.

Figure 9:
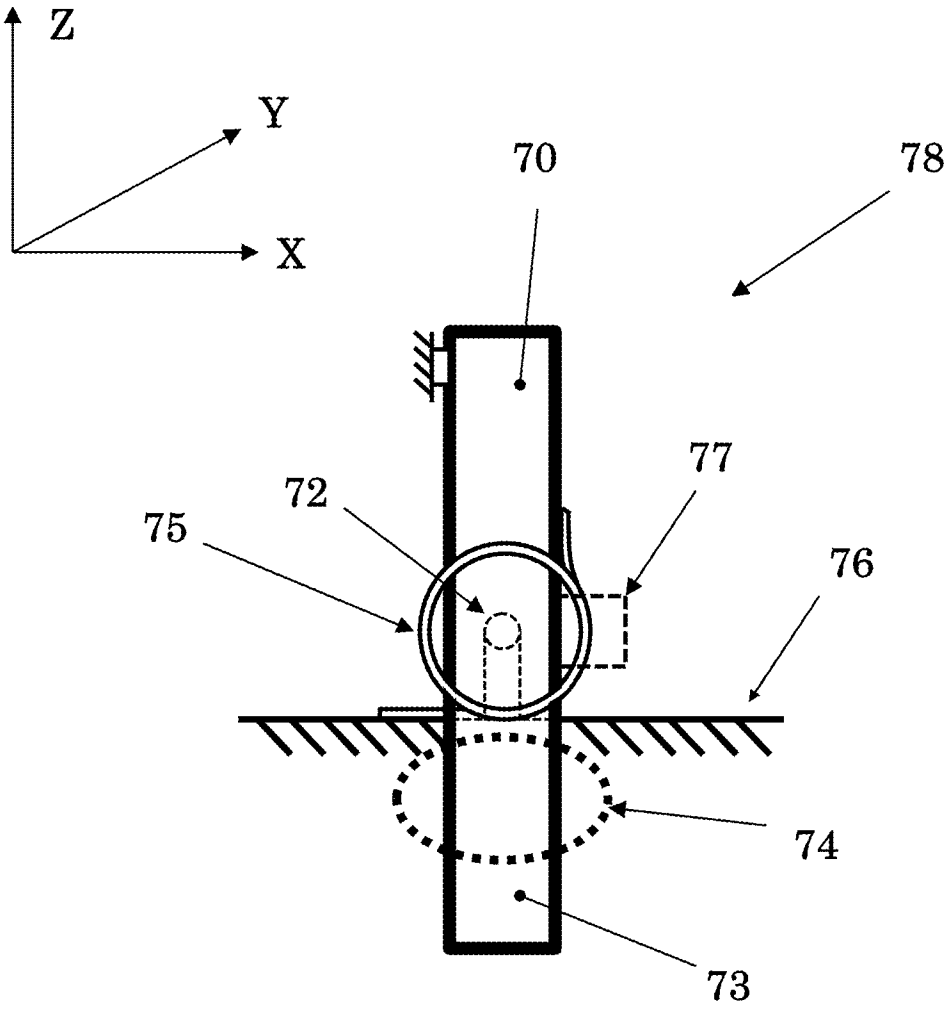
FIG. 9 illustrates the schematic side view of a rotary beam assembly unit of the inertial mechanical delay mechanisms of the embodiments of FIGS. 6A-6D, 7 and 8 in which the center of mass of the beam element coincident with its rotary joint to make it resistant to acceleration in any direction other than the direction of the prescribed acceleration to which it is configured to respond.

FIG. 9 illustrates the schematic side view of a rotary beam assembly unit, indicated by the numeral 78, of the inertial mechanical delay mechanisms of the embodiments of FIGS. 6A-6D, 7 and 8 in which the center of mass of the beam element is configured to be coincident with its rotary joint axis. In FIG. 9, the beam element 70 of the rotary beam assembly to render its geometry symmetrical about the axis of its rotary joint 72 (by adding the lower segment 73 to the beam 70) and position its center of mass coincident with the axis of the rotary joint 72. As a result, the aforementioned lateral acceleration (the negative X direction in FIG. 9) would not generate a clockwise torque to rotate the beam element 70. It is noted that other components of the rotary beam assembly are identical to those of the rotary beam assemblies of the inertial mechanical delay mechanisms of the embodiments of FIGS. 6A-6D, 7 and 8, such as rotary beam assemblies 16 and 17 or 36 and 37 of FIGS. 6A and 7, respectively.

It is appreciated by those skilled in the art that to position the center of mass of the link element 70 of the rotary beam assembly of FIG. 9 at the center of the rotary joint 72, instead of making the link geometrically symmetrical as was described above, an equivalent mass 74 may be positioned as shown in FIG. 9 for the same effect but with the objective of reducing the extent of the added segment 73.

It is appreciated that for the first rotary beam assemblies (e.g., 15 in FIG. 6A), the offset mass (18, 49 and 59 in FIGS. 6A, 7 and 8, respectively), the offset mass 77 may also be moved in line (in the X-axis direction) with the rotary joint 72 so that acceleration in any direction except the direction of the positive Z-axis (arrow 23 in FIG. 6A) would not generate and apply a clockwise torque to the beam element 70 of the rotary beam assembly.

In general, two basic novel methods may be used to develop the present novel inertial mechanical delay mechanisms.

The first novel method, which was used to develop the inertial mechanical delay mechanisms 10, 48 and 60 of FIGS. 6A, 7 and 8, respectively, is based on using rotary beam assemblies, in which the beam element of the first assembly is provided with an offset mass and responds to the prescribed acceleration profile, i.e., minimum acceleration magnitude and duration, to rotate as was described for the rotary beam assembly 15 of FIG. 6A, and strike the next rotary beam assembly to start it to rotate and sequentially rotate (activate) the provided rotary beam assemblies. The rotation of the beam element of the last rotary beam assembly is then configured to "actuate" or "initiate" the device in which the inertial mechanical delay mechanism is employed. The inertial mechanical delay mechanisms would reset if the applied acceleration magnitude were less than the prescribed minimum magnitude or its duration is shorter than the prescribed minimum.

The second method is based on using rotary beam assemblies, in which the beam element of the first assembly is also provided with an offset mass, which responds to the prescribed acceleration profile, i.e., minimum acceleration magnitude and duration, and begin to rotate as was described for the rotary beam assembly 15 of FIG. 6A. In this method, all rotary beam assemblies are provided with offset mass members like the offset mass 18 that is provided for the first rotary beam member 15 of FIG. 6A. Then as the beam element of the first rotary beam assembly rotates, it engages a release mechanism (an example of which is described later in this disclosure) that prevents rotation of the beam elements of all the other rotary beam assemblies and releases the beam element of the next (second) rotary beam assembly. The beam element of the second rotary beam assembly would then begin to similarly rotate due to the action of the applied acceleration on its offset mass and similarly release the beam element of the next rotary beam assembly. All rotary beam assemblies are therefor sequentially activated as long as the applied acceleration persist. However, if the applied acceleration ceases, then all beam elements of the inertial mechanical delay mechanism would return to their initial pre-activation positioning by their provided preloaded torsion springs as was described for the inertial mechanical delay mechanism embodiment 10 of FIG. 6A.

One feature of the inertial mechanical delay mechanisms that are configured using the above first method, such as the inertial mechanical delay mechanisms 10, 48 and 60 of FIGS. 6A, 7 and 8, respectively, is that each beam element of a rotary beam assembly is configured to activate the next rotary beam assembly by impacting the back surface of its beam element. Such impacts results in the impacted beam element to start its motion with a non-zero rotational velocity due to the resulting momentum transfer. As a result, the generated delay time by each rotary beam assembly unit becomes shorter than if the beam elements would have started with a zero rotational velocity. In addition, since momentum transfer between impacting beam elements is generally difficult to be reliably predicted, the imparted initial rotational velocity of the impacted beam element cannot be reliably predicted. As a result, the delay time of an inertial mechanical delay mechanism becomes relatively short and not very reliably predictable.

The operational characteristic of the inertial mechanical delay mechanisms that are configured using the above second method, however, ensures that the beam elements of each rotary beam assembly start its motion with zero initial rotary velocity upon release. As a result, the inertial mechanical delay mechanisms would generate relatively longer delay time and that the resulting delay time is more reliably predictable.

It is appreciated that numerous mechanisms may be used for sequential releasing rotary beam elements of an inertial mechanical delay mechanism that is configured based on the above second method from rest (zero initial velocity). The release mechanism to be used can be resettable if the applied acceleration magnitude is below the prescribed threshold and more importantly if the applied acceleration magnitude is at or above the prescribed threshold but its duration is below the prescribed duration. This is the case since one or more of the rotary beam assembly units may have already been activated and to keep the inertial mechanical delay mechanism operational, the mechanism must be resettable after the applied acceleration has ceased or has dropped below its magnitude threshold.

Figure 10:
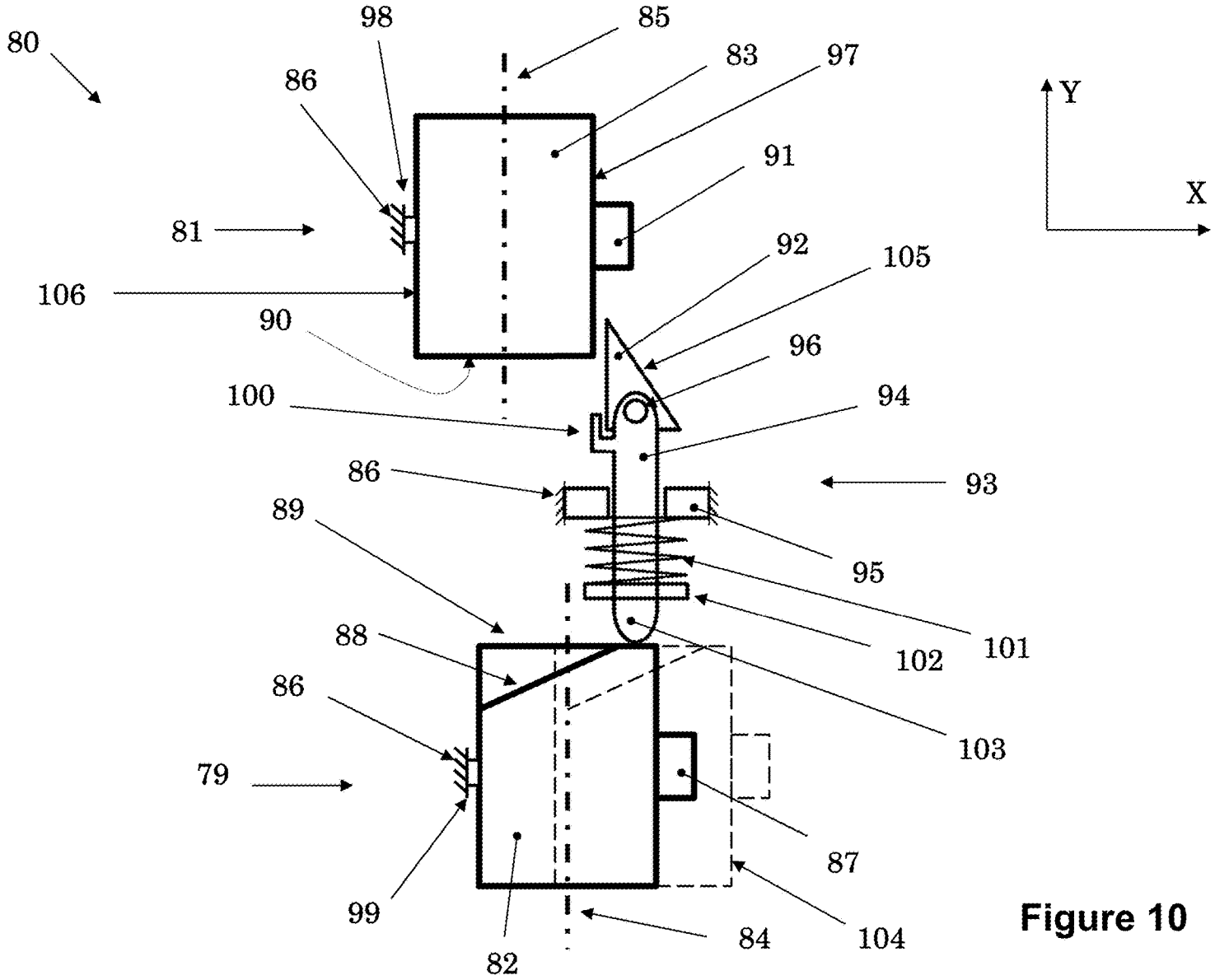
FIG. 10 illustrates the schematic of the top view of an inertial mechanical delay mechanism configured to sequentially release beam elements of the rotary beam assemblies with zero initial rotary velocity.

An example configuration of a resettable inertial mechanical delay mechanism based on the above second method is shown in the top view schematic of FIG. 10 and is indicated as the embodiment 80. In the schematic of FIG. 10 and for the sake of simplicity, only the first rotary beam assembly and one of the next rotary beam assemblies that are sequentially active upon detection of the prescribed acceleration with minimum magnitude and duration thresholds are shown.

In the top view of FIG. 10, the inertial mechanical delay mechanism is shown with its first activated rotary beam assembly 79 and one of its at least one next rotary beam assemblies 81, which are configured to be sequentially activated as was described for the previous embodiments. The beam elements 82 and 83 of the rotary beam assemblies 79 and 81, respectively, are attached to their support members like those of the embodiment 10 of FIG. 6A (e.g., support member 14 in FIG. 6A for the rotary beam assembly 15), which are not visible in the top view of FIG. 10, by rotary joints indicated by dashed lines 84 and 85, respectively, which are intended to indicate the shafts of the said rotary joints. The support members of the rotary beam assemblies 79 and 81 are fixedly attached to the base structure (not shown) of the inertial mechanical delay mechanism, a small portion 86 of which is shown in FIG. 10. In addition, similar to the rotary beam assemblies of the embodiment 10 of FIG. 6A, the rotary beam assemblies 79 and 81 are provided with stops 99 and 98, respectively, which are fixedly attached to the base structure 86 of the inertial mechanical delay mechanism 80. The stops 99 and 98 are provided to prevent the beam elements 82 and 83, respectively, from rotation in the direction of the −Y axis, i.e., in the backward direction as viewed in the top view of FIG. 10. In the inertial mechanical delay mechanism embodiment 80 of FIG. 10, all rotary beam assembly units are identical except for the first rotary beam assembly 79, which is provided with the angled cutout 88, which may run all the length of the side 89 (not the case in FIG. 10) of the beam element 82 facing the side 90 of the beam element 83 of the rotary beam assembly 81. All rotary beam assemblies of this embodiment are provided with the offset mass members 87 and 91 for the beam elements 82 and 83, respectively, similar to the offset mass 18 in the first rotary beam assembly unit 15 of the embodiment 10 of FIG. 6A. All rotary beam assembly units are provided with preloaded torsional springs like those of the rotary beam assembly units of the embodiment 10 of FIG. 6A.

In this embodiment, the inertial mechanical delay mechanism is configured to be activated when subjected to a prescribed minimum acceleration magnitude and duration in the +Z direction (normal to X-Y plane, FIG. 10. When subjected to the indicated prescribed acceleration profile, their offset mass (87 and 91 for the beam elements 82 and 83, respectively) would generate a torque in the direction of +Y axis, which could tend to rotate them in the same direction, i.e., in the clockwise direction as viewed in their side view similar to the side view of the embodiment 10 of FIG. 6A.

Now if the inertial mechanical delay mechanism embodiment 80 is subjected to the prescribed minimum acceleration magnitude and duration in the +Z direction (all-fire condition in munitions), the acceleration would act on the offset mass 87 of the first rotary beam assembly 79, generating a torque in the +Y axis direction, overcome the preloading torque of its torsion spring and begin to rotate its beam element 82 about the +Y axis as was described for the first rotary beam assembly 15 of the embodiment 10 of FIG. 6A.

It is appreciated that the applied acceleration would also act on the offset mass 91 of the rotary beam assembly unit 81 and generate a similar torque that would overcome the unit preloaded torsion spring and tend to similarly rotate its beam element 83 about the +Y axis, i.e., forward as seen in the top view of FIG. 10. However, in the configuration of the inertial mechanical delay mechanism 80 of FIG. 10, the stop member 92 of the release mechanism 93, which is described below, is shown to prevent rotational motion of the beam element 83 of the rotary beam assembly.

The release mechanism 93 comprises the sliding member 94, which is free to slide up and down as viewed in FIG. 10 in the sliding bearing 95, which is fixedly attached to the base structure of the inertial mechanical delay mechanism 80 (not shown), to which the support members of the rotary joints 84 and 85 of the rotary beam assemblies 79 and 81, respectively, are also fixedly attached. As can be seen in the schematic of FIG. 10, the stop member 92 is attached to the sliding member 94 by the rotary joint 96, which is also provided with a slightly preloaded torsion spring (not shown) to bias the stop member against the surface 97 of the beam element 83, thereby preventing it from being activated, i.e., tilting forward to rotate in the direction of the +Y axis. While in the configuration of FIG. 10, the extended member 100 of the sliding member 94 prevents clockwise rotation of the stop member 92, thereby allowing it to resist clockwise rotation (rotation in the direction of the +Y axis) of the beam element 83 of the rotary beam assembly 81. However, the stop member 92 can rotate in the counter-clockwise direction as viewed in FIG. 10 to allow for resetting rotation of the beam element 83 in the opposite direction, i.e., rotation in the direction of the −Y axis.

The sliding member 94 is also provided with a section 102, between which the sliding bearing 95, i.e., the base structure 86 of the inertial mechanical delay mechanism embodiment 80, a preloaded compressive spring 101 is provided, FIG. 10. In the configuration, i.e., in the pre-activation state of the inertial mechanical delay mechanism embodiment 80, the preloaded compressive spring biases the rounded end 103 of the sliding member 94 to rest against the top surface 89 (usually the provided flat section) of the beam element 82 of the rotary beam assembly 79. In this configuration, as can be seen in the schematic of FIG. 10, the stop member 92 is positioned in front of the surface 97, preventing it from rotation when the inertial mechanical delay mechanism is subjected to the aforementioned prescribed acceleration in the direction of the +Z axis.

Figure 11A:
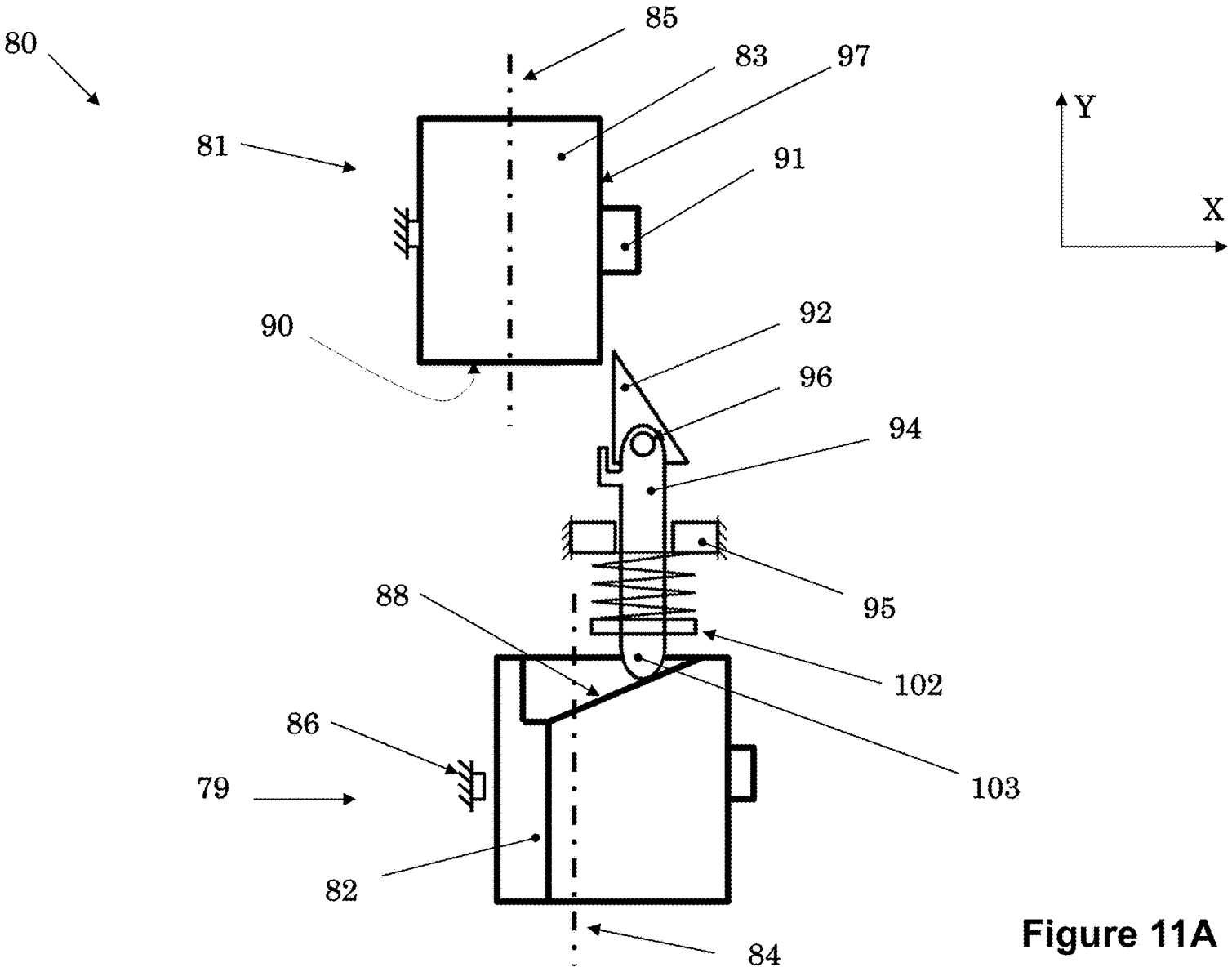
FIG. 11A illustrates the schematic of the top view of the inertial mechanical delay mechanism of the embodiment of FIG. 10 as it is subjected to the prescribed acceleration profile (all-fire condition in munitions).

Now when the inertial mechanical delay mechanism embodiment 80 is subjected to the prescribed minimum acceleration magnitude and duration in the +Z direction (all-fire condition in munitions), the beam element 82 of the first rotary beam assembly 79 is rotated in the direction of the +Y axis (using right hand rule) as was described for the first rotary beam assembly 15 of the embodiment 10 of FIG. 6A and shown by the dashed lines 104 in FIG. 10, causing the rounded end 103 of the sliding member 94 to move over the angled cutout 88 on the side 89 of the beam element 82, thereby causing the sliding member 94 to begin to move down as shown in the schematic of FIG. 11A.

Figure 11B:
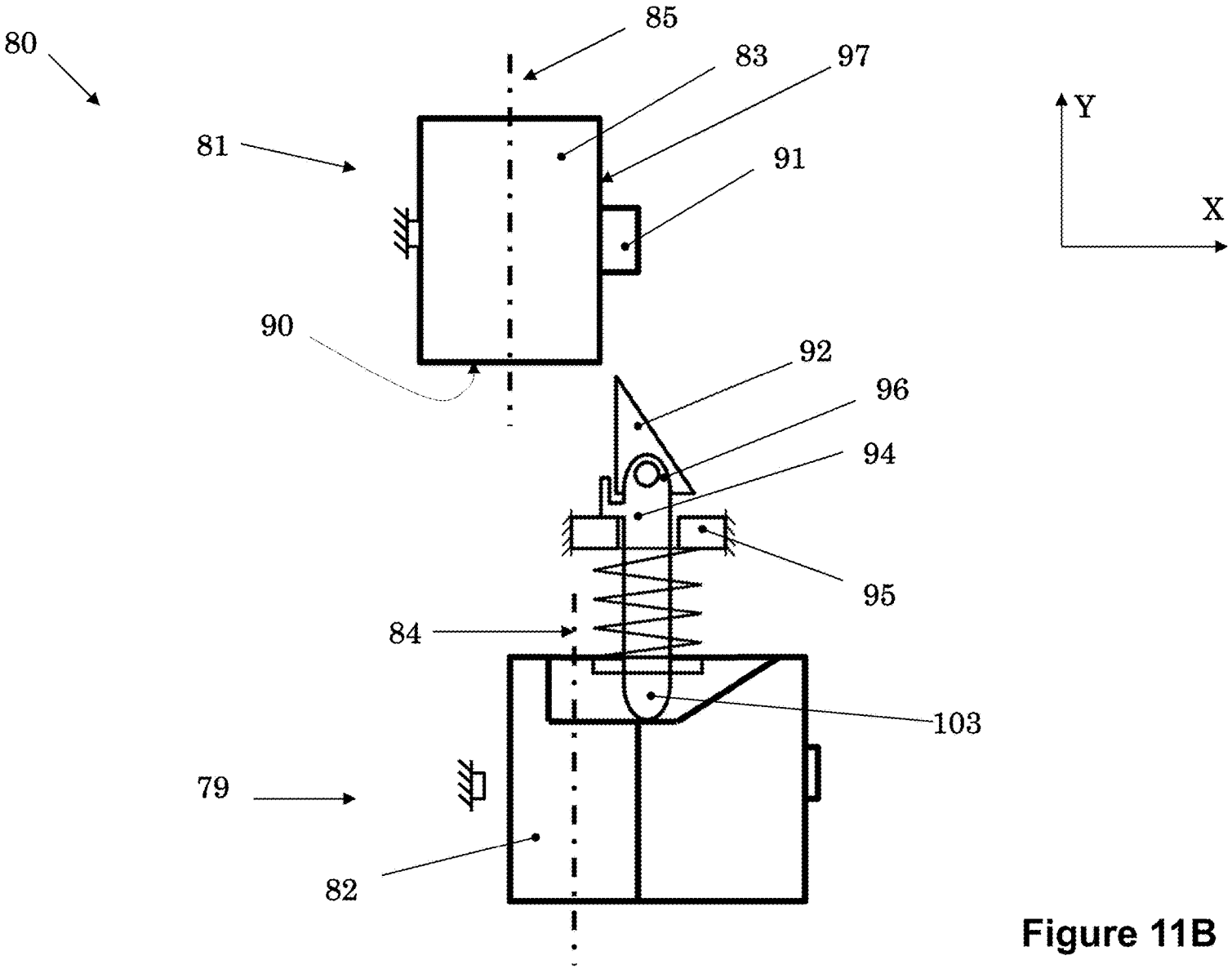
FIG. 11B illustrates the schematic of the top view of the inertial mechanical delay mechanism of the embodiment of FIG. 10 as it continues to be subjected to the prescribed acceleration profile (all-fire condition in munitions) and as the delay mechanism release mechanism releases the beam element of the second rotary beam assembly.

Now as the prescribed minimum acceleration magnitude and duration in the +Z direction (all-fire condition in munitions) continues to be applied to the inertial mechanical delay mechanism embodiment 80, the beam element 82 of the first rotary beam assembly unit 79 continues to rotate in the direction of the +Y axis and the rounded end 103 of the sliding member 94 continues to slide down the angled cutout surface 88 as was described above, thereby causing the sliding member 94 to begin to continue to move down until the stop member 92 clears the frontal surface 97 of the beam element 83 of the rotary beam assembly 81 as shown in the schematic of FIG. 11B.

It is appreciated that as the beam element 83 of the rotary beam assembly unit 81 is released by the indicated pulling of the stop member 92, the beam element 83 becomes free to begin to rotate in the direction of +Y axis under the action of the dynamic torque generated by the action of the applied acceleration on the offset mass 91, as was described above for the rotary beam assembly unit 79.

It is also appreciated that the released beam element 83 of the rotary beam assembly unit 81 would start its rotary motion from zero velocity, no matter what the rotary speed of the beam element 82 of the rotary beam assembly unit 79 is at the time of its release (unlike the rotary beam assembly units of the embodiment 10 of FIG. 6A). As a result, the delay time of the inertial mechanical delay mechanism is increased and is also made more reliable as was previously indicated.

It is appreciated by those skilled in the art that the inertial mechanical delay mechanism embodiment 80 may be provided with more rotary beam assembly units. For example, if a third rotary beam assembly unit were provided, it would be positioned above the rotary beam assembly unit 81, FIG. 10, and the beam element 83 of the unit 81 would be configured similar to the first rotary beam assembly unit 79, i.e., it would be provided with similar angled cutout surface (88 in the rotary beam assembly unit 79) and a release mechanism similar to the release mechanism 93 would provide the function of releasing the beam element of the added rotary beam assembly unit only once the beam element 83 has been released as was described above and after it has rotated enough to release its beam element. As a result, all rotary beam assembly units are sequentially activated once the inertial mechanical delay mechanism is subjected to the prescribed acceleration profile, i.e., minimum acceleration magnitude and duration (all-fire condition in munitions).

It is appreciated that when it is desired to limit the amount of rotation of the beam elements of the rotary beam assembly units of the inertial mechanical delay mechanism embodiment 80 of FIG. 10, the beam elements can be provided with stop members (like stop member 29 for the beam element 11 of the rotary beam assembly 15, FIGS. 6A-6D) to limit their rotation following activation for the first rotary beam assembly unit and following activation for the other, sequentially activated, rotary beam assembly units.

It is also appreciated that if the inertial mechanical delay mechanism embodiment 80 of FIG. 10 is subjected to a less than minimum prescribed acceleration magnitude or higher than the minimum magnitude but less than the minimum duration, the inertial mechanical delay mechanism. In the embodiment 80 of FIG. 10, this occurs since both rotary beam assembly units 79 and 81 (and any number of other provided and sequentially fully and partially activated rotary beam assemblies) can be rotated back to their initial positioning shown in the schematic of FIG. 10. In this case, any of the rotary beam assembly units may be partially activated, while the rest of the rotary beam assemblies are either fully activated (i.e., for the case of previous units) or have not been released. For example, the first rotary beam assembly unit 79 alone may be partially rotated to the point that the stop member 92 has not released the beam element 83 of the rotary beam assembly unit 81. In another case, the first rotary beam assembly unit 79 may be fully rotated and the beam element 83 of the rotary beam assembly unit 81 may have been released and partially rotated (before releasing the next rotary beam assembly-if provided), or may have been fully rotated, thereby releasing the next rotary beam assembly unit-if provided. In either case, all rotary beam assembly units can reset independent of the relative rotational positing of each unit beam element, i.e., return to their initial positioning shown in FIG. 10. It is appreciated that during resetting of the inertial mechanical delay mechanism embodiment 80, as the beam element 82 of the first rotary beam assembly unit 79 is rotated back towards its initial (pre-activation) positioning by the unit preloaded torsion spring, the rounded end 103 of the sliding member 94 is displaced back upwards by the angled cutout surface 88 until it is returned to its initial positioning shown in the schematic of FIG. 10. The beam element 83 of the rotary beam assembly unit 81 is also rotated back towards its initial (pre-activation) positioning by its provided preloaded torsion spring, and when its back surface 106 comes into contact with the frontal surface 105 of the stop member 92, the stop member 92 is rotated in the counterclockwise direction by the surface 106, clearing the path for the beam element 83 to return to its initial positioning shown in FIG. 10. The preload torsion spring provided at the joint 96 of the stop member 92, will then force it to return to its positioning shown in FIG. 10, i.e., in the position of preventing forward rotation of the beam element 83.

It is also appreciated that as it was previously indicated, it is highly desirable for any novel miniature inertial mechanical delay mechanism that is used directly for the development of mechanical inertial igniters and other similar devices to be capable of satisfying no activation requirements that may be experienced upon drops or other events that may subject the device to very high-G accelerations as compare to the prescribed activation acceleration magnitude threshold with relatively long durations, for example high-G acceleration levels that may be as high as 5000-10000 G and even higher in magnitude with durations that may be as long as 1-3 msec and sometimes more. It is also appreciated that following such drops, the device (e.g., inertial igniter for the case of munitions) may be required to be operational and activate when subjected to the prescribed (lower G) and (longer) duration acceleration thresholds (all-fire condition in munitions). Alternatively, following such drops, the device may be required to become inert, i.e., become incapable of being activated when subjected to any acceleration event, including the prescribed acceleration and duration thresholds. The inertial mechanical delay mechanisms are described below by the examples of their application to the inertial mechanical delay mechanism embodiment 10 of FIG. 6A. However, as can be seen, the methods are applicable to all inertial mechanical delay mechanism disclosed in the present disclosure.

Figure 12:
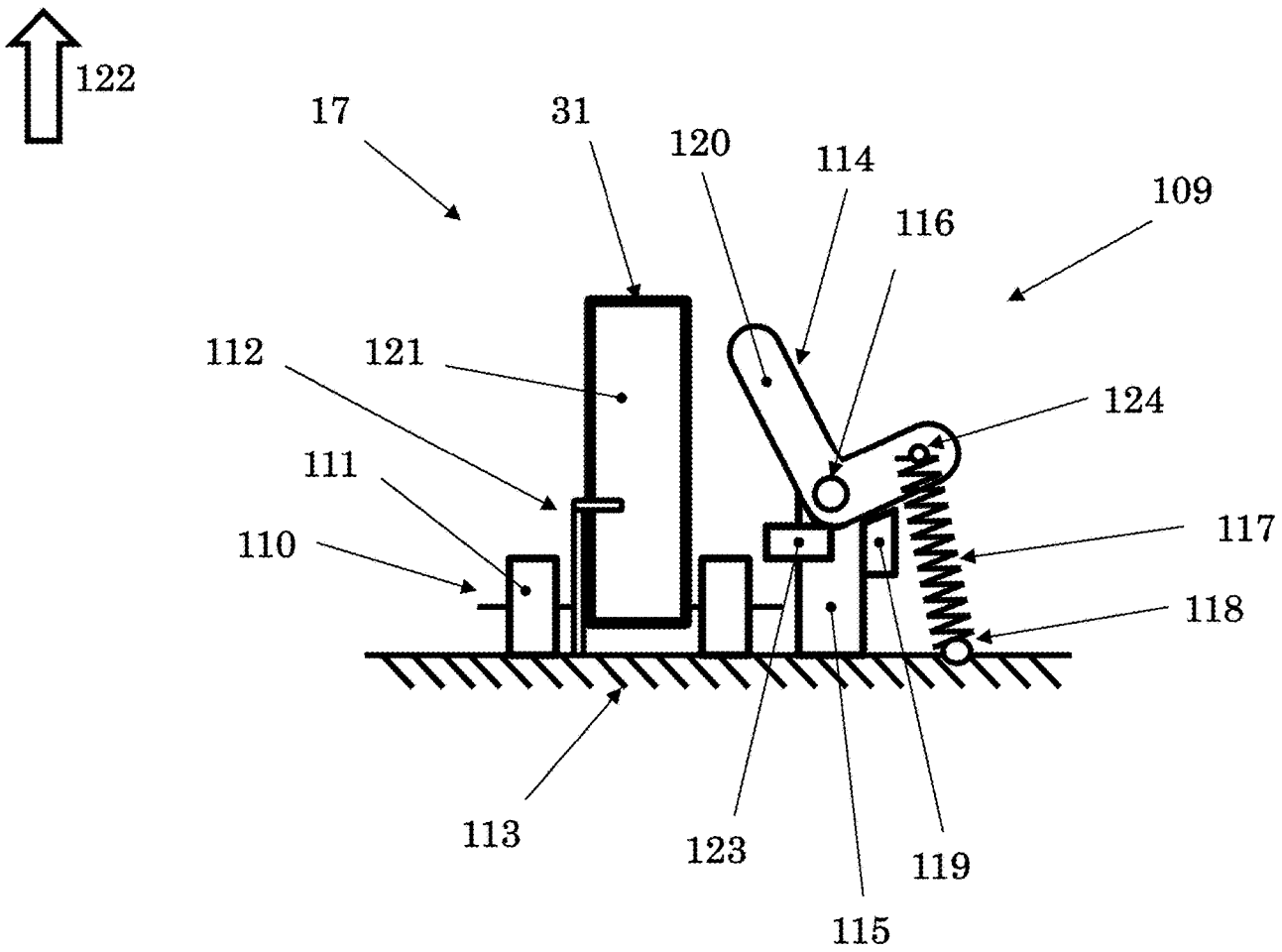
FIG. 12 illustrates the schematic of an example of an activation prevention mechanism for preventing activation of an inertial mechanical delay mechanism when subjected to relatively high G accidental acceleration events.

In this example of the application of the above novel methods of making inertial mechanical delay mechanisms, a mechanism, hereinafter referred to as the "high G activation prevention mechanism", is shown to be used as shown in the schematic of FIG. 12 to prevent at least one of the rotary beam assembly units of the inertial mechanical delay mechanism embodiment 10 of FIG. 6A from being fully activated. The activation prevention mechanisms used for all at least one rotary beam assembly units may be identical or may be configured to provide different operational characteristic as are described later in this disclosure.

In FIG. 12, the frontal view "C" of the rotary beam assembly unit 17 of the inertial mechanical delay mechanism embodiment 10 of FIG. 6A is shown together with the "high G activation prevention mechanism" 109 in the rest positioning of the inertial mechanical delay mechanism. In the schematic FIG. 12, the beam element of the rotary beam assembly unit 17 is indicated by the numeral 31, and as it was described for the embodiment 10 of FIG. 6A, it is attached to the inertial mechanical delay mechanism base structure 113 (12 in FIG. 6A) by the rotary joint 110 (13 in FIG. 6A) in the support structure 111 (14 in FIG. 6A), which is fixedly attached to the base structure 113. The rotary beam assembly is also similarly provided with the preloaded torsion spring 112 (19 in FIG. 6A), which biases the beam element 31 against the provided stop (not seen in FIG. 12 and indicated as 22 in FIG. 6A).

In the schematic of FIG. 12, the "high G activation prevention mechanism" 109 is shown to consist of an "L" shaped link member 114, which is attached to the support member 115 by the rotary joint 116. The support member is fixedly attached to the inertial mechanical delay mechanism base structure 113 and is provided with a stop member 119 to limit the clockwise rotation of the link member 114 as viewed in the plane of FIG. 12. The center of mass of the "L" shaped link member 114 is configured to be to the left side of the rotary joint 116 as viewed in FIG. 12. A preloaded tensile spring 117, which is attached to the inertial mechanical delay mechanism base structure 113 on one end 118 and to the "L" shaped link member 114 at the joint 124 on the other end, is used to bias the link member 114 against the stop 119 as shown in the configuration of the FIG. 12, i.e., when the inertial mechanical delay mechanism is at rest.

When the inertial mechanical delay mechanism embodiment 10 of FIG. 6A that is provided with at least one "high G activation prevention mechanism" 109 is subjected to acceleration in the direction of the arrow 122 (23 in FIG. 6A), the acceleration acts on the center of mass of the "L" shaped link member 114, which is located on the left side of the joint 116, applying a counterclockwise torque to the link member 114, which would tend to rotate it in the counterclockwise direction.

In general, inertial mechanical delay mechanisms, such as the embodiment 10 of FIG. 6A, are configured with "high G activation prevention mechanisms" 109 in which the preloading level of their preloaded tensile springs are selected such that they would counter the aforementioned applied counterclockwise torque for accelerations that are at or below the prescribed delay mechanism activation acceleration magnitude threshold.

However, if the inertial mechanical delay mechanism embodiment 10 of FIG. 6A that is provided with at least one "high G activation prevention mechanism" 109 is subjected to an acceleration in the direction of the arrow 122 which has a magnitude that is larger than the prescribed activation acceleration magnitude threshold (hereinafter referred to as "relatively high G acceleration"), the previously indicated generated counterclockwise toque that is applied to the "L" shaped link member 114 would overcome the clockwise torque of the preloaded tensile spring 117, causing the link member 114 to begin to be rotated in the counterclockwise direction.

Figure 13:
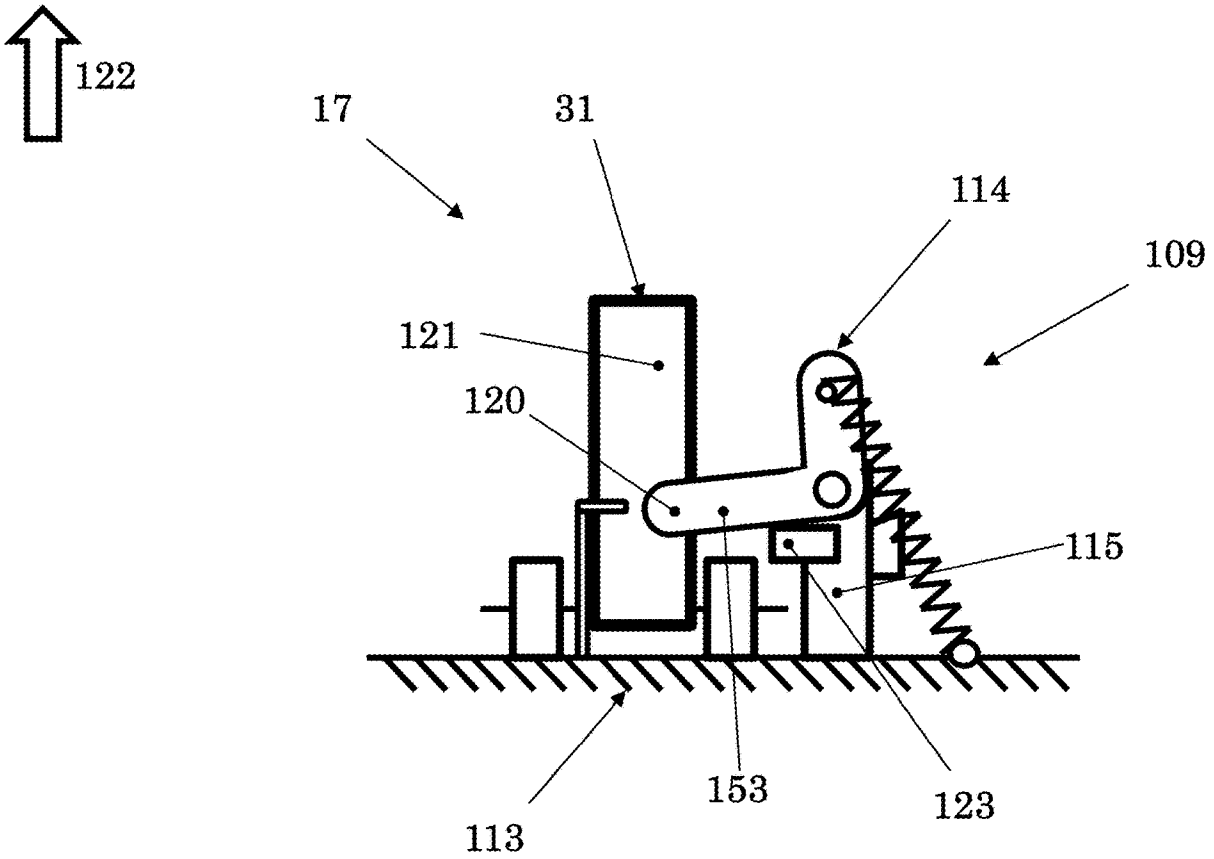
FIG. 13 illustrates the schematic of the example of the activation prevention mechanism of FIG. 12 as it is moved to prevent activation (rotation) of the beam element of a rotary beam assembly unit.

It is appreciated that in the resting positioning of the inertial mechanical delay mechanism embodiment 10 of FIG. 6A, the branch 120 of the "L" shaped link member 114 is positioned slightly in front of the surface 121 of the beam element 31 of the rotary beam assembly unit 17. As a result, if the applied "relatively high G acceleration" in the direction of the arrow 122 persists long enough and/or the magnitude of the applied "relatively high G acceleration" is high enough, the "L" shaped link member 114 will continue its counterclockwise rotation and bring a portion of the branch 120 of the "L" shaped link member 114 in front of the surface 121 of the beam element 31 of the rotary beam assembly unit 17 as shown in FIG. 13. In general, a stop member 123 is also provided to limit the counterclockwise rotation of the "L" shaped link member 114.

It is appreciated that the activation of those rotary beam assembly units that have not yet been activated can be blocked by the provided "high G activation prevention mechanisms" 109. For example in the inertial mechanical delay mechanism embodiment 10 of FIG. 6A, which is provided with a total of three rotary beam assembly units, depending on the magnitude and duration of the high G acceleration in the direction of the arrow 122, since there is a delay between the activation of the second rotary beam assembly 16 relative to the activation of the first rotary beam assembly 15, and similarly there is even a longer delay between the activation of the third rotary beam assembly 17 relative to the activation of the first rotary beam assembly 15, the "high G activation prevention mechanisms" 109 can always be configured to have enough time to at least prevent activation of one of the rotary beam assembly units. The provision of the "high G activation prevention mechanisms" 109 would therefore provide the above disclosed inertial mechanical delay mechanisms with the capability of avoiding full activation when the applied acceleration in the intended direction of their operation (e.g., in the direction of the arrow 23 for the embodiment 10 of FIG. 6A) is higher than their prescribed acceleration magnitude threshold, even if the duration of the applied high G acceleration is longer than the prescribed acceleration threshold duration.

It is appreciated that once the high G acceleration has ceased, the "L" shaped link member 114 of the "high G activation prevention mechanisms" 109 is rotated in the clockwise direction by the preloaded tensile spring 117 and is brought back to its initial positioning shown in the schematic of FIG. 12. All activated rotary beam assembly units would also return to their initial positioning shown in FIGS. 12 and 6A.

Figure 14:
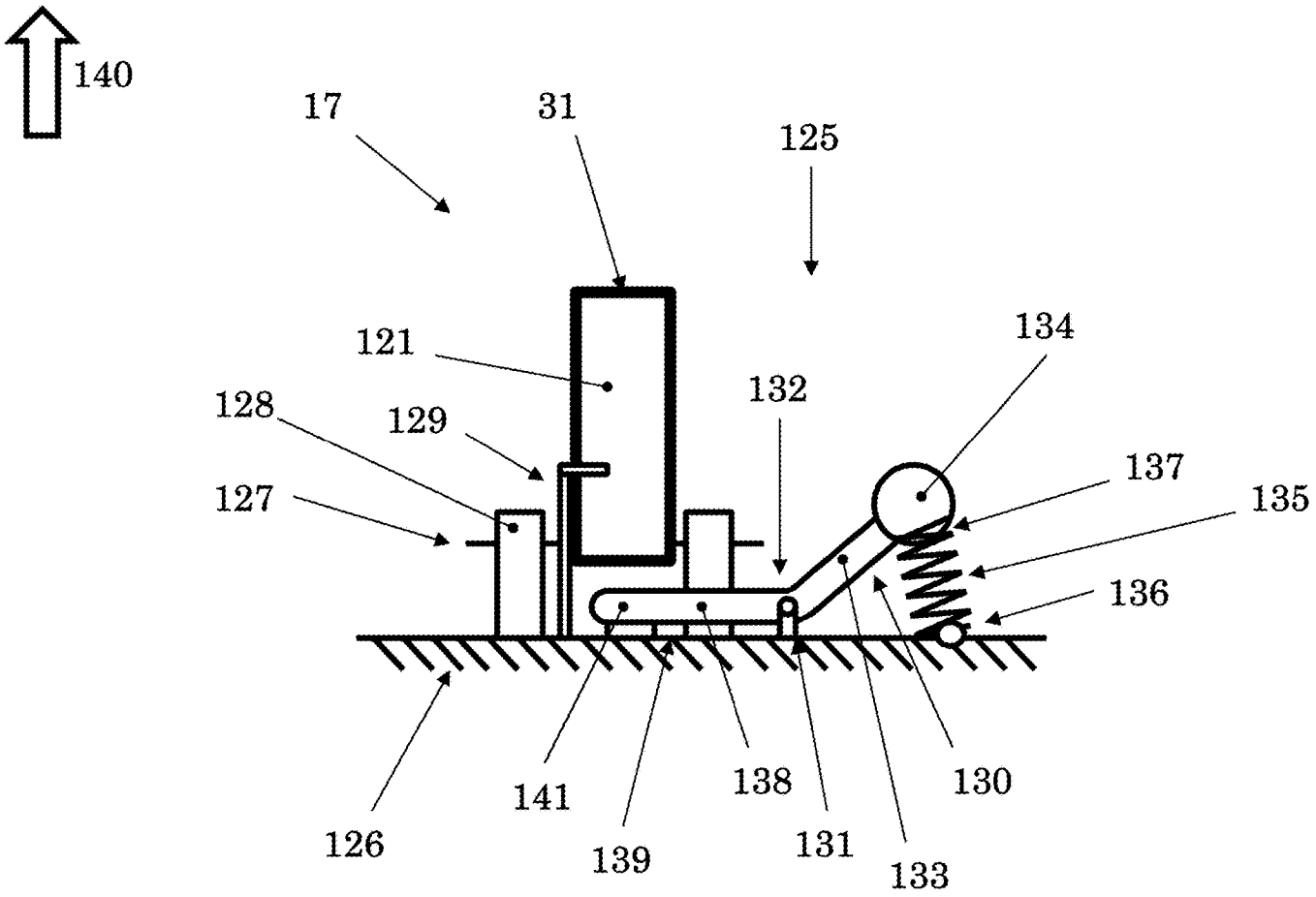
FIG. 14 illustrates the schematic of another example of an activation prevention mechanism for preventing activation of an inertial mechanical delay mechanism when subjected to relatively high G accidental acceleration events.

In FIG. 14, the frontal view "C" of the rotary beam assembly unit 17 of the inertial mechanical delay mechanism embodiment 10 of FIG. 6A is also shown together with the "high G activation prevention mechanism" 125 in the rest positioning of the inertial mechanical delay mechanism. In the schematic FIG. 14, the beam element 31 of the rotary beam assembly unit 17, which as it was described for the embodiment 10 of FIG. 6A, it is attached to the inertial mechanical delay mechanism base structure 126 (12 in FIG. 6A) by the rotary joint 127 (13 in FIG. 6A) in the support structure 128 (14 in FIG. 6A), which is fixedly attached to the base structure 126. The rotary beam assembly unit 17 is also similarly provided with the preloaded torsion spring 129 (19 in FIG. 6A), which biases the beam element 31 against the provided stop (not seen in FIG. 12 and indicated as 22 in FIG. 6A).

In the schematic of FIG. 14, the "high G activation prevention mechanism" 125 is shown to consist of a "V" shaped link member 130, which is attached to the support member 131 by the rotary joint 132. The support member 131 is fixedly attached to the inertial mechanical delay mechanism base structure 126. The branch 133 of the "V" shaped link member 130 is provided with the mass member 134 to shift the center of mass of the link 130 to the right of the joint 132 as viewed in the plane of the FIG. 14. A preloaded compressive spring 135, which is attached to the inertial mechanical delay mechanism base structure 126 on one end 136 and on the other end 137 to the "V" shaped link member 130 (via the branch 133 or the mass member 134), is used to bias the branch 138 of the link member against the stop 139 as shown in the configuration of the FIG. 14, i.e., when the inertial mechanical delay mechanism is at rest.

When the inertial mechanical delay mechanism embodiment 10 of FIG. 6A that is provided with at least one "high G activation prevention mechanism" 125 is subjected to acceleration in the direction of the arrow 140 (23 in FIG. 6A), the acceleration acts on the center of mass of the "V" shaped link member 130, which is located on the right side of the joint 132, applying a clockwise torque to the link member 130, which would tend to rotate it in the clockwise direction.

In general, inertial mechanical delay mechanisms, such as the embodiment 10 of FIG. 6A, are configured with "high G activation prevention mechanisms" 125 in which the preloading level of their preloaded compressive springs are selected such that they would counter the aforementioned applied clockwise torque for accelerations that are at or below the prescribed delay mechanism activation acceleration magnitude threshold.

However, if the inertial mechanical delay mechanism embodiment 10 of FIG. 6A that is provided with at least one "high G activation prevention mechanism" 125 is subjected to an acceleration in the direction of the arrow 140 which has a magnitude that is larger than the prescribed activation acceleration magnitude threshold ("relatively high G acceleration"), the previously indicated generated clockwise toque that is applied to the "V" shaped link member 130 would overcome the counterclockwise torque of the preloaded compressive spring 135, causing the link member 130 to begin to be rotated in the clockwise direction.

Figure 15:
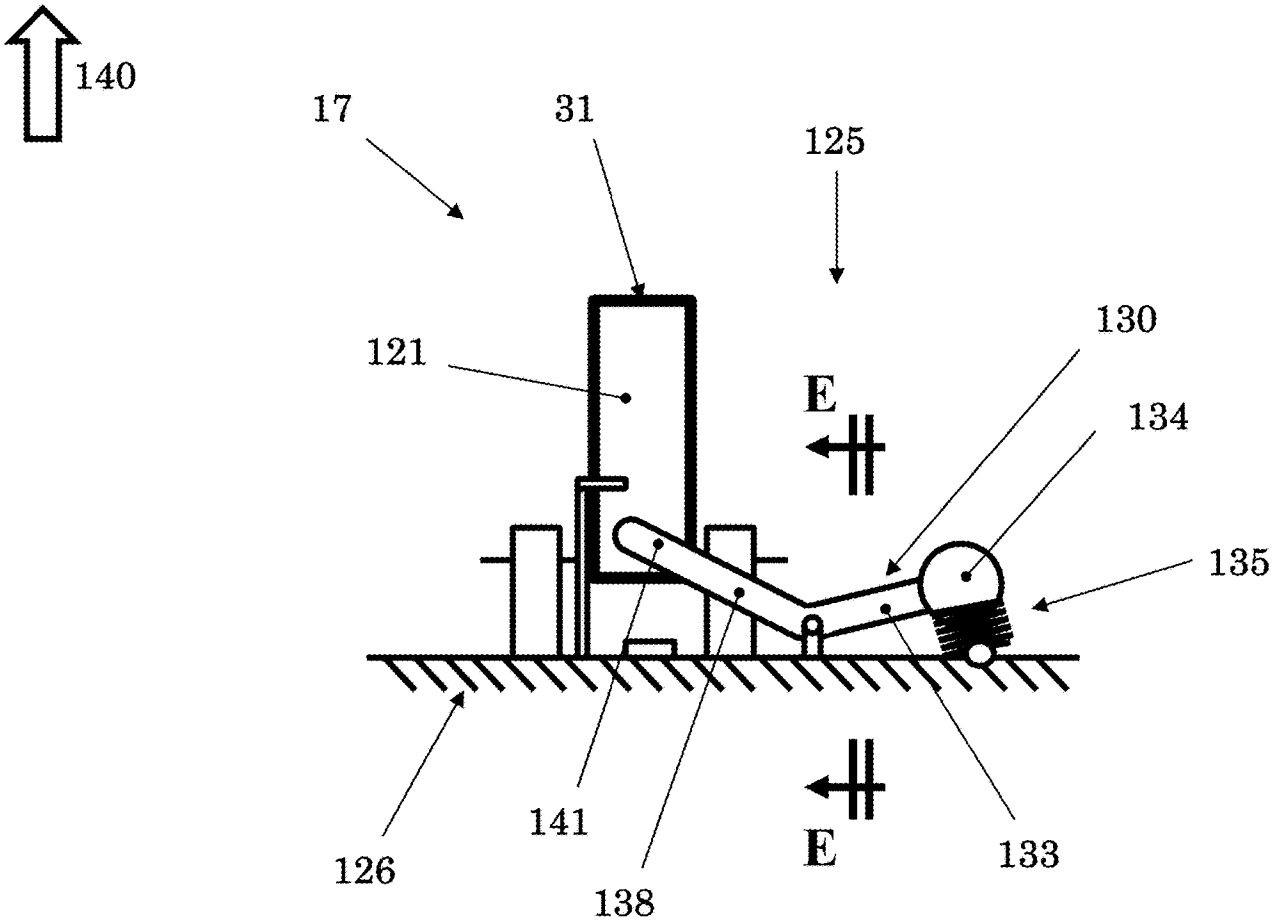
FIG. 15 illustrates the schematic of the example of the activation prevention mechanism of FIG. 14 as it is moved to prevent activation (rotation) of the beam element of a rotary beam assembly unit.

It is appreciated that in the resting positioning of the inertial mechanical delay mechanism embodiment 10 of FIG. 6A, the branch 138 of the "V" shaped link member 130 is positioned slightly in front of the surface 121 of the beam element 31 of the rotary beam assembly unit 17. As a result, if the applied "relatively high G acceleration" in the direction of the arrow 140 persists long enough and/or the magnitude of the applied "relatively high G acceleration" is high enough, the "V" shaped link member 130 will continue its clockwise rotation and bring the front portion 141 of the "V" shaped link member 130 in front of the surface 121 of the beam element 31 of the rotary beam assembly unit 17 as shown in FIG. 15. In general, a stop member (not shown) may be provided to limit the clockwise rotation of the "V" shaped link member 130.

It is appreciated that the activation of those rotary beam assembly units that have not yet been activated can be blocked by the provided "high G activation prevention mechanisms" 125. For example in the inertial mechanical delay mechanism embodiment 10 of FIG. 6A, which is provided with a total of three rotary beam assembly units, depending on the magnitude and duration of the high G acceleration in the direction of the arrow 140, since there is a delay between the activation of the second rotary beam assembly 16 relative to the activation of the first rotary beam assembly 15, and similarly there is even a longer delay between the activation of the third rotary beam assembly 17 relative to the activation of the first rotary beam assembly 15, the "high G activation prevention mechanisms" 125 can always be configured to have enough time to at least prevent activation of one of the rotary beam assembly units. The provision of the "high G activation prevention mechanisms" 125 would therefore provide the above disclosed inertial mechanical delay mechanisms with the capability of avoiding full activation when the applied acceleration in the intended direction of their operation (e.g., in the direction of the arrow 23 for the embodiment 10 of FIG. 6A) is higher than their prescribed acceleration magnitude threshold, even if the duration of the applied high G acceleration is longer than the prescribed acceleration threshold duration.

It is appreciated that once the high G acceleration has ceased, the "V" shaped link member 130 of the "high G activation prevention mechanisms" 125 is rotated in the counterclockwise direction by the preloaded compressive spring 135 and is brought back to its initial positioning shown in the schematic of FIG. 14. All activated rotary beam assembly units would also return to their initial positioning shown in FIGS. 14 and 6A.

It is appreciated that the "high G activation prevention mechanisms" 109 and 125 of FIGS. 12 and 14, respectively, are configured to reset, i.e., return to their initial positions shown once the applied relatively high G acceleration event has ceased. However, in certain applications, particularly if the experienced high G acceleration could have damaged the device in which the inertial mechanical delay mechanism is mounted, the inertial mechanical delay mechanism and the device(s) that it is used to operate may be desired to be rendered non-operative. In such applications, the "high G activation prevention mechanisms" 109 and 125 of FIGS. 12 and 14, respectively, need to be configured to be non-resettable, i.e., stay in the configurations of FIGS. 13 and 15, respectively, and continue to block rotation of at least one of the beam elements of the delay mechanism rotary beam assembly units.

The method of preventing resetting of an inertial mechanical delay mechanism, for example, those provided with "high G activation prevention mechanisms" 109 or 125 of FIGS. 12 and 14, respectively, is based on "locking" the deployed members of the "high G activation prevention mechanisms" that block at least one of the beam elements of the rotary beam assembly units of the delay mechanism, such as the members 114 and 130 of the "high G activation prevention mechanisms" 109 and 125 of FIGS. 12 and 14, respectively.

Figure 16B:
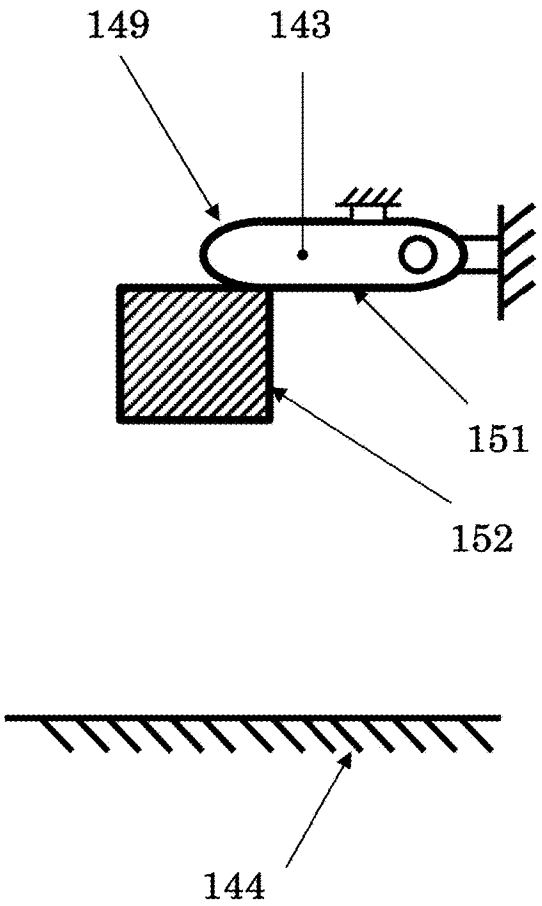
FIG. 16B illustrates the schematic of the resetting prevention mechanism of FIG. 16A after the inertial mechanical delay mechanism is subjected to a relatively high G accidental acceleration event and its activation prevention mechanism is locked in its actuated positioning.
Figure 16A:
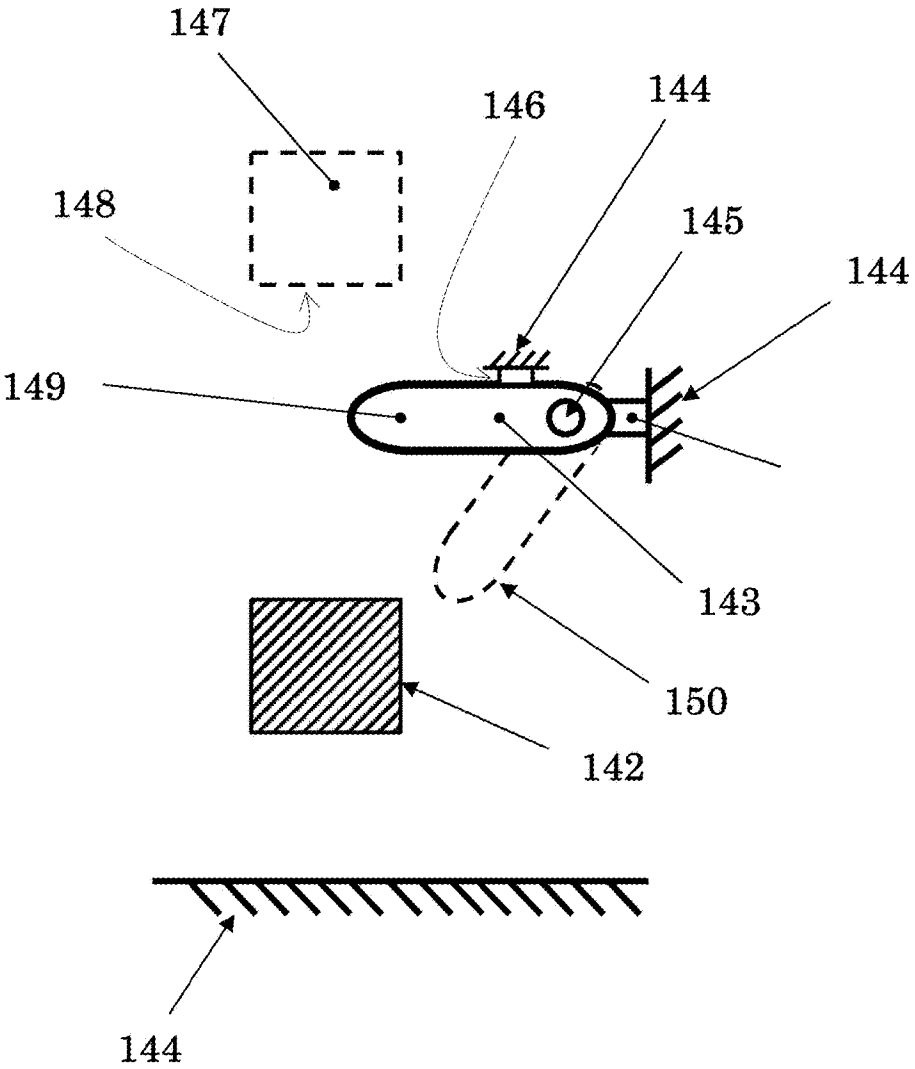
FIG. 16A illustrates the schematic of a resetting prevention mechanism for use in the activation prevention mechanisms of FIGS. 12 and 14 before the inertial mechanical delay mechanism is subjected to a relatively high G accidental acceleration event.

The cross-sectional view E-E of FIG. 15 showing only the cross-section of the 133 branch of the "V" shaped link member 130 of the "high G activation prevention mechanisms" 125 together with the above indicated "resetting blocking mechanism" is shown in the schematic of FIG. 16A. In the schematic of FIG. 16A, the cross-section 142 indicates the cross-sectional view of the branch 133 of the "V" shaped link member 130 of the "high G activation prevention mechanisms" 125 in its actuated positioning shown in the schematic of FIG. 15. As can be seen in FIG. 16A, the "resetting blocking mechanism" consists of the link member 143, which is attached to the base structure 144 of the inertial mechanical delay mechanism (embodiment 10 of FIG. 10 for the case of the schematic of mechanism of FIG. 14) by the rotary joint 145. In the configuration shown in FIG. 16A, the link member 143 is shown to be positioned against the stop 146 on the base structure 144 of the inertial mechanical delay mechanism, which is the position that it is biased by a provided torsion spring (not shown for the sake of clarity) at the rotary joint 145.

In the schematic of FIG. 16A, the cross-section 142 of the branch 133 of the "V" shaped link member 130 of the "high G activation prevention mechanisms" 125 in its pre-activation state of FIG. 14 is shown with dashed lines and is indicated by the numeral 147. Now when the inertial mechanical delay mechanism is subjected to a high G acceleration in the direction of the arrow 140, FIGS. 14 and 15, then as the link 130 is rotated in the clockwise direction, the cross-section 147 begins to move down. Then at some point, the bottom surface 148 of the cross-section 147 comes into contact with the upper surface of the tip 149 of the link member 143 and begins to rotate the link in the counterclockwise direction. Then, as the link member 143 is rotated to the point of clearing the path of downward displacement of the link 130 (indicated by its cross-section 147 in FIG. 16A), i.e., around the link member 143 position shown by dashed line 150, the link 130 moves passed its point of engagement with the link member 143 and free the link member to return back to its initial position shown by solid line in FIG. 16A by the aforementioned provided preloaded torsion spring at the joint 145. The link 130 of the "high G activation prevention mechanisms" 125 is thereby positioned under the link member 143.

Now, if the high G acceleration in the direction of the arrow 140, FIGS. 14 and 15, would cease, then the preloaded compressive spring 135 would rotate the "V" shaped link member 130 of the "high G activation prevention mechanisms" 125 in the counterclockwise direction until the counterclockwise rotation of the link member 130 is stopped by its branch 133 (shown in FIG. 16B by its cross-sectional area 152) coming in contact with the bottom surface 151 of the link member 143. As a result, the "V" shaped link member 130 of the "high G activation prevention mechanisms" 125 stays in the position of blocking rotation of at least one beam element of the rotary beam assembly units (31 of the rotary beam assembly 17 in FIG. 14) of the inertial mechanical delay mechanism as was previously described for the embodiment of FIG. 14. As a result, the inertial mechanical delay mechanism becomes inoperative when subjected to the any acceleration event in the direction of the arrow 140, FIG. 14, even if the acceleration satisfies the prescribed minimum magnitude and duration requirement (all-fire condition in munitions).

It is appreciated by those skilled in the art that the method of preventing resetting of the "high G activation prevention mechanisms" 125 described by the above example is also applicable to the "high G activation prevention mechanisms" 109 of FIG. 12, in which case, the resetting link 143 of the mechanism shown in the schematics of FIGS. 16A and 16B is used to prevent the clockwise rotation of the "L" shaped link member 114 of the "high G activation prevention mechanisms" 109 once it is moved to its position of blocking rotation of at least one of the beam elements of the rotary beam assembly units (31 of the rotary beam assembly 17 in FIG. 12) of the inertial mechanical delay mechanism as was previously described for the embodiment of FIG. 14. It is noted that in the "high G activation prevention mechanisms" 109 of FIG. 12, the link member 143 of the resting blocking mechanism of FIGS. 16A and 16B is positioned above the branch 153 of the "L" shaped link member with the tip 120, FIG. 13, so that once the branch 153 (cross-section of which is then represented by the cross-section 142 in FIG. 16A) has cleared the link member 143, it would be prevented to reset to its initial positioning shown in FIG. 12 as shown in FIG. 16B (cross-section of the branch 153 is then represented by the cross-section 152 in FIG. 16B).

It is also appreciated by those skilled in the art that many other mechanism configurations may be used in place of the mechanism shown in FIGS. 16A and 16B to perform the same function of blocking the resetting of the "high G activation prevention mechanisms" 109 and 125 of FIGS. 12 and 14, respectively. For example, instead of providing the links 114 and 130, FIGS. 12 and 14, respectively, with rotary joints 116 and 132, they may be provided with sliding joints and configured to perform their rotary beam assembly beam element rotation blocking action by sliding into blocking position instead of by a rotary motion as was described above.

In the inertial mechanical delay mechanism embodiments 10, 48 and 60 of FIGS. 6A, 7 and 8, respectively, relatively long delay times was shown to be obtained by sequentially activating the provided rotary beam assemblies. In certain applications, due space constraints, it is highly desirable for the inertial mechanical delay mechanism to have relatively small footprint. For such applications, the inertial mechanical delay mechanism may be configured with displacing (rather than rotary) assembly units that are sequentially activated in response to the applied operating acceleration. An example of such an inertial mechanical delay mechanism configuration in shown in the schematic of FIG. 17 and is designated as the embodiment 160.

Figure 17:
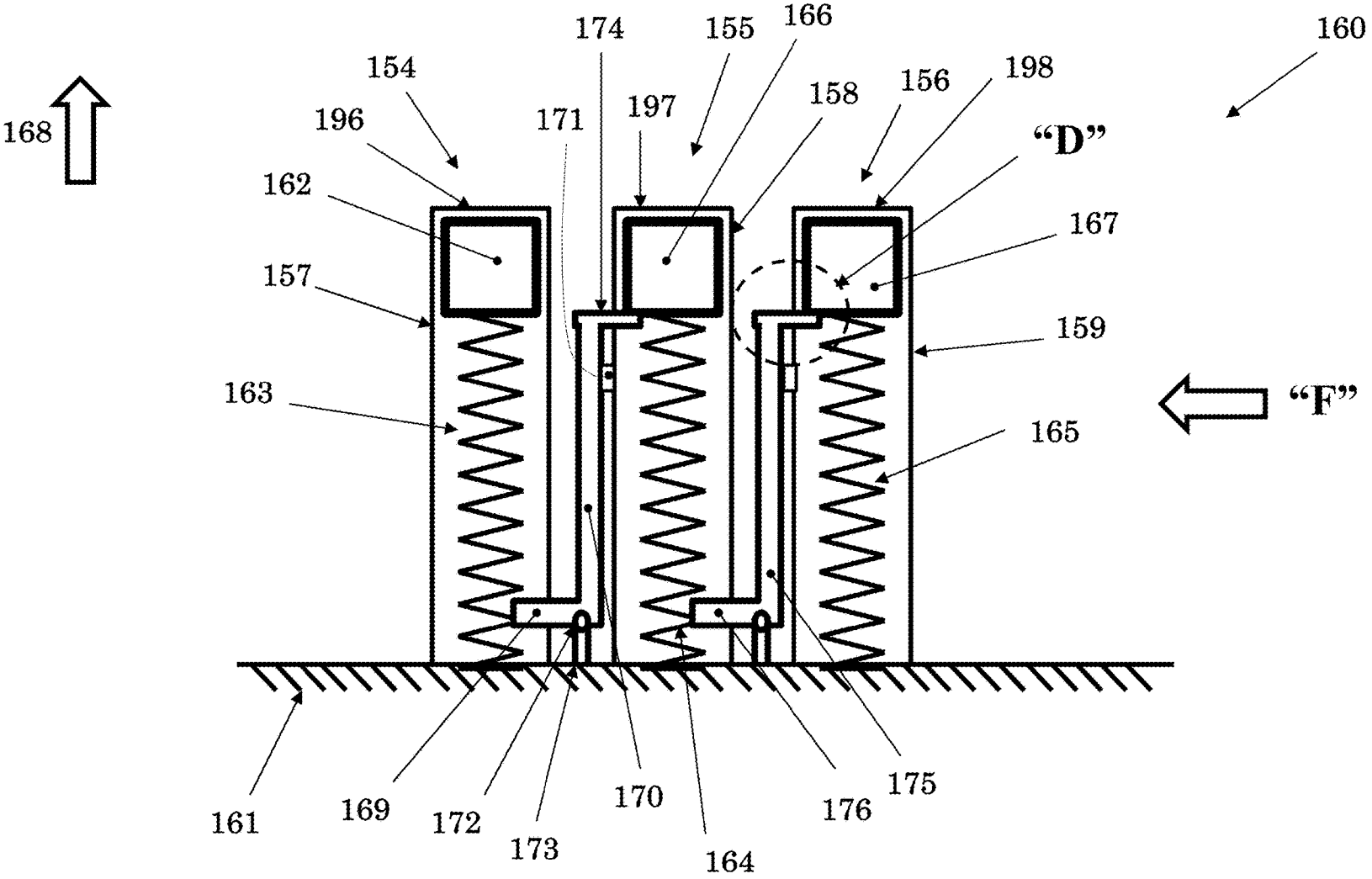
FIG. 17 illustrates the schematic side view of the second inertial mechanical delay mechanism embodiment for generating long duration delays in various devices in its pre-activation state.

As can be seen in the schematic of FIG. 17, the inertial mechanical delay mechanism embodiment 160 is provided with three identical "sliding mass-spring assemblies" 154, 155 and 156, which are fixedly attached by their relatively rigid housings 157, 158 and 159, respectively, to the base structure of the inertial mechanical delay mechanism 161. It is appreciated, however, that the individual "sliding mass-spring assemblies" may be configured differently in shape, size, etc., to achieve different performance characteristics for the resulting inertial mechanical delay mechanism as described later in this disclosure.

The "sliding mass-spring assemblies" of the inertial mechanical delay mechanism embodiment 160 of FIG. 17 can be seen to consist of a mass member 162, which is connected to the base structure 161 of the inertial mechanical delay mechanism by a compressive spring 163, which may be preloaded as will be discussed later in this disclosure. The compressive spring 163 is attached on one end to the mass member 163 and on the other end to the base structure 161 of the inertial mechanical delay mechanism. In the rest position of the inertial mechanical delay mechanism embodiment 160, the mass members 162, 163 and 164 are constrained in their upward motion by the top members 196, 197 and 198 of the "sliding mass-spring assembly" units 154, 155 and 156, respectively.

It is noted that for the sake of simplicity, the compressive springs 163, 164 and 165 and mass members 162, 166 and 167 of the "sliding mass-spring assemblies" 154, 155 and 156, respectively, are indicated to be identical. It is, however, appreciated by those skilled in the art that when configuring such inertial mechanical delay mechanisms, the spring preloads, spring rates, and the mass of the mass members may be selected to be different to achieve the desired inertial mechanical delay mechanism delay time to an acceleration event magnitude and duration as described later in this disclosure.

Now if the inertial mechanical delay mechanism embodiment 160 is subjected to an acceleration in the direction of the arrow 168, the dynamic force generated by the mass member 162 of the "sliding mass-spring assembly" 154 would act on the preloaded compressive spring 163. It is appreciated that if the applied acceleration in the direction of the arrow 168 is not enough to overcome the preloading force of the compressive spring 163, then the mass member 162 would stay stationary in its position shown in FIG. 17. However, if the applied acceleration in the direction of the arrow 168 is high enough to overcome the preloading force of the compressive spring 163, then the mass member 162 would begin to displace downward as viewed in the plane of the FIG. 17.

Now if the magnitude of the applied acceleration in the direction of the arrow 168 is relatively low and/or its duration is relatively short, then the mass member 162 is accelerated downward by the net dynamic force less the preloading force of the compressive spring 163 a relatively small distance, i.e., coming to stop before reaching the tip 169 of the "Z" shaped link 170, and is then returned to its starting position shown in FIG. 17.

The "Z" shaped link 170 is attached to the base structure 161 of the inertial mechanical delay mechanism 160 by the rotary joint 172 provided in the support member 173, which is fixedly attached to the base structure 161. The "Z" shaped link 170 is provided with a preloaded torsion spring (not shown for the sake of clarity) at the joint 172, which biases it against the stop member 171, which is provided on the surface of the housing 158 of the "sliding mass-spring assemblies" 155 as shown in FIG. 17. The rigid housings 157 and 158 of the "sliding mass-spring assemblies" 154 and 155, respectively, are provided with properly sized openings to allow the tips 169 and 174 of the "Z" shaped link 170 to enter each rigid housing. In the rest configuration of the inertial mechanical delay mechanism shown in the schematic of FIG. 17, the tip 174 of the "Z" shaped link 170 is seen to support the mass member 166 against any dynamic force generated due to acceleration of the inertial mechanical delay mechanism 160 in the direction of the arrow 168.

However, if the magnitude of the applied acceleration in the direction of the arrow 168 is high enough and its duration is long enough, then the mass member 162 is accelerated downward until it strikes the tip 169 of the "Z" shaped link 170 and cause it to rotate in the counterclockwise direction. As a result of counterclockwise rotation of the "Z" shaped link 170, its tip 174 is displaced out of contact with the mass member 166, thereby releasing it to displace downward under continued acceleration in the direction of the arrow 168.

It is appreciated that if the above applied acceleration in the direction of the arrow 168 persists, then the mass member would similarly impact the tip 176 of the next "Z" shaped link 175 and release the next mass member 167 of the "sliding mass-spring assembly" 156. The mass member would then be accelerated down as was described for the mass member 162 of the "sliding mass-spring assembly" 155 and actuate the input member of the device that is configured to operate, such as initiating the activation of an inertial igniter in a munition or opening or closing a circuit and the like, examples of which are described later in this disclosure. It is appreciated that for a constant acceleration being applied in the direction of the arrow 168 to the inertial mechanical delay mechanism 160, as a mass member such as the mass member 162 is displaced downward, the increased deformation of the compressive spring 163 would increase the force that the compressive spring applies to the mass member, thereby proportionally reducing its downward acceleration. As a result, the time that the mass member 162 takes to release the second mass member 166 by actuating the "Z" shaped link 170 (that its generated delay time) can be varied by varying the preloading level and spring rate of the compressive springs and the mass of the mass members of the "sliding mass-spring assembly" units 154, 155 and 156. Such configuration can achieve the desired total delay time of the inertial mechanical delay mechanism embodiment 160 of FIG. 17 for a given applied acceleration level.

It is also appreciated that in the inertial mechanical delay mechanism embodiment 160 of FIG. 17, after the first "sliding mass-spring assembly" unit 154, the mass members of the following "sliding mass-spring assembly" units are sequentially released with initial zero velocity, which would result in relatively longer delay times and would also allow the delay time of each "sliding mass-spring assembly" unit to be more accurately determined. It is appreciated that once the applied acceleration in the direction of the arrow 168 has ceased, as was described above for the previous inertial mechanical delay mechanism embodiments, the inertial mechanical delay mechanism embodiment 160 of FIG. 17 may be desired to return to its initial positioning shown in the schematic of FIG. 17 in certain applications, like the inertial mechanical delay mechanism embodiment 10 of FIG. 6A. In other applications, the inertial mechanical delay mechanism embodiment 160 of FIG. 17 may be desired to become inoperative following certain high G and generally shorter duration accelerations in the direction of the arrow 168, like the inertial mechanical delay mechanism embodiment 10 of FIG. 6A with the "high G activation prevention mechanisms" 109 or 125 of FIGS. 12 and 14, respectively. Such variations of the inertial mechanical delay mechanism embodiment 160 of FIG. 17 can be readily obtained by simple modification of its "sliding mass-spring assembly" units. Examples of such modifications to certain components of the "sliding mass-spring assembly" units are provided below. It is, however, appreciated by those skilled in the art that numerous other configuration modifications and configuration mechanisms known in the art may also be to achieve the resettable and non-resettable functionality of the inertial mechanical delay mechanism embodiment 160 of FIG. 17.

It is appreciated by those skilled in the art that once the inertial mechanical delay mechanism 160 of FIG. 17 is subjected to an acceleration event in the direction of the arrow 168, if the acceleration would cease before the mass member 162 of the first "sliding mass-spring assembly" unit 154 could actuate the "Z" shaped link 170 and release the mass member 166 of the "sliding mass-spring assembly" unit 155, then the mass member 162 would eventually return to its initial (pre-acceleration event) position shown in FIG. 17. However, if the applied acceleration is applied long enough for the mass member to release the next mass member 166 and possibly the mass member 167 of the next "sliding mass-spring assembly" unit 156, then the mass members 166 (and 167—if released) are would not return to their initial positions shown in FIG. 17 but are stopped below the tip members (174 for the mass member 162) of the "Z" shaped link 170. In applications that the inertial mechanical delay mechanism embodiment 160 of FIG. 17 is desired to return to its initial positioning once the applied activation acceleration has ceased, i.e., if the inertial mechanical delay mechanism embodiment 160 is desired to be resettable, the following modifications to the tip 174 of the "Z" shaped link 170 (and similarly to all "Z" shaped links), FIGS. 18A and 18B, would achieve this goal.

Figure 18B:
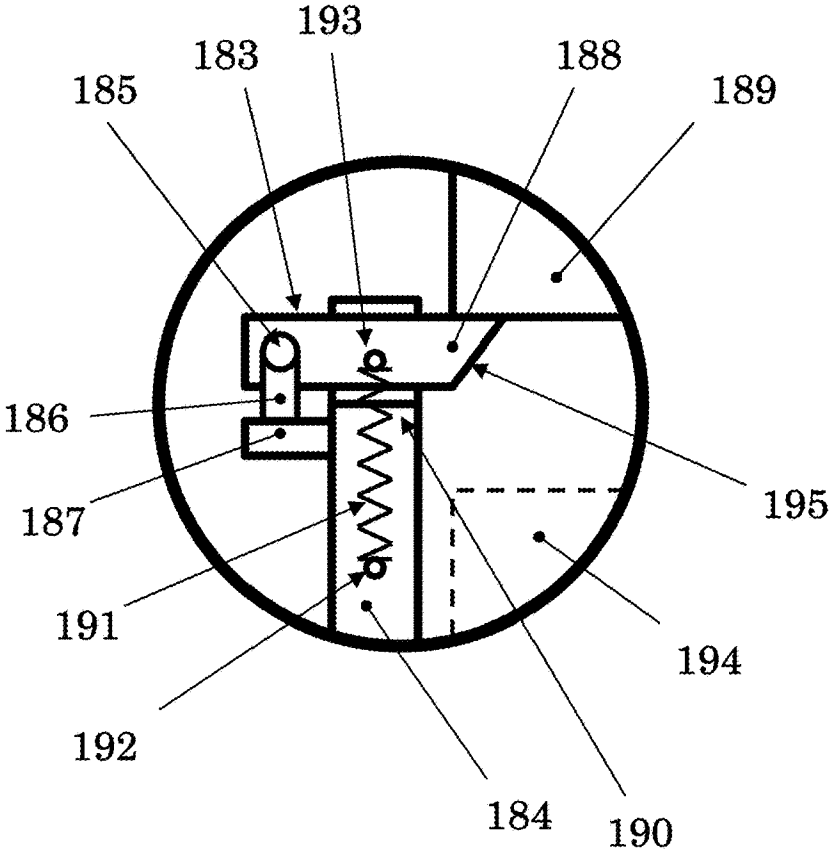
FIG. 18B illustrates the schematic another reset enabling mechanism for use in the inertial mechanical delay mechanism embodiment of FIG. 17.
Figure 18A:
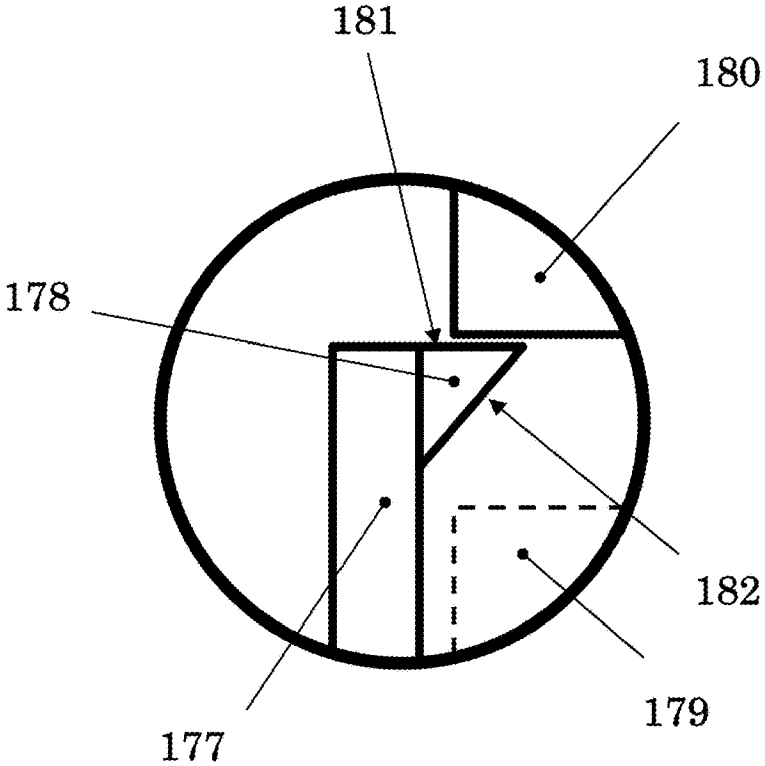
FIG. 18A illustrates the schematic a reset enabling mechanism for use in the inertial mechanical delay mechanism embodiment of FIG. 17.

The area of the tip of a "Z" shaped link that supports a mass member of a the "sliding mass-spring assembly" unit is indicated by the dashed lined view "D" in the schematic of FIG. 17. In FIGS. 18A and 18B, the blow-up views "D" of two possible modifications to the "Z" shaped links of the embodiment 160 of FIG. 17 are presented, which would make the inertial mechanical delay mechanism fully resettable as was previously described.

In the blow-up view of FIG. 18A, the tip member 178 (174 in FIG. 17) is a triangular member, which is similarly and fixedly attached to the long member 177 of the "Z" shaped link 177 (170 in FIG. 17). In its initial (pre-activation) position, the mass member 180 of the "sliding mass-spring assembly" unit (e.g., mass member 167 of the unit 156) is held against the top surface 181 of the triangular tip member 178 as can be seen in FIG. 18A by the preloaded compressive spring of the "sliding mass-spring assembly" unit (preloaded compressive spring 165 in the case of the mass member 167 of unit 156, FIG. 17). Then when the mass member 180 is released by the counterclockwise rotation of the "Z" shaped link and thereby leftward displacement of the triangular tip member 178 as viewed in the plane of FIG. 18A, the aforementioned delay mechanism activating applied acceleration in the direction of the arrow 168 (FIG. 17) would cause the mass member 180 move down passed the triangular tip member 178 as indicated by the dashed lines 179. Now if the activating applied acceleration is ceased, the displaced mass member 179 is pushed upwards as viewed in the plane of FIG. 17 by the preloaded compressive spring (preloaded compressive spring 165 in the case of the mass member 167 of unit 156, FIG. 17), its corner shown in FIG. 18A would press on the inclined surface 182 of the triangular tip member 178, forcing the "Z" shaped link 177 to undergo a counterclockwise rotation that would clear the path for the mass member to pass the triangular tip member 178 and move to the position in which it is indicated by the numeral 180. At this time, the "Z" shaped link 177 becomes free to be rotated back to its initial position shown in FIGS. 18A and 17. The inertial mechanical delay mechanism embodiment 160 of FIG. 17 would thereby resettles to its initial configuration shown in FIG. 17.

In the blow-up view of FIG. 18B, the tip member 183 (174 in FIG. 17) is shown to be attached to the "Z" shaped link 184 (170 in FIG. 17) by the rotary joint 185, which is provided in the support member 186, which is fixedly attached to the "Z" shaped link 184 by the intermediate member 187. The free end 188 of the tip member 183 is provided with a sharp end with inclined surface to support the mass member 189 of the "sliding mass-spring assembly" unit in its initial (pre-activation) position, (e.g., mass member 167 of the unit 156) as can be seen in FIG. 18B by the preloaded compressive spring of the "sliding mass-spring assembly" unit (preloaded compressive spring 165 in the case of the mass member 167 of unit 156, FIG. 17). In the (pre-activation) configuration shown in FIG. 18B, the tip member 183 is biased to stop against the surface 190 provided on the "Z" shaped link 184 by the lightly preloaded tensile spring 191, which is attached to the "Z" shaped link 184 by the rotary joint 192 on one end and to the tip member 183 by the rotary joint 193 on the other end.

Then when the mass member 189 is released by the counterclockwise rotation of the "Z" shaped link and thereby leftward displacement of the free end 188 of the tip member 183 as viewed in the plane of FIG. 18B, the aforementioned delay mechanism activating applied acceleration in the direction of the arrow 168 (FIG. 17) would cause the mass member 189 to move down passed the end 188 of the tip member 183 as indicated by the dashed lines 194.

Now, if the activating applied acceleration is ceased, the displaced mass member 194 is pushed upwards as viewed in the plane of FIG. 17 by the preloaded compressive spring (preloaded compressive spring 165 in the case of the mass member 167 of unit 156, FIG. 17), its corner shown in FIG. 18B would press on the inclined surface 195 of the tip member 183, forcing it and the "Z" shaped link 184 to rotate in the counterclockwise direction, which would then clear the path for the mass member 194 to pass and move to the position in which it is indicated by the numeral 189. At this time, the "Z" shaped link 184 and the tip member 183 become free to be rotated back to their initial position shown in FIGS. 18B and 17. The inertial mechanical delay mechanism embodiment 160 of FIG. 17 would thereby resettles to its initial configuration shown in FIG. 17.

Figure 19B:
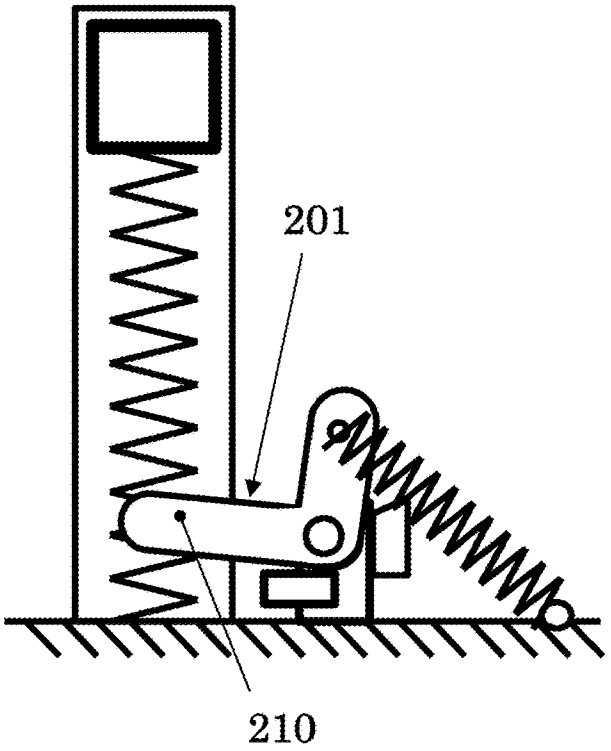
FIG. 19B illustrates the schematic of the example of the activation prevention mechanism of FIG. 19A as it is moved to prevent activation (displacement) of the mass member of the "sliding mass-spring assembly" unit of the inertial mechanical delay mechanism.

It is also appreciated that as it was previously indicated, it is highly desirable for any novel miniature inertial mechanical delay mechanism, including the embodiment 160 of FIG. 17, to be capable of satisfying no activation requirements that may be experienced upon drops or other events that may subject the device to very high-G accelerations as compare to the prescribed activation acceleration magnitude threshold with relatively long durations, for example high-G acceleration levels that may be as high as 5000-10000 G and even higher in magnitude with durations that may be as long as 1-3 msec and sometimes more. It is also appreciated that as it was previously indicated, following such drops, the device which is operated by the delay mechanism (e.g., inertial igniter for the case of munitions) may be required to stay operational and activate when subjected to the prescribed (lower G) and (longer) duration acceleration thresholds (all-fire condition in munitions). Alternatively, following such drops, the device may be required to become inert, i.e., become incapable of being activated when subjected to any acceleration event, including the prescribed acceleration and duration thresholds. A configuration of such inertial mechanical delay mechanisms was presented by the examples the embodiments of FIGS. 12 and 14 for as applied to the inertial mechanical delay mechanism embodiment 10 of FIG. 6A. The "high G activation prevention mechanisms" may be readily applied to the inertial mechanical delay mechanism embodiment 160 of FIG. 17 as illustrated in the schematics of FIGS. 19A and 19B.

In this example of the application of the above methods, the previously described "high G activation prevention mechanism" 109 is used to provide the inertial mechanical delay mechanisms embodiment 160 of FIG. 17 with the same high G activation prevention functionality as that of the embodiment of FIG. 12. In the schematic of FIG. 19A, the "high G activation prevention mechanism" 200 (109 in FIG. 12) is shown to be used to prevent at least one of the "sliding mass-spring assembly" units (156 in FIG. 19A) of the inertial mechanical delay mechanism embodiment 160 of FIG. 17 from being fully activated. The activation prevention mechanisms used for all at least one sliding mass-spring assembly units may be identical or may be configured to provide different operational characteristic as are described later in this disclosure.

It is appreciated that the "high G activation prevention mechanism" 200 is configured to reset, i.e., return to their initial positions shown once the applied relatively high G acceleration event has ceased. However, in certain applications, particularly if the experienced high G acceleration could have damaged the device in which the inertial mechanical delay mechanism is mounted, the inertial mechanical delay mechanism and the device(s) that it is used to operate may be desired to be rendered non-operative. In such applications, the "high G activation prevention mechanism" 200 needs to be configured to be non-resettable, i.e., continue to block activation of at least one of the "sliding mass-spring assembly" units.

Figure 19A:
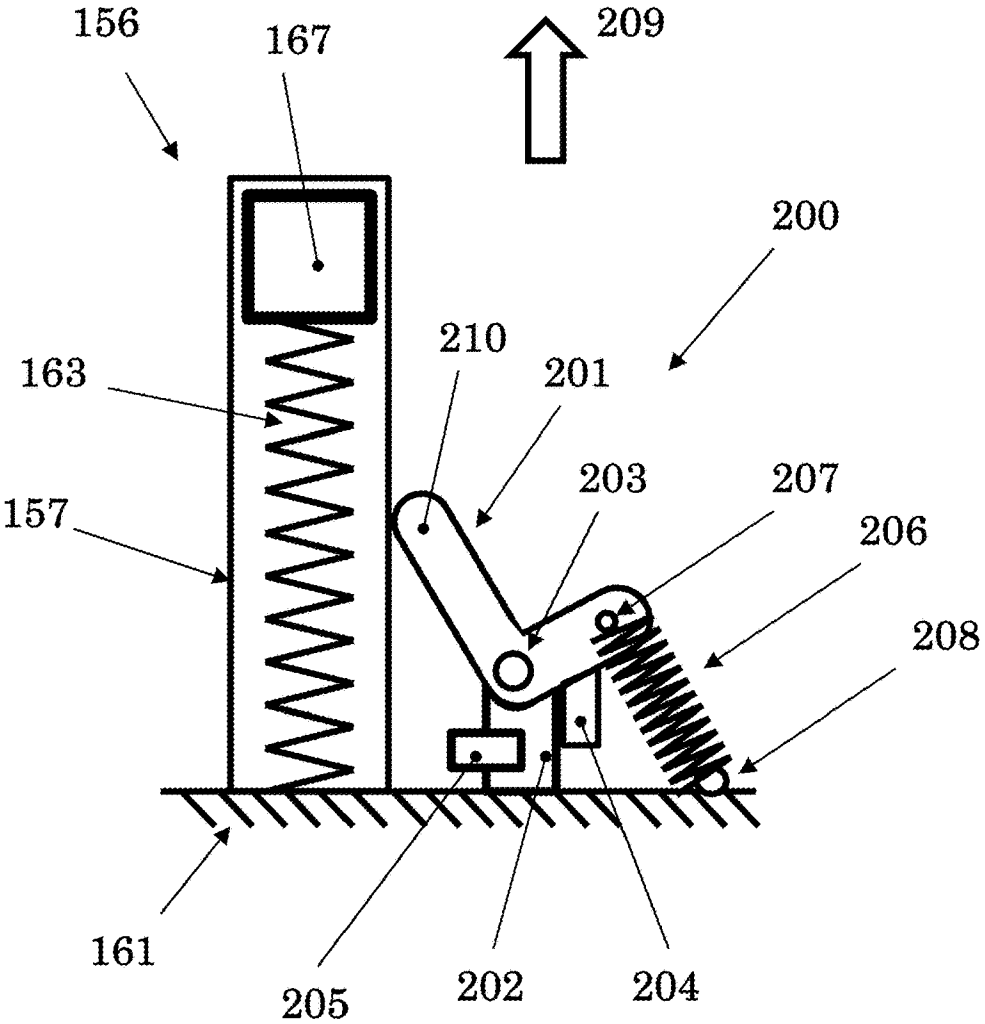
FIG. 19A illustrates the schematic of an example of an activation prevention mechanism for preventing activation of the inertial mechanical delay mechanism embodiment of FIG. 17 when subjected to relatively high G accidental acceleration events.

In FIG. 19A, the frontal view "F" of the "sliding mass-spring assembly" units (156 in FIG. 19A) of the inertial mechanical delay mechanism embodiment 160 of FIG. 17 is shown together with the "high G activation prevention mechanism" 200 in the rest positioning of the inertial mechanical delay mechanism. In the schematic FIG. 19A, as it was described for the inertial mechanical delay mechanism 160, the mass member 167 of the sliding mass-spring assembly unit 156 is attached to the base structure 161 of the inertial mechanical delay mechanism, as is the housing 157 of the sliding mass-spring assembly unit 156.

In the schematic of FIG. 19A, similar to the mechanism 109, the "high G activation prevention mechanism" 200 is shown to consist of an "L" shaped link member 201, which is attached to the support member 202 by the rotary joint 203. The support member 203 is fixedly attached to the inertial mechanical delay mechanism base structure 161 and is provided with stop members 204 and 205 to limit clockwise and counterclockwise rotation, respectively, of the "L" shaped link member 201 as viewed in the plane of FIG. 19A. The center of mass of the "L" shaped link member 201 is configured to be to the left side of the rotary joint 203 as viewed in FIG. 19A. A preloaded tensile spring 206, which is attached to the inertial mechanical delay mechanism base structure 161 on one end 208 and to the "L" shaped link member 201 at the joint 207 on the other end, is used to bias the link member 201 against the stop 204 as shown in the configuration of the FIG. 19A, i.e., when the inertial mechanical delay mechanism is at rest.

When the inertial mechanical delay mechanism embodiment 160 of FIG. 17 that is provided with at least one "high G activation prevention mechanism" 200 is subjected to acceleration in the direction of the arrow 209 (168 in FIG. 17), the acceleration acts on the center of mass of the "L" shaped link member 201, which is located on the left side of the joint 203, applying a counterclockwise torque to the link member 201, which would tend to rotate it in the counterclockwise direction.

In general, inertial mechanical delay mechanisms, such as the embodiment 160 of FIG. 17, are configured with "high G activation prevention mechanisms" 200, FIG. 19A, in which the preloading level of their preloaded tensile springs 206 are selected such that they would counter the applied counterclockwise torque for accelerations in the direction of the arrow 209 that are at or below the prescribed delay mechanism activation acceleration magnitude threshold.

However, if the inertial mechanical delay mechanism embodiment 160 of FIG. 17 that is provided with at least one "high G activation prevention mechanism" 200 is subjected to an acceleration in the direction of the arrow 209 which has a magnitude that is larger than the prescribed activation acceleration magnitude threshold (aforementioned "relatively high G acceleration"), the generated counterclockwise toque that is applied to the "L" shaped link member 201 would overcome the clockwise torque of the preloaded tensile spring 206, causing the link member 201 to begin to be rotated in the counterclockwise direction.

It is appreciated that in the resting positioning of the inertial mechanical delay mechanism embodiment 160 of FIG. 17, the branch 210 of the "L" shaped link member 201 is positioned slightly in front of the mass member 167 of the sliding mass-spring assembly unit 156. As a result, if the applied "relatively high G acceleration" in the direction of the arrow 209 persists long enough and/or the magnitude of the applied "relatively high G acceleration" is high enough, the "L" shaped link member 201 will continue its counterclockwise rotation and position the tip portion of the branch 210 of the "L" shaped link member 201 in the path of travel of the mass member 167 of the sliding mass-spring assembly unit 156 as shown in the schematic of FIG. 19B. In general, the stop member 205 is provided to limit the counterclockwise rotation of the "L" shaped link member 201.

It is appreciated that the activation of those sliding mass-spring assembly units that have not yet been activated is thereby blocked by the provided "high G activation prevention mechanisms" 200. For example, in the inertial mechanical delay mechanism embodiment 160 of FIG. 17, which is provided with a total of three sliding mass-spring assembly units, depending on the magnitude and duration of the high G acceleration in the direction of the arrow 209, since there is a delay between the activation of the second sliding mass-spring assembly unit 155 relative to the activation of the first sliding mass-spring assembly unit 154, and similarly there is even a longer delay between the activation of the third sliding mass-spring assembly unit 156 relative to the activation of the first sliding mass-spring assembly unit 154, the "high G activation prevention mechanisms" 200 can always be configured to have enough time to at least prevent activation of one of the sliding mass-spring assembly units.

The provision of the "high G activation prevention mechanisms" 200 would therefore provide the inertial mechanical delay mechanism 160 of FIG. 17 with the capability of avoiding full activation when the applied acceleration in the intended direction of their operation, i.e., in the direction of the arrow 168, is higher than their prescribed acceleration magnitude threshold, even if the duration of the applied high G acceleration is longer than the prescribed acceleration threshold duration.

It is appreciated that once the high G acceleration has ceased, the "L" shaped link member 201 of the "high G activation prevention mechanisms" 200 is rotated in the clockwise direction by the preloaded tensile spring 206 and is brought back to its initial positioning shown in the schematic of FIG. 19A. All activated sliding mass-spring assembly units would also return to their initial positioning shown in FIG. 17.

It is appreciated that the "high G activation prevention mechanism" 200 of FIG. 19A is configured to reset, i.e., return to their initial positions shown once the applied relatively high G acceleration event has ceased. However, in certain applications, particularly if the experienced high G acceleration could have damaged the device in which the inertial mechanical delay mechanism is mounted, the inertial mechanical delay mechanism and the device(s) that it is used to operate may be desired to be rendered non-operative. In such applications, the "high G activation prevention mechanism" of FIG. 19A needs to be configured to be non-resettable, i.e., stay in the configuration of FIG. 19B, and continue to block at least one of the sliding mass-spring assembly unit from resetting.

It is appreciated that a method for preventing resetting of an inertial mechanical delay mechanism once it has been subjected to a relatively high G acceleration event was previously described for the "high G activation prevention mechanisms" 109 or 125 of FIGS. 12 and 14, respectively, as based on "locking" the deployed members of the "high G activation prevention mechanisms" that block at least one of the beam elements of the rotary beam assembly units of the delay mechanism, such as the members 114 and 130 of the "high G activation prevention mechanisms" 109 and 125 of FIGS. 12 and 14, respectively. The same method and mechanisms may also be used to "lock" the deployed member (branch 210 of the "L" shaped link member 201) of the "high G activation prevention mechanisms" 200 in its deployed position shown in FIG. 19B, thereby preventing the inertial mechanical delay mechanism embodiment 160 of FIG. 17 from resetting following subjection to a previously described relatively high G acceleration event.

It is appreciated that in the case of the "high G activation prevention mechanisms" 200, the cross-section 142 and 152 in FIGS. 16A and 16B, respectively, would indicate the cross-sectional views of the branch 210 of the "L" shaped link member 201, FIGS. 19A and 19B.

Figure 20B:
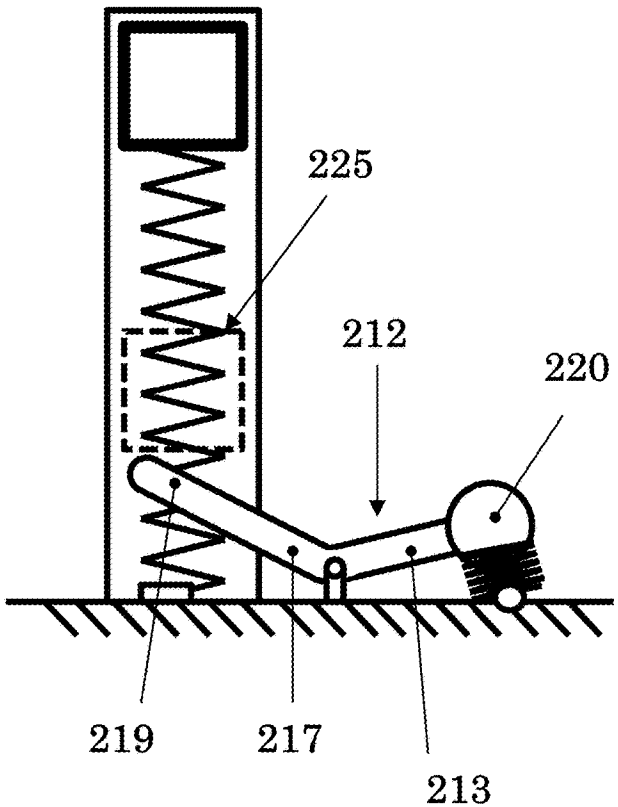
FIG. 20B illustrates the schematic of the example of the activation prevention mechanism of FIG. 20A as it is moved to prevent activation (displacement) of the mass member of the "sliding mass-spring assembly" unit of the inertial mechanical delay mechanism.
Figure 20A:
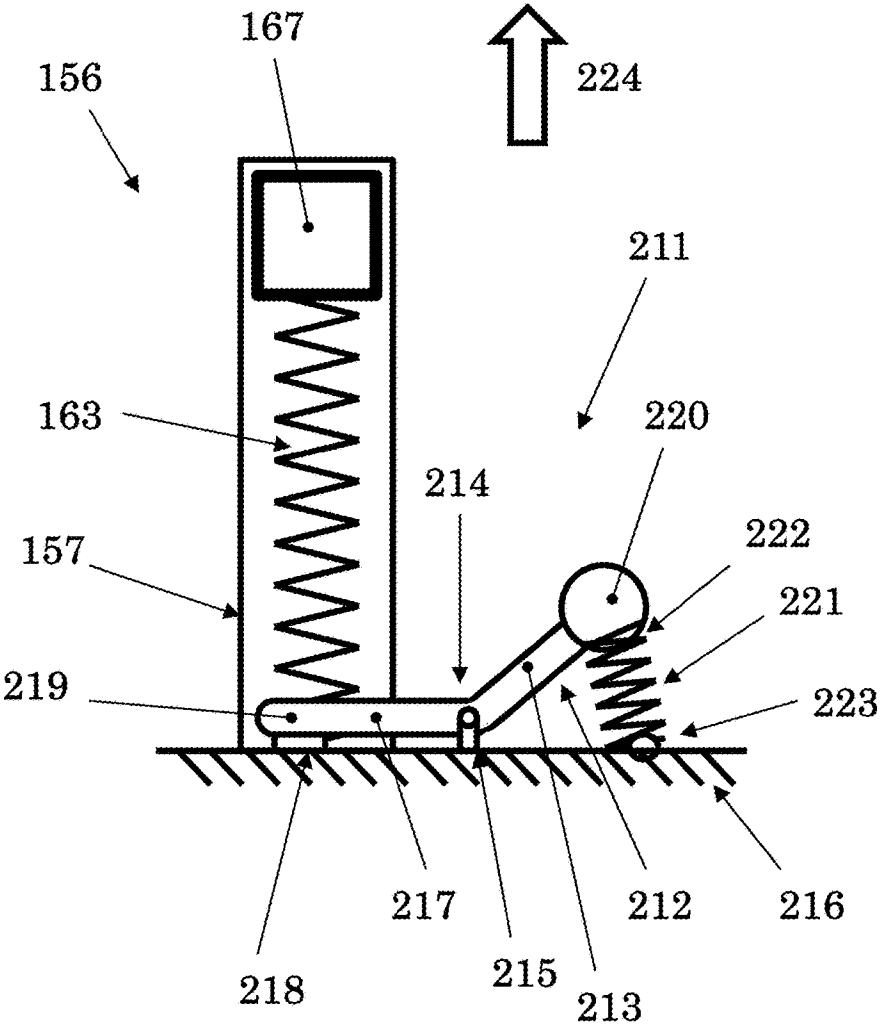
FIG. 20A illustrates the schematic of another example of an activation prevention mechanism for preventing activation of the inertial mechanical delay mechanism embodiment of FIG. 17 when subjected to relatively high G accidental acceleration events.

It is appreciated that alternatively, "high G activation prevention mechanisms" of the type illustrated in the schematic of FIG. 14 (indicated with the numeral 125) may be used instead of the "high G activation prevention mechanism" 200 of FIG. 19A to perform the same functionality as shown in the schematics of FIGS. 20A and 20B.

In FIG. 20A, the frontal view "F" of the "sliding mass-spring assembly" units (156 in FIG. 19A) of the inertial mechanical delay mechanism embodiment 160 of FIG. 17 is shown together with the aforementioned alternative "high G activation prevention mechanism" 211 (125 in FIG. 14) in the rest positioning of the inertial mechanical delay mechanism. In the schematic FIG. 19A, as it was described for the inertial mechanical delay mechanism 160, the mass member 167 of the sliding mass-spring assembly unit 156 is attached to the base structure 161 of the inertial mechanical delay mechanism, as is the housing 157 of the sliding mass-spring assembly unit 156.

In the schematic of FIG. 20A, the "high G activation prevention mechanism" 211 (125 in FIG. 14) is shown to similarly consist of an "V" shaped link member 212 (130 in FIG. 14), which is attached to the support member 215 by the rotary joint 214. The support member 215 is fixedly attached to the inertial mechanical delay mechanism base structure 216 (126 in FIG. 14). The branch 213 of the "V" shaped link member 212 is provided with the mass member 220 (134 in FIG. 14) to shift the center of mass of the link 212 to the right of the joint 214 as viewed in the plane of the FIG. 20A. A preloaded compressive spring 221, which is attached to the inertial mechanical delay mechanism base structure 216 on one end 223 and on the other end 222 to the "V" shaped link member 212 (via the branch 213 or the mass member 220), is used to bias the branch 217 of the "V" shaped link member against the stop 218 as shown in the configuration of the FIG. 20A, i.e., when the inertial mechanical delay mechanism is at rest.

When the inertial mechanical delay mechanism embodiment 160 of FIG. 17 that is provided with at least one "high G activation prevention mechanism" 211 is subjected to acceleration in the direction of the arrow 224 (168 in FIG. 17), the acceleration acts on the center of mass of the "V" shaped link member 211, which is located on the right side of the joint 214, applying a clockwise torque to the link member 211, which would tend to rotate it in the clockwise direction.

In general, inertial mechanical delay mechanisms, such as the embodiment 160 of FIG. 17, are configured with "high G activation prevention mechanisms" 211 in which the preloading level of their preloaded compressive springs are selected such that they would counter the aforementioned applied clockwise torque for accelerations that are at or below the prescribed delay mechanism activation acceleration magnitude threshold.

However, if the inertial mechanical delay mechanism embodiment 160 of FIG. 17, which is provided with at least one "high G activation prevention mechanism" 211 is subjected to an acceleration in the direction of the arrow 224 which has a magnitude that is larger than the prescribed activation acceleration magnitude threshold ("relatively high G acceleration"), the previously indicated generated clockwise toque that is applied to the "V" shaped link member 212 would overcome the counterclockwise torque of the preloaded compressive spring 211, causing the link member 212 to begin to be rotated in the clockwise direction.

It is appreciated that in the resting positioning of the inertial mechanical delay mechanism embodiment 160 of FIG. 17, the branch 217 of the "V" shaped link member 212 is positioned in the path of downward displacement of the mass member 167 of the sliding mass-spring assembly unit 156. As a result, if the applied "relatively high G acceleration" in the direction of the arrow 224 persists long enough and/or the magnitude of the applied "relatively high G acceleration" is high enough, the "V" shaped link member 212 will continue its clockwise rotation and position the front portion 219 of the "V" shaped link member 213 in the path of the downward displacement of the mass member 167 as shown in dashed line and indicated by the numeral 225 in FIG. 20B. In general, a stop member (not shown) may be provided to limit the clockwise rotation of the "V" shaped link member 212.

It is appreciated that the activation of those sliding mass-spring assembly units that have not yet been activated can be blocked by the provided "high G activation prevention mechanisms" 211. For example, in the inertial mechanical delay mechanism embodiment 160 of FIG. 17, which is provided with a total of three sliding mass-spring assembly units, depending on the magnitude and duration of the high G acceleration in the direction of the arrow 168, since there is a delay between the activation of the second sliding mass-spring assembly unit 155 relative to the activation of the first sliding mass-spring assembly unit 154, and similarly there is even a longer delay between the activation of the third sliding mass-spring assembly unit 156 relative to the activation of the first sliding mass-spring assembly unit 154, the "high G activation prevention mechanisms" 211 can always be configured to have enough time to at least prevent activation of one of the sliding mass-spring assembly units. The provision of the "high G activation prevention mechanisms" 211 would therefore provide the inertial mechanical delay mechanism embodiment 160 with the capability of avoiding full activation when the applied acceleration in the intended direction of their operation, i.e., in the direction of the arrow 168, is higher than their prescribed acceleration magnitude threshold, even if the duration of the applied high G acceleration is longer than the prescribed acceleration threshold duration.

It is appreciated that once the high G acceleration has ceased, the "V" shaped link member 212 of the "high G activation prevention mechanisms" 211 is rotated in the counterclockwise direction by the preloaded compressive spring 221 and is brought back to its initial positioning shown in the schematic of FIG. 20A. All activated rotary beam assembly units would also return to their initial positioning shown in FIG. 17.

It is appreciated that a method for preventing resetting of an inertial mechanical delay mechanism once it has been subjected to a relatively high G acceleration event was previously described for the "high G activation prevention mechanisms" 109 or 125 of FIGS. 12 and 14, respectively, as based on "locking" the deployed members of the "high G activation prevention mechanisms" that block at least one of the beam elements of the rotary beam assembly units of the delay mechanism, such as the members 114 and 130 of the "high G activation prevention mechanisms" 109 and 125 of FIGS. 12 and 14, respectively. The same method and mechanisms may also be used to "lock" the deployed member (branch 217 of the "V" shaped link member 212) of the "high G activation prevention mechanisms" 211 in its deployed position shown in FIG. 20B, thereby preventing the inertial mechanical delay mechanism embodiment 160 of FIG. 17 from resetting following subjection to a previously described relatively high G acceleration event.

It is appreciated that in the case of the "high G activation prevention mechanisms" 211, the cross-section 142 and 152 in FIGS. 16A and 16B, respectively, would indicate the cross-sectional views of the branch 217 of the "V" shaped link member 212, FIGS. 20A and 20B.

It is appreciated by those skilled in the art that as can be observed, the inertial mechanical delay mechanism embodiment 160 of FIG. 17 can only be activated by accelerations (of the prescribed magnitude and duration) in the direction of the arrow 168. This is the case since the mass members of its sliding mass-spring assembly units are constrained from motion in all directions except downward in response to acceleration in the direction of the arrow 168. These characteristics of the inertial mechanical delay mechanism embodiment 160 of FIG. 17, particularly when the mechanism is provided with one of the aforementioned types of "high G activation prevention mechanisms" of FIG. 19A or 20A, makes is highly suitable for applications that the device in which the delay mechanism is used may be subjected to accidental, sometimes very high G, accelerations and their possible activation is of great safety concern.

In the above description of the inertial mechanical delay mechanism embodiment 160 of FIG. 17, all its sliding mass-spring assembly units (three in the FIG. 17 or more) were considered to have identical mass members and preloaded compressive springs. The preloaded compressive springs may also be considered to have constant spring rate, i.e., be springs with linear force vs. deformation characteristics. However, it is appreciated by those skilled in the art that the sliding mass-spring assembly units may have different mass members and compressive springs that have different preloading levels and have different constant spring rate or have nonlinear force vs. deformation characteristics. The delay mechanism can be configured by selecting the indicated mass member and spring parameters as well as the sliding mass-spring assembly unit heights to achieve the desired the inertial mechanical delay mechanism response to the operating acceleration profiles (all-fire condition in munitions) and accidental (no-fire conditions in munitions) acceleration events.

Figure 21:
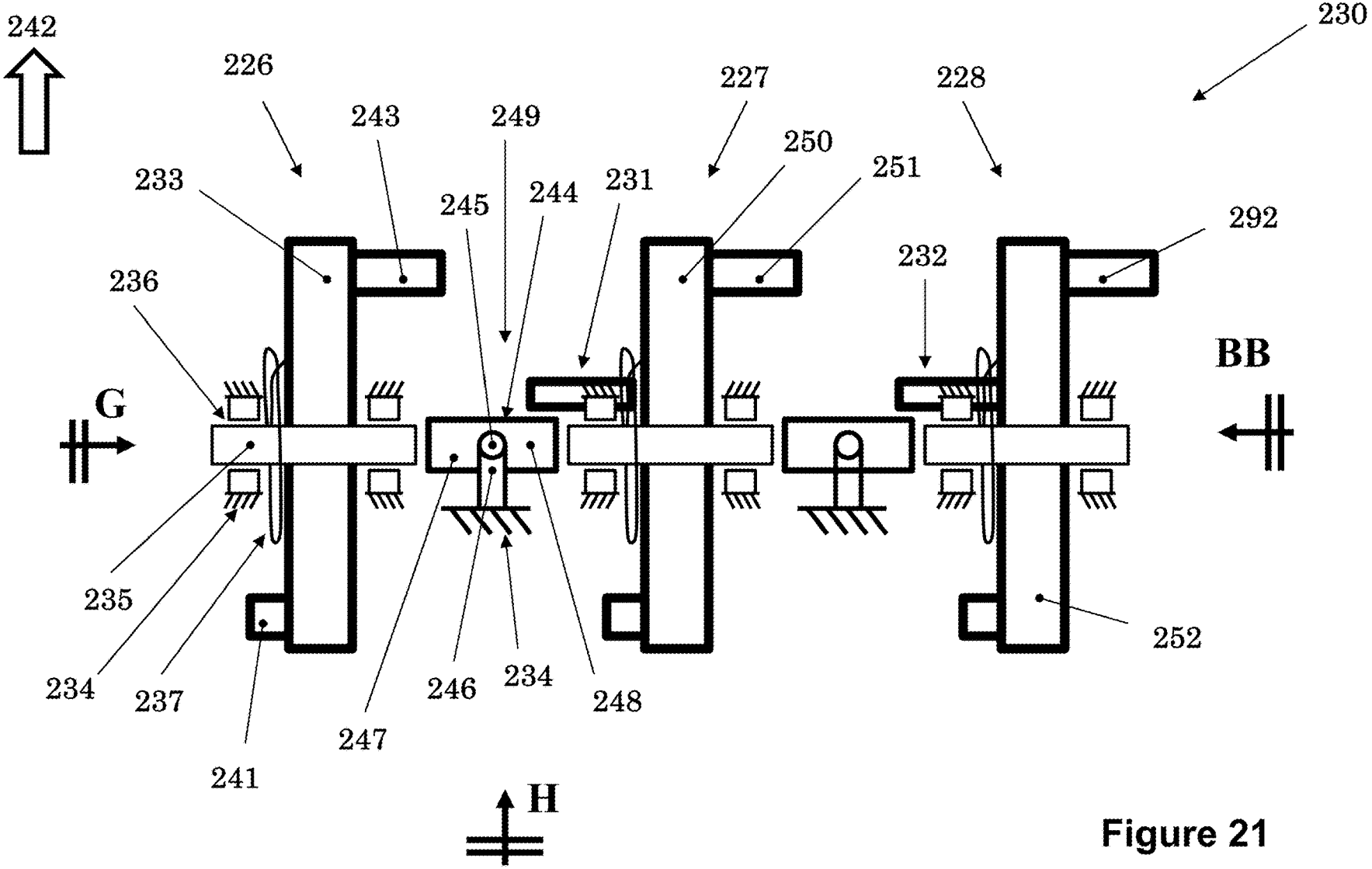
FIG. 21 illustrates the schematic top view of the third inertial mechanical delay mechanism embodiment for generating long duration delays in various devices in its pre-activation state.

Another example of a configuration inertial mechanical delay mechanisms is illustrated in the schematic of FIG. 21. In FIG. 21, the top view of the present inertial mechanical delay mechanism embodiment 230 is shown in its rest position. This inertial mechanical delay mechanism can be the same as those of the previous embodiments and the delay mechanism can be used in devices such as inertial igniters or impulse switches or the like to actuate their release/actuation mechanisms only after a prescribed minimum setback acceleration threshold and duration (all-fire condition in munitions) has been detected.

It is appreciated by those skilled in the art that the delay mechanisms alone or as integrated, for example, with the striker mass of an inertial igniter and its release mechanism, it must ensure that the inertial igniter is initiated only after a prescribed minimum setback acceleration threshold and its duration (all-fire condition) has been detected.

In the schematic of FIG. 21, the inertial mechanical delay mechanism embodiment 230 is shown in its resting configuration (pre-activation state). The inertial mechanical delay mechanism embodiment 230 is seen consist of three "wheel assembly" units 226, 227 and 228. It is, however, appreciated that the inertial mechanical delay mechanism may be constructed with fewer or more such wheel assembly units.

In the inertial mechanical delay mechanism embodiment 230 of FIG. 21, three wheel assemblies 226, 227 and 228 are identical, except for the first wheel assembly 226, which is not provided with a stop member 231 and 232 in the wheel assemblies 227 and 228, respectively, the function of which is described later. It is appreciated, however, that the individual wheel assemblies may be configured differently in shape, size, etc., to achieve different performance characteristics for the resulting inertial mechanical delay mechanism as described later in this disclosure.

Figure 22:
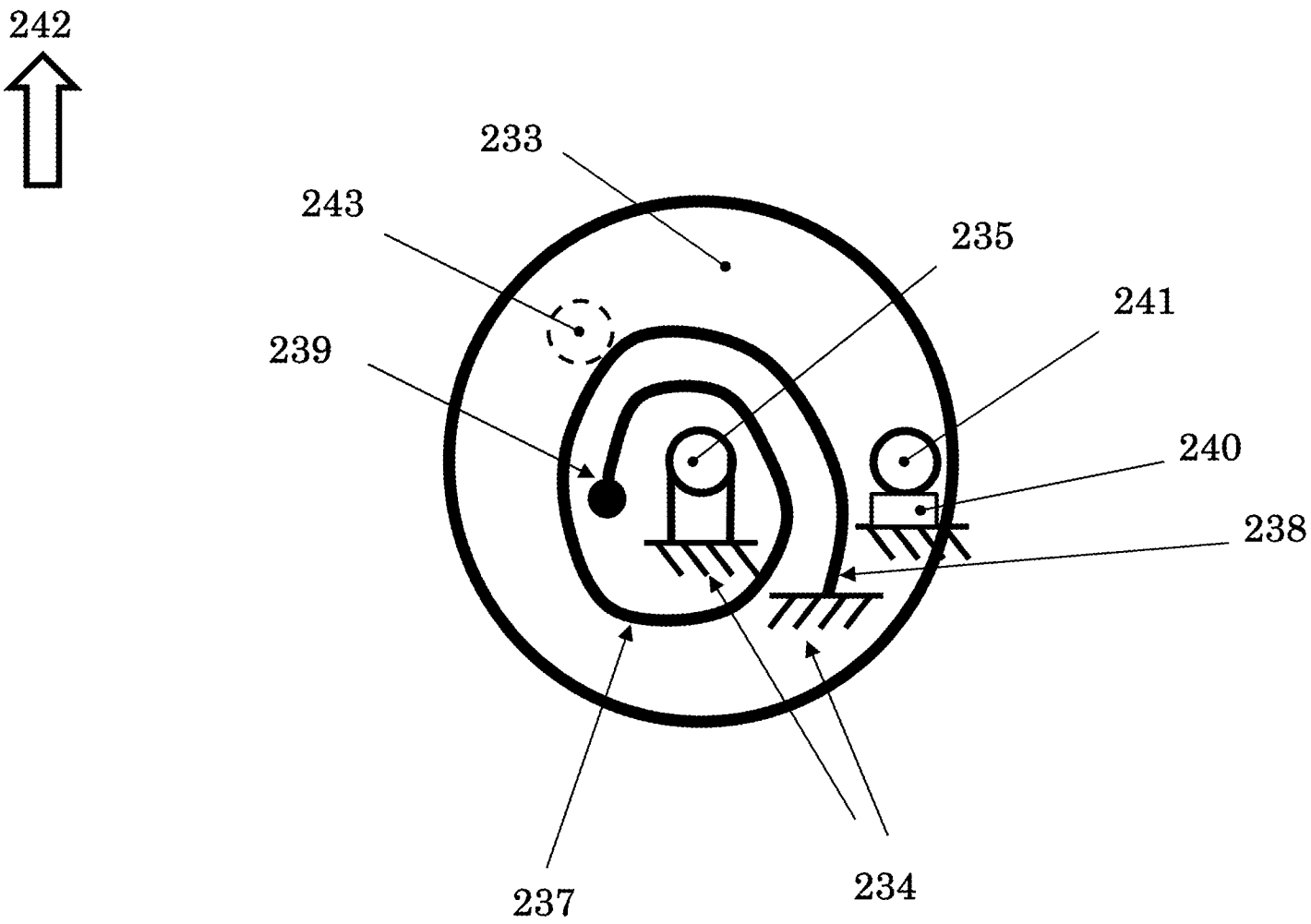
FIG. 22 illustrates the side view "G" of FIG. 21 showing the components of the viewed wheel assembly of the inertial mechanical delay mechanism.

The inertial mechanical delay mechanism embodiment 230 of FIG. 21 can be seen to consist of a first wheel assembly 226, which is constructed with a wheel member 233, which is attached to the base structure 234 of the inertial mechanical delay mechanism 230 by the shaft 235, which is free to rotate in the bearings 236. The wheel assembly 233 is also provided with a slightly preloaded torsion spring 237, which is positioned to apply a torque to the wheel 233 to bias it to its initial positioning as shown in FIG. 22 of the view "G" of FIG. 21. As can be seen in FIG. 22 of the view "G", one end 238 of the preloaded torsion spring 237 is fixedly attached to the inertial mechanical delay mechanism base structure 234 and the other end 239 is fixedly attached to the wheel member 233, thereby the slight preloading of the torsion spring 237 in the configuration shown in FIG. 22 would bias the wheel member 233 to stay in contact against the stop 240 by its member 241 by the application of a relatively small clockwise torque to the wheel member. The wheel member 233 is configured such that its center of mass (not shown) lies on the axis of rotation of the shaft 235, which is normal to the direction of the prescribed delay mechanism activation acceleration (shown by the arrow 242 in FIG. 21) to which the inertial mechanical delay mechanism embodiment 230 is configured to respond. It is noted that as previously indicated, all wheel assemblies are identical to the wheel assembly 226 as shown in FIGS. 21 and 22, except that they are also provided with the stop member 231, the function of which is described later.

It is noted that for the sake of simplicity, the torsion springs 237 of the wheel assemblies 226, 227 and 228 are considered to have constant torque in the following descriptions, particularly for their relatively limited range of utilized motions in the present inertial mechanical delay mechanisms. It is, however, appreciated by those skilled in the art that when configuring such inertial mechanical delay mechanisms, the increase in their applied torque to the assembly wheel members must be considered.

In addition, all wheel assemblies are provided with the offset mass 243, FIGS. 21 and 22, which shifts the center of mass of the wheel members slightly to the left of the shaft 235 as viewed in the schematic of FIG. 22, and upon application of acceleration in the direction of the arrow 242, as can be seen in the schematic of FIG. 22, would generate a downward dynamic force as viewed in the plane of FIG. 22, which would in turn apply a counterclockwise (as viewed in the view "G" direction) torque to the wheel 233, which would tend to rotate the wheel in the counterclockwise direction (as viewed in the view "G" direction of FIG. 22). The generated counterclockwise torque must, however, overcome the clockwise preloading torque of the torsion spring 237 before being able to start to rotate the wheel 233 in the counterclockwise direction as viewed in FIG. 22.

Therefore, if the acceleration in the direction of the arrow 242 is not enough to generate a torque that would overcome the preloading torque of the torsion spring 237, then the wheel member 233 would stay stationary in its position shown in FIGS. 21, resting against the stop 240, FIG. 22. However, if the acceleration in the direction of the arrow 242 is high enough to overcome the preloading torque of the torsion spring 237, then the wheel member 233 would begin to rotate in the counterclockwise direction.

Now if the magnitude of the acceleration in the direction of the arrow 242 is relatively low and/or its duration is relatively short, then the wheel member 233 is accelerated in the counterclockwise direction a relatively small angle and is then returned to its starting position shown in FIGS. 21 and 22.

However, if the magnitude of the acceleration in the direction of the arrow 242 is high enough and its duration is long enough, then the wheel member 233 is rotationally accelerated in the counterclockwise direction until its offset mass 243 reaches and engages the release mechanism 249 and releases the wheel assembly 227 as described below.

Between the first wheel assembly 226 and the second wheel assembly 227 (and similarly between the second and third wheel assemblies 227 and 228, and sequentially between other wheel assemblies that may be provided), a release mechanism 249 is provided for sequential release of the wheel assemblies. The release mechanism 249 consists of a link 244, which is attached to the base structure 234 of the inertial mechanical delay mechanism 230 by the rotary joint 245 provided in the support 246, which is fixedly attached to the base structure 234. Link 244 is provided with a soft torsion spring (not shown) at the joint 245 to normally bias it to stay in the configuration shown in FIG. 21.

Figure 23:
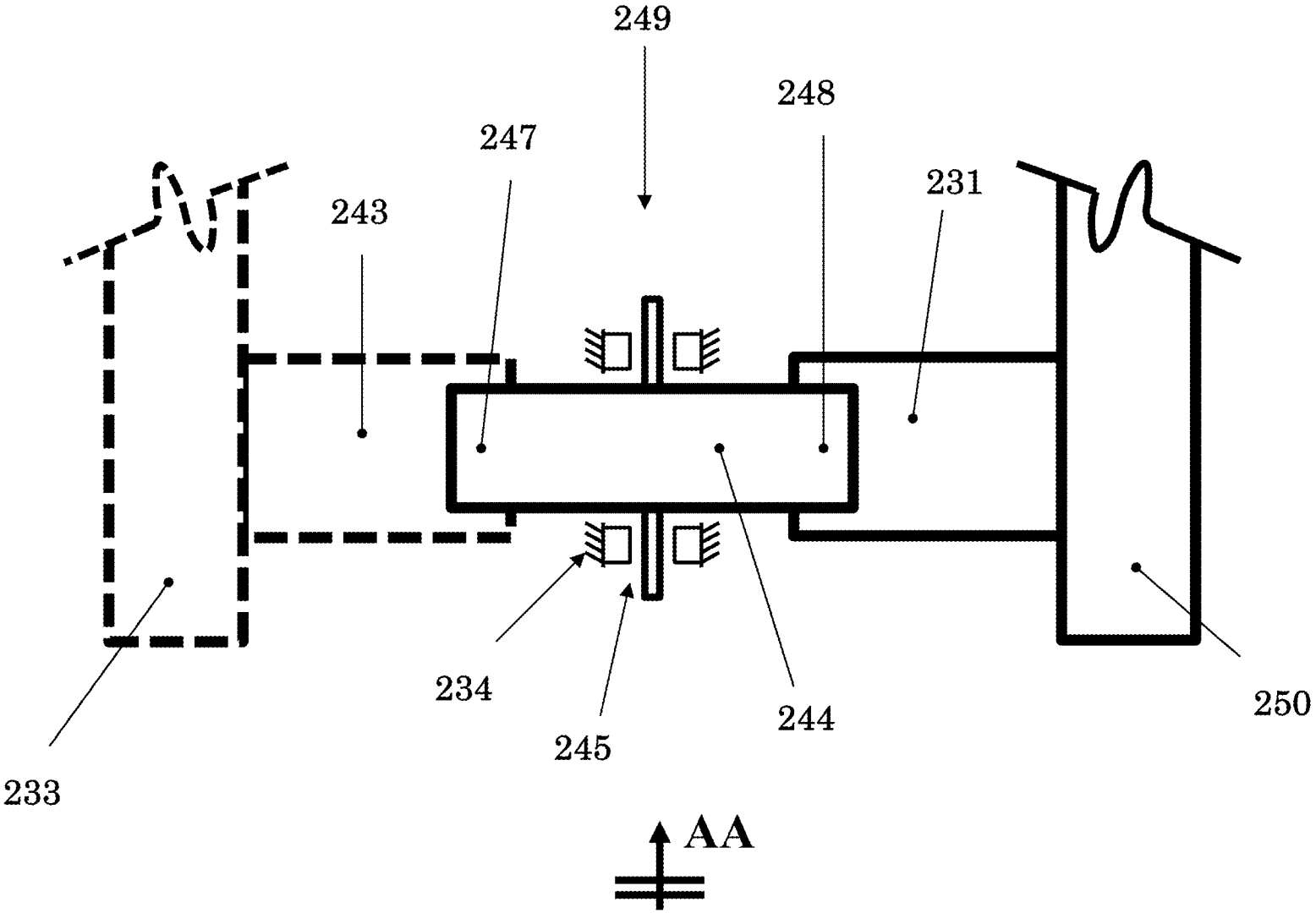
FIG. 23 illustrates the side view "H" of FIG. 21 showing the components of the release mechanism for sequential release of wheel assemblies of the inertial mechanical delay mechanism.

The view "H" of the release mechanism 249 is shown in the schematic of FIG. 23. In FIG. 23, the view "H" shows that the link 244 of the release mechanism 249 is positioned to engage the stop member 231 of the wheel 250 of the wheel assembly 227 in the initial (pre-activation) configuration of the inertial mechanical delay mechanism embodiment 230, FIG. 21. In this configuration, the lightly preloaded torsion spring of the wheel assembly 227 biases the stop member 231 against the tip 248 of the link 244 of the release mechanism 249, FIG. 23.

In the view "H" of FIG. 23, the offset mass 243 of the wheel 233 of the first wheel assembly 226, FIG. 21, and the visible portion of the wheel 233 are shown in dashed lines to indicate their positioning as the wheel 233 had been rotated in the counterclockwise direction (as viewed in the view "G" direction of FIG. 22) due to an operating acceleration in the direction of the arrow 242 and just at the moment of the offset mass 243 is about to strike the back side (as viewed in FIG. 23) of the tip 247 of the link 244 of the release mechanism 249. Now as it was previously indicated, when the inertial mechanical delay mechanism embodiment 230 of FIG. 21 is subjected to acceleration in the direction of the arrow 242, if the magnitude of the acceleration in the direction of the arrow 242 is high enough and its duration is long enough, then the wheel member 233 is rotationally accelerated in the counterclockwise direction until its offset mass 243 reaches the position shown by dashed lines in FIG. 23, and strike the back of the tip 247 (as seen in FIG. 23) of the link 244 of the release mechanism 249, causing it to rotate in (tip 247 of the link 244 out of the plane of the FIG. 23 and the tip 248 of the link 244 into the plane of the FIG. 23), thereby clearing the stop member 231 of the wheel member 250 of the wheel assembly 227.

Now if the aforementioned acceleration in the direction of the arrow 242 (and of the indicated magnitude) persists, then similar to the wheel 233 of the wheel assembly 226, the wheel member 250 is rotationally accelerated in the counterclockwise direction until its offset mass 251 reaches the position shown by dashed lines in FIG. 23 for the release mechanism 249 (but for the release mechanism between the wheel assemblies 227 and 228), and would sequentially release the wheel 252 of the wheel assembly 228 an other additional wheel assemblies that might be provided to the inertial mechanical delay mechanism embodiment of FIG. 21.

It is appreciated that a wheel member of a wheel assembly (for example, wheel member 233 of the wheel assembly 226) is rotated in the counterclockwise direction due to the applied acceleration in the direction of the arrow 242 as was previously described, its center of mass shifts to the left as viewed in FIG. 22 until the offset mass 243 is horizontally inline with the center of the rotary joint 235, during which time the dynamic force acting on its center of mass gains increased moment arm and generates an increasing amount of counterclockwise torque to the wheel member. However, the amount of generated counterclockwise torque decreases as the wheel member continues its counterclockwise rotation and becomes zero when the offset as 243 is directly under the center of the rotary joint 235. At this point and depending on the magnitude of the applied acceleration, the wheel member would still have certain counterclockwise rotary velocity, i.e., rotary kinetic energy, which allows the wheel member to continue to rotate in the counterclockwise (even possibly passed impact with the tip 247 of the link 244 of the release mechanism 249, until its kinetic energy is absorbed by the further loading of the torsion spring 237 or if the wheel member is configured to stop its rotation by a provided stop (not shown).

It is appreciated that in practice, torsion springs used in present applications are not of constant torque type, i.e., they usually have a linear or nonlinear spring rate, which means as the wheel member continues its counterclockwise rotation, the level of resistive torque applied to the wheel member by the torsion spring is increased. In general, the spring rate of the torsion spring can be selected such that the wheel member would not require a hard stop to limit its counterclockwise rotation. In addition, higher torsional spring rates are also used to provide for higher minimum acceleration magnitude that would cause the first (or even intermediate) wheel assembly to activate the next wheel assembly, i.e., to actuate the release mechanisms (e.g., 249 in FIG. 21).

It is appreciated that once the applied acceleration in the direction of the arrow 242 has ceased, the wheels of the activated wheel assembly units begin to be rotated back in the clockwise direction by the preloaded torsion springs, for example, the activated wheel member 233 of the wheel assembly 226 begins to be rotated back in the clockwise direction as viewed in FIG. 22 by the torsion spring 237.

It is appreciated that as it was previously described, if the wheel member 233 of the first wheel assembly unit 226 has been "partially" activated (here, "partial" is intended to indicate counterclockwise rotation of the wheel member up to the point of striking the tip 247 of the link 244 of the release mechanism 249), the wheel member 233 and thereby the inertial mechanical delay mechanism embodiment 230 of FIG. 21 would return (reset) to its initial positioning of FIG. 21. However, if the wheel member 233 has engaged and rotated the link 244 of the release mechanism 249 and released the wheel member 250 of the next wheel assembly unit 227, if the offset mass 243 (stop member 231) of the wheel member 233 (wheel member 250) arrives at the link 244 of the release mechanism 249 and rotates and passes it before stop member 231 (offset mass 243) arrives and engages the link 244, then the inertial mechanical delay mechanism would reset to its initial state of FIG. 21. Otherwise in certain situations, both offset mass 243 and stop member 231 could arrive nearly simultaneously and engage the link 244. If such a configuration occurs, the inertial mechanical delay mechanism could still be configured to reset since in this configuration the wheel member 250 is rotationally near its balanced state, i.e., applies significantly less force to the tip 248 of the link 244 than the wheel member 233, which is close to its peak rotational displacement from its balanced state, therefore the offset mass 243 would first rotate the link 244 and pass its engagement and thereby allow the stop member 231 to rotate the link 244 next and pass its engagement. The inertial mechanical delay mechanism embodiment 230 of FIG. 21 can therefore be seen to be resettable.

An alternative method of making the inertial mechanical delay mechanism embodiment of FIG. 21 fully resettable, is to ensure that once that the offset mass of one wheel member has released the wheel member of the next wheel assembly, it can always reset once the acceleration in the direction of the arrow 242 has ceased or been reduced well below the prescribed operational acceleration magnitude of the delay mechanism no matter where the wheel member of the released wheel assembly might be positioned. The released wheel member must also be capable of resetting independent of the positioning of any other wheel member, i.e., any wheel member must be capable of resetting independent of the motion of any other wheel member of the inertial mechanical delay mechanism. Such a release mechanism is shown in the schematic of FIG. 24.

Figure 24:
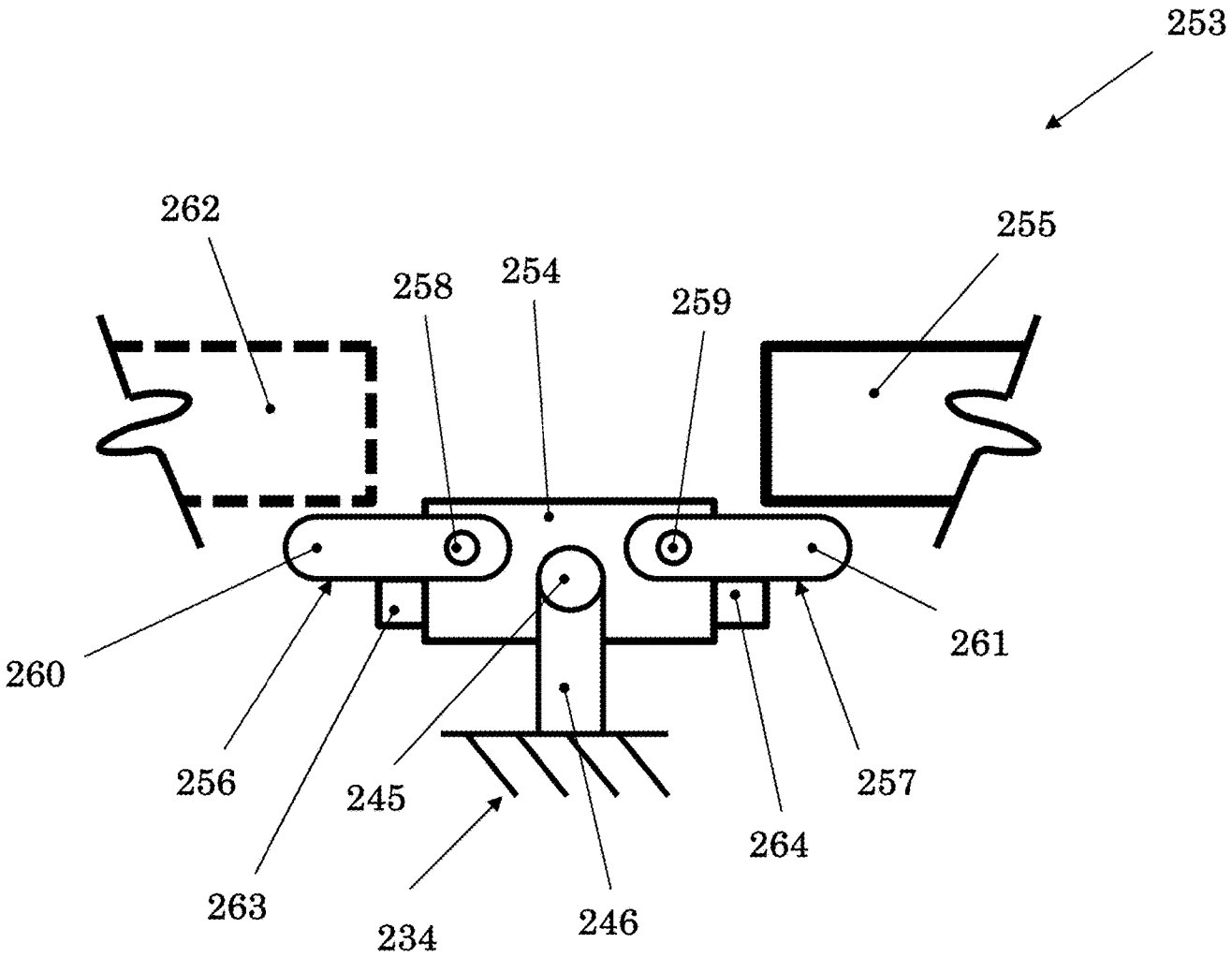
FIG. 24 illustrates the top view of the release mechanism of the inertial mechanical delay mechanism of FIG. 21 showing the components of the alternative release mechanism for sequential release of wheel assemblies of the inertial mechanical delay mechanism for a fully resettable delay mechanism.

In FIG. 24, the top view of the alternative release mechanism as it would be seen in the schematic of FIG. 21 (replacing the release mechanism 249 for all wheel assemblies) that is configured using the above method is illustrated and indicated by the numeral 253. In FIG. 23, the top view shows the link 254 (244 in FIG. 21) of the release mechanism 253 (249 in FIG. 21) is shown to be similarly attached to the base structure 234 of the inertial mechanical delay mechanism 230, FIG. 21, by the rotary joint 245 via the support 246. A torsion spring (not shown) is used at the joint 245 to bias the link 254 to the position shown in FIG. 24. In the alternative release mechanism embodiment of FIG. 24, the link 254 is seen to be shorter than the link 244 in the release mechanism 249 on both of its tips 247 and 248, which are provided for engagement with the offset mass 243 and the stop member 231 as can be seen in FIG. 23. In the alternative release mechanism embodiment of FIG. 24, in place of the tips 247 and 248, the links 256 and 257 are provide, respectively. The links 256 and 257 are attached to the link 254 by the rotary joints 258 and 259, respectively. The links 256 and 257 are both provided with torsion springs (not shown) at their joints 258 and 259 to bias the links against the stops 263 and 264, respectively, which are provided on the link 254 as can be seen in FIG. 24. In the configuration of FIG. 24, the inertial mechanical delay mechanism 230 of FIG. 21 is in its initial (pre-activation) state. The stop member 255 (231 of the wheel 250 of the wheel assembly 227) is therefore biased by the slightly preloaded torsion spring of the wheel assembly 227, FIG. 21, against the tip 261 of the link 257.

In the top view FIG. 24 of the release mechanism 253, the offset mass 243 of the wheel 233 of the first wheel assembly 226, FIG. 21, is shown with dashed lines to indicate their positioning as the wheel 233 had been rotated in the counterclockwise direction (as viewed in the view "G" direction of FIG. 22) due to an operating acceleration in the direction of the arrow 242 and just at the moment of the offset mass 243 is about to strike the back side (as viewed in FIG. 24) of the tip 260 of the link 256 of the release mechanism 253.

Now as it was previously indicated, when the inertial mechanical delay mechanism embodiment 230 of FIG. 21 is subjected to acceleration in the direction of the arrow 242, if the magnitude of the acceleration in the direction of the arrow 242 is high enough and its duration is long enough, then the wheel member 233 is rotationally accelerated in the counterclockwise direction until its offset mass 243 reaches the position shown by dashed lines in FIG. 24, and strike the back of the tip 260 (as seen in FIG. 23) of the link 256 of the release mechanism 253, causing the link 254 to rotate in the counterclockwise direction as viewed in FIG. 24, thereby causing the tip 261 of the link 257 to clear the stop member 255 (231 of the wheel member 250 of the wheel assembly 227).

Now if the aforementioned acceleration in the direction of the arrow 242 (and of the indicated magnitude) persists, then similar to the wheel 233 of the wheel assembly 226, the wheel member 250 is rotationally accelerated in the counterclockwise direction until its offset mass 251 reaches the position shown by dashed lines in FIG. 24 for the release mechanism 253 (but for the release mechanism between the wheel assemblies 227 and 228), and would sequentially release the wheel 252 of the wheel assembly 228 an other additional wheel assemblies that might be provided to the inertial mechanical delay mechanism embodiment of FIG. 21.

It is appreciated that once the applied acceleration in the direction of the arrow 242 has ceased, the wheel members of the activated wheel assembly units begin to be rotated back in the clockwise direction by the preloaded torsion springs, for example, the activated wheel member 233 of the wheel assembly 226 begins to be rotated back in the clockwise direction as viewed in FIG. 22 by the torsion spring 237. Then as some point, the offset mass 262 (243 of the wheel member 233) engages the bottom surface of the tip 260 of the link 256 as viewed in FIG. 24, causes the link 256 to rotate in the clockwise direction to clear it and allow the wheel member (233 for the first wheel assembly 226) to return to its pre-activation state, i.e., to reset. The stop member 255 would also at some point similarly engage the bottom side of the link 257 (as viewed in FIG. 24), rotate the link 257 in the counterclockwise direction and clear it for the corresponding wheel member to return to its pre-activation state, i.e., to reset. Other activated wheel assemblies would similarly reset. The inertial mechanical delay mechanism 230 of FIG. 21 is thereby made fully resettable.

It is appreciated by those skilled in the art that if it is desired for the inertial mechanical delay mechanism embodiment 230 of FIG. 21 not to be resettable, then the release mechanism of the delay mechanism can be configured to prevent the resetting of the activated wheel members of the delay mechanism wheel assemblies. It is also appreciated that many different changes/modifications can be made to the described release mechanisms or different other release mechanisms may be provided so that they would provide the indicated resetting prevention functionality. One example of such release mechanism is provided in the schematic of FIG. 25.

Figure 25:
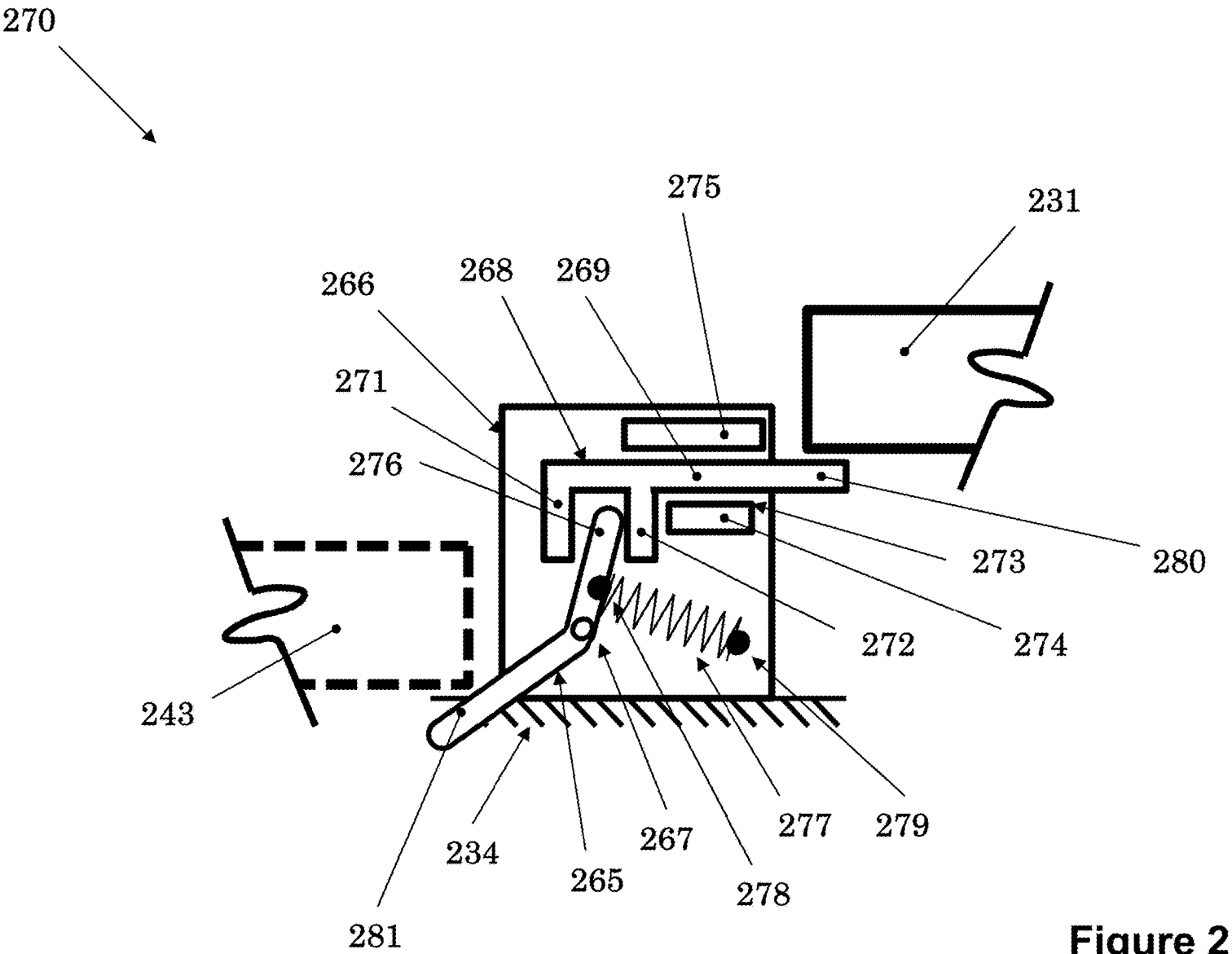
FIG. 25 illustrates an example of a release mechanism for use in the inertial mechanical delay mechanism embodiment of FIG. 21 for rendering the delay mechanism not capable of resetting following activation.

In FIG. 25, the top view of the release mechanism embodiment 270 as it would be seen in the schematic of FIG. 21 (replacing the release mechanism 249 for all wheel assemblies) that is configured to prevent resetting of the activated wheel assemblies of the inertial mechanical delay mechanism 230 of FIG. 21 is illustrated. In FIG. 25, the top view shows the link 265, which is attached to the base 266 of the release mechanism 270 by the rotary joint 267. The base 266 of the release mechanism 270 is in turn fixedly attached to the base structure 234 of the inertial mechanical delay mechanism 230 of FIG. 21. The release mechanism is also provided with the link member 268, the long side 269 of which is configured to slide freely in the enclosed guide 273, which is formed between the base 266 and the covered side members 274 and 275 (the cover of the guide is removed for clarity). The link member 268 is provided with the prongs 271 and 272, within which the tip 276 is positioned and constrained. The release mechanism 270 is also provided with the lightly preloaded tensile spring 277, which is attached to the base 266 of the release mechanism on one end by the rotary joint 279 and to the link 265 by the rotary joint 278 on the other end, thereby biasing the tip 276 of the link 265 against the prong 272 of the link member 268 and the prong 272 against the side 274 of the guide 273 as can be seen in the schematic of FIG. 25. In the configuration of FIG. 25, the inertial mechanical delay mechanism 230 of FIG. 21 is in its initial (pre-activation) state. In this state, the stop member 231 of the wheel 250 of the wheel assembly 227 is therefore biased by the slightly preloaded torsion spring of the wheel assembly 227, FIG. 21, against the tip 280 of the link 268.

In the top view FIG. 25 of the release mechanism 270, the offset mass 243 of the wheel 233 of the first wheel assembly 226, FIG. 21, is shown with dashed lines to indicate their positioning as the wheel 233 had been rotated in the counterclockwise direction (as viewed in the view "G" direction of FIG. 22) due to an operating acceleration in the direction of the arrow 242 and just at the moment of the offset mass 243 is about to strike the end 281 of the link member 265.

Now as it was previously indicated, when the inertial mechanical delay mechanism embodiment 230 of FIG. 21 is subjected to acceleration in the direction of the arrow 242, if the magnitude of the acceleration in the direction of the arrow 242 is high enough and its duration is long enough, then the wheel member 233 is rotationally accelerated in the counterclockwise direction until its offset mass 243 reaches the position shown by dashed lines in FIG. 25 and strikes the end 281 of the link member 265 of the release mechanism 270, FIG. 25, and begins to rotate the link 265 in the counterclockwise direction as viewed in FIG. 25. Then as the link member 265 rotates in the counterclockwise direction, the tip 276 of the link member 265 engages the prong 271 of the link 269 and displaces the link 269 to the left in its guide 273, thereby pulling the tip 280 of the link 269 away from engagement with the stop member 231 of the wheel 250 of the wheel assembly 227. Then at some point tip 280 of the link 269 clears the stop member 231, thereby allowing the wheel 250 of the wheel assembly 227 to rotate in the counterclockwise direction. Then at some point the offset mass 243 would pass clear the tip 281 of the link 265, allowing the preloaded tensile spring 277 to turn the link 265 back to its initial position, as the prong 277 of the link 169 comes to a stop against the side 274 of the guide 273. At this point, the release mechanism 270 is in its initial positioning of FIG. 25. Now if the aforementioned acceleration in the direction of the arrow 242 (and of the indicated magnitude) persists, then similar to the wheel 233 of the wheel assembly 226, the wheel member 250 is rotationally accelerated in the counterclockwise direction until its offset mass 251 reaches the position shown by dashed lines in FIG. 25 for the release mechanism 253 (but for the release mechanism between the wheel assemblies 227 and 228), and would sequentially release the wheel 252 of the wheel assembly 228 an other additional wheel assemblies that might be provided to the inertial mechanical delay mechanism embodiment of FIG. 21.

It is appreciated that once the applied acceleration in the direction of the arrow 242 has ceased, the wheel members of the activated wheel assembly units begin to be rotated back in the clockwise direction by the preloaded torsion springs, for example, the activated wheel member 233 of the wheel assembly 226 begins to be rotated back in the clockwise direction as viewed in FIG. 22 by the torsion spring 237.

Then as some point, the offset mass 243 of the wheel member 233 engages the bottom surface of the tip 281 of the link 265 as viewed in FIG. 25 and comes to a stop against the tip 281 and cannot rotate any further in the clockwise direction towards its initial positioning of FIG. 21. The stop member 231 of the wheel member 250 would similarly comes to a stop against the bottom surface of the tip 280 of the link 269 as viewed in FIG. 25 as it rotates in the clockwise direction towards its initial positioning of FIG. 21. All other activated wheel members of provided wheel assemblies would also not be able to reset. As a result, the inertial mechanical delay mechanism embodiment 230 of FIG. 21 that uses the release mechanism 270 of FIG. 25 becomes un-resettable.

In the above description of the release mechanism 270 of FIG. 25, the release mechanisms 270 were considered to be used between all wheel assembly units of the inertial mechanical delay mechanism 230 of FIG. 21. It is, however, appreciated that in certain applications, when the applied acceleration of a given magnitude in the direction of the arrow 242 is of relatively short duration and only causes the first few wheel assembly units to be activated, then it inertial mechanical delay mechanism may be desired to be resettable. For example, if in the inertial mechanical delay mechanism 230 of FIG. 17 only the wheel assemblies 226 and 227 have been activated by the applied acceleration and the wheel assembly unit 228 has not been activated, then the two activated wheel assemblies may be desired to be resettable. In such cases, a resettable release mechanism such as the release mechanism 253 of FIG. 24 may be used between the wheel assemblies 226 and 227 and the release mechanism 270 of FIG. 25 between the wheel assemblies 227 and 228. Then the resulting inertial mechanical delay mechanism 230 of FIG. 21 becomes un-resettable only if the applied acceleration in the direction of the arrow 242 has activated all three "wheel assembly" units of the delay mechanism.

It is appreciated by those skilled in the art that since the range of counterclockwise rotation of the wheel members of the wheel assembly units of the inertial mechanical delay mechanism embodiment 230 of FIG. 17 is limited to less than 180 degrees for delay time generation, therefore to increase the delay time of a wheel assembly unit for a given acceleration magnitude in the direction of the arrow 242 and preloading and spring rate of its wheel member torsional spring, the moment of inertia of the wheel member of the unit has to be increased. This can obviously be achieved, for example, by increasing the diameter of the wheel and/or increasing the thickness of the wheel and/or constructing the wheel with higher density materials. The first of these two options would increase the size of the resulting inertial mechanical delay mechanism and the third option would increase its cost. Another method of increasing the moment inertia of the wheel member is to provide a "flywheel" and transmit the wheel member rotation to it via speed increasing gearing. Such an arrangement is shown in the schematic of FIG. 26.

Figure 26:
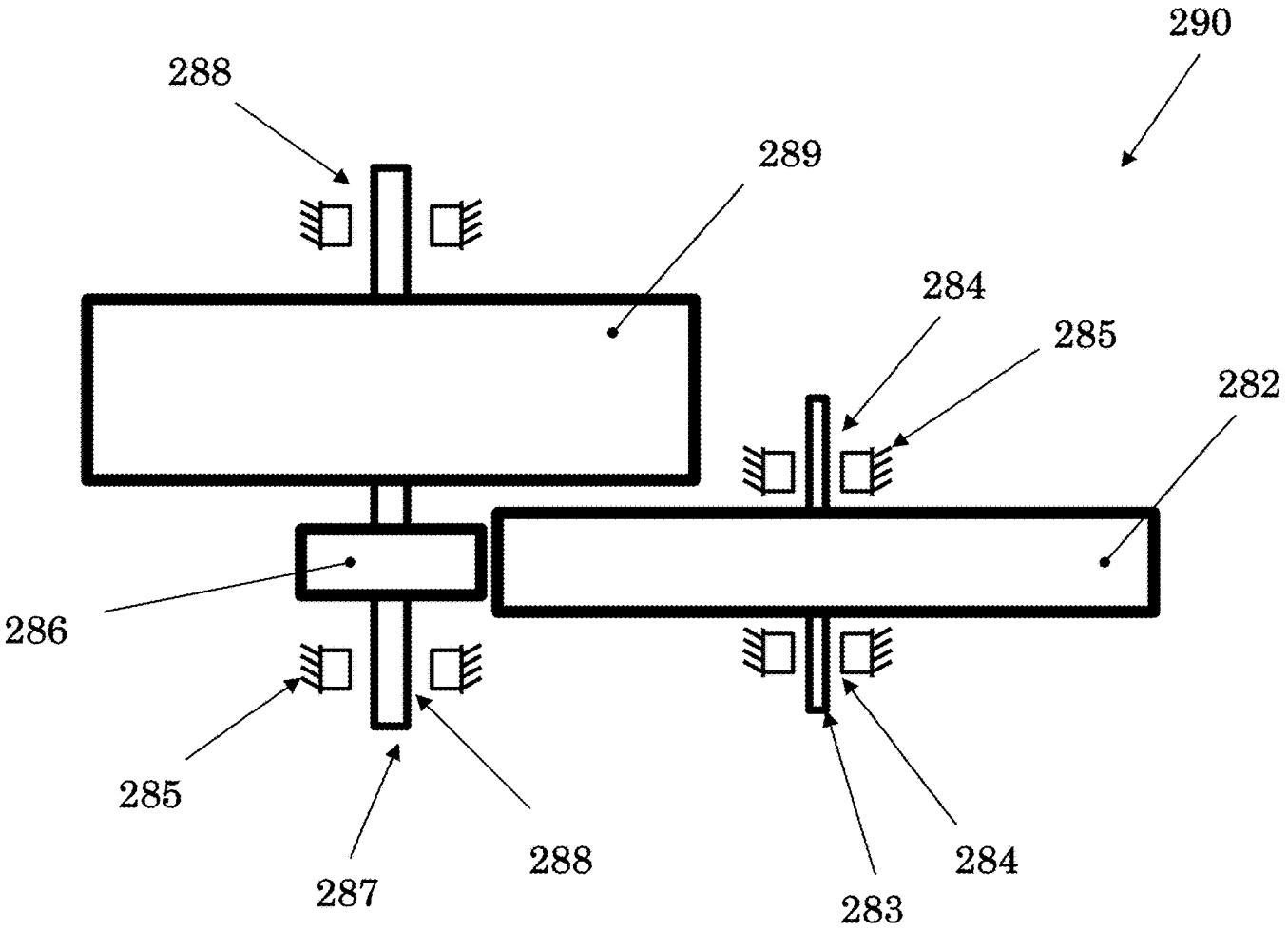
FIG. 26 illustrates a wheel member of a wheel assembly of the inertial mechanical delay mechanism embodiment of FIG. 21 that is provided with a geared flywheel to significantly increase the moment of inertia of the unit to increase the provided delay time.

FIG. 26 illustrates the top view of a wheel member 282 (e.g., the wheel member 233) of a wheel assembly unit of an inertial mechanical delay mechanism of the type of embodiment 230 of FIG. 21, without any other elements of the wheel member and delay mechanism being shown. Similar to the wheel members of the embodiment 230, the wheel member 282 is attached to the base structure 285 of the delay mechanism via the rotary joint with the shaft 283 and bearings 284. The wheel member 282 is constructed with outer gearing teeth (not shown) that engages the pinion 286. The pinion 286 is fixedly mounted on the shaft 287, which is free to rotate in the bearings 288, which are also fixedly attached to the base structure 285 of the delay mechanism. A flywheel 289 is also fixedly mounted on the shaft 287 as can be seen in FIG. 26.

It is appreciated that by selecting a high gear ration between the gear 282 and the pinion 286, the effective moment of inertia of the "geared wheel member" 290 of FIG. 26 is increased by the square of the gear ration. For example, if the moment of inertia of the flywheel 289 is I and the gear ratio is N, then the moment of inertia of the wheel member 282 is increased by the amount of $IN^2$.

It is appreciated that by those skilled in the art that in the process of activation of the wheel assembly units 226, 227 and 228 of the inertial mechanical delay mechanism embodiment 230 of FIG. 21, the three wheel members of the assembly units are considered to be identical except for the stop members 231 and 232 of the wheel assembly units 227 and 228. However, each unit may be configured with different geometrical, inertial and torsion spring rate and preloading level, etc., so that they would respond differently to different acceleration magnitudes and durations. For example, the first wheel assembly units 226 may be configured with small offset mass but high moment of inertia and with high torsion spring 237 preload so that it would begin its counterclockwise rotation at a high magnitude of acceleration in the direction of the arrow 242 and rotates counterclockwise slowly before it activates the second wheel assembly 227.

It is appreciated by those skilled in the art that the inertial mechanical delay mechanism embodiment 230 of FIG. 21 may be provide with more or fewer wheel assemblies. It is also appreciated that by increasing the number of properly configured wheel assembly units, the delay time of the mechanism can be increased to the desired level.

It is also noted that in the inertial mechanical delay mechanism of the embodiment 230 of FIG. 21, the wheel members of the wheel assemblies may have a common shaft on which the individual wheel members are mounted by ball or other type of bearings that allow their independent rotation. The common shaft can then be fixedly attached to the base structure of the inertial mechanical delay mechanism (234 in FIG. 21).

It is also noted that in the inertial mechanical delay mechanism of the embodiment 230 of FIG. 21, many different arrangements of the wheel assembly units is possible, as long as they can be sequentially activated when the delay mechanism is subjected to the prescribed activation acceleration profile in the direction of the arrow 242. For example, the shafts of the wheel members of the wheel assemblies be parallel to each other or make certain irregular angles relative to each other, similar to the embodiments of FIGS. 8 and 7, respectively. The wheel members may also be different in size and moment of inertia to achieve different speeds and thereby different delay times.

It is also appreciated that as it was previously indicated, it is highly desirable for any novel miniature inertial mechanical delay mechanism that is used directly the development of mechanical inertial igniters and other similar devices to be capable of satisfying no activation requirements that may be experienced upon drops or other events that may subject the device to very high-G accelerations as compare to the prescribed activation acceleration magnitude threshold with relatively long durations, for example high-G acceleration levels that may be as high as 5000-10000 G and even higher in magnitude with durations that may be as long as 1-3 msec and sometimes more. It is also appreciated that following such drops, the device (e.g., inertial igniter for the case of munitions) may be required to be operational and activate when subjected to the prescribed (lower G) and (longer) duration acceleration thresholds (all-fire condition in munitions). Alternatively, following such drops, the device may be required to become inert, i.e., become incapable of being activated when subjected to any acceleration event, including the prescribed acceleration and duration thresholds. Such configurations of inertial mechanical delay mechanisms, examples of which were illustrated by their application to the inertial mechanical delay mechanism embodiment 10 of FIG. 6A, may also be applied to the inertial mechanical delay mechanism embodiment 230 of FIG. 21 as described below.

Figure 27B:
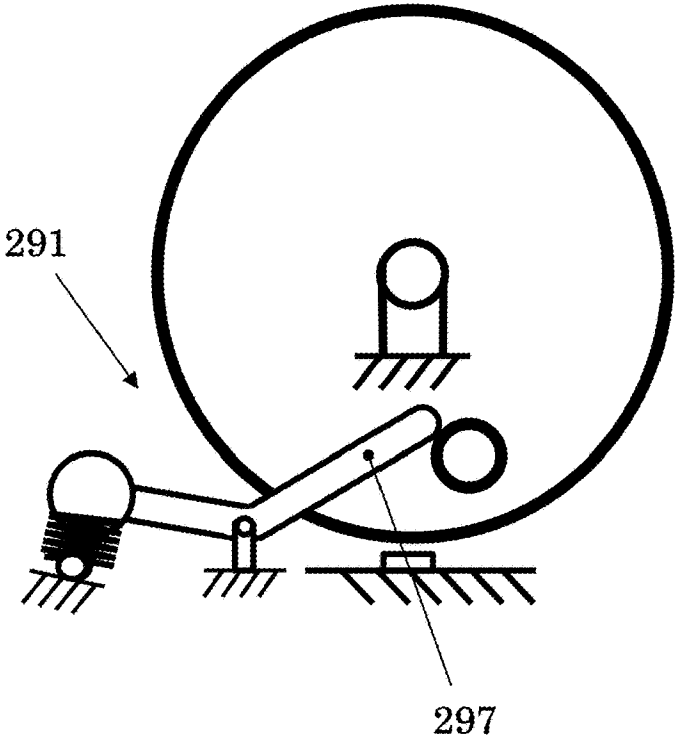
FIG. 27B illustrates the schematic of the activation prevention mechanism of FIG. 27A in its activated state.
Figure 27A:
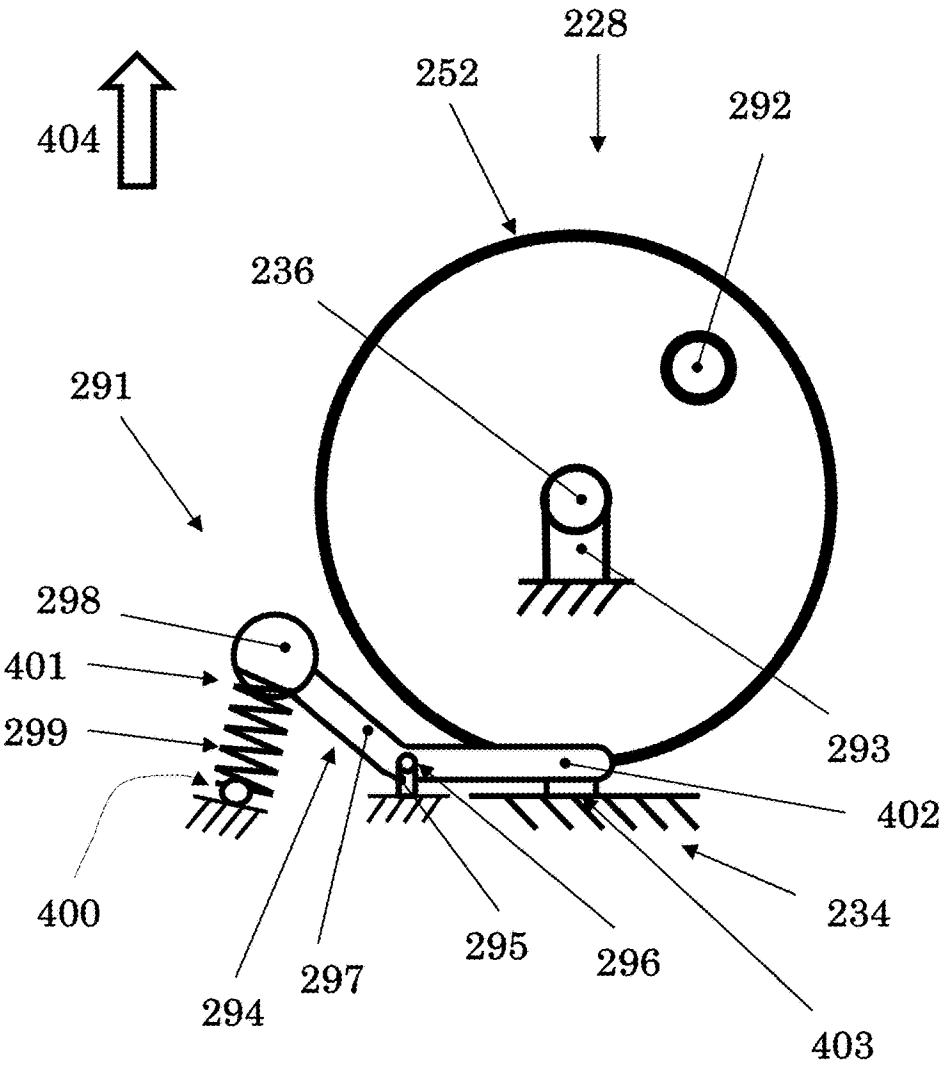
FIG. 27A illustrates the schematic of an example of an activation prevention mechanism for preventing activation of the inertial mechanical delay mechanism of FIG. 21 when subjected to relatively high G accidental acceleration events in its pre-activation state.

In this example of the application of the above novel methods to the inertial mechanical delay mechanism embodiment 230 of FIG. 21, the "high G activation prevention mechanism" 125 of FIG. 14 is adapted to provide the delay mechanism embodiment 230 with high G activation prevention capability while rendering the delay mechanism resettable. In FIG. 27A the frontal view "BB" of one of the wheel members of the inertial mechanical delay mechanism embodiment 230 of FIG. 21 is shown with the provided "high G activation prevention mechanism", which is indicated by the numeral 291.

In FIG. 27A, the frontal view "BB" of the wheel assembly unit 228 of the inertial mechanical delay mechanism embodiment 230 of FIG. 21 is shown together with the "high G activation prevention mechanism" 291 (125 in FIG. 14) in the rest positioning of the inertial mechanical delay mechanism. In the schematic FIG. 27A, the wheel member 252 of the wheel assembly unit 228, which as it was described for the embodiment 230 of FIG. 21, is attached to the inertial mechanical delay mechanism base structure 234 by the rotary joint 236 in the support structure 293. The wheel assembly unit 228 is also similarly provided with the preloaded torsion spring 237 (not seen in the view "BB" of FIG. 27A), which biases the wheel member 252 against the provided stop (240 in FIG. 22—not seen in FIG. 27A).

In the schematic of FIG. 27A and similar to the mechanism 125 of FIG. 14, the "high G activation prevention mechanism" 291 is shown to consist of an "V" shaped link member 294, which is attached to the support member 295 by the rotary joint 296. The support member 295 is fixedly attached to the inertial mechanical delay mechanism base structure 234. The branch 297 of the "V" shaped link member 294 is provided with the mass member 298 to shift the center of mass of the link 294 to the left of the joint 295 as viewed in the plane of the FIG. 27A. A preloaded compressive spring 299, which is attached to the inertial mechanical delay mechanism base structure 234 on one end 400 and on the other end 401 to the "V" shaped link member 294 (via the branch 297 or the mass member 298), is used to bias the branch 402 of the link member 294 against the stop 403 as shown in the configuration of the FIG. 27A, i.e., when the inertial mechanical delay mechanism is at rest.

When the inertial mechanical delay mechanism embodiment 230 of FIG. 21 that is provided with at least one "high G activation prevention mechanism" 291 is subjected to acceleration in the direction of the arrow 404, the acceleration acts on the center of mass of the "V" shaped link member 294, which is located on the left side of the joint 296, applying a counterclockwise torque to the link member 294, which would tend to rotate it in the counterclockwise direction.

In general, inertial mechanical delay mechanisms, such as the embodiment 230 of FIG. 21, are configured with "high G activation prevention mechanisms" 291 in which the preloading level of their preloaded compressive springs are selected such that they would counter the aforementioned applied counterclockwise torque for accelerations that are at or below the prescribed delay mechanism activation acceleration magnitude threshold.

However, if the inertial mechanical delay mechanism embodiment 230 of FIG. 21 that is provided with at least one "high G activation prevention mechanism" 291 is subjected to an acceleration in the direction of the arrow 404 which has a magnitude that is larger than the prescribed activation acceleration magnitude threshold ("relatively high G acceleration"), the previously indicated generated counterclockwise toque that is applied to the "V" shaped link member 294 would overcome the clockwise torque of the preloaded compressive spring 299, causing the link member 294 to begin to be rotated in the counterclockwise direction.

It is appreciated that in the resting positioning of the inertial mechanical delay mechanism embodiment 230 of FIG. 21, the branch 402 of the "V" shaped link member 294 is positioned slightly in front of the surface of the wheel member 252 of the wheel assembly unit 228. As a result, if the applied "relatively high G acceleration" in the direction of the arrow 242 persists long enough and/or the magnitude of the applied "relatively high G acceleration" is high enough, the "V" shaped link member 294 will continue its counterclockwise rotation and bring the front portion 402 of the "V" shaped link member 294 in in the path of the offset mass 292 of the wheel member 252 of the wheel assembly unit 228 as the wheel member 252 rotates in the clockwise direction due to the acceleration in the direction of the arrow 404 as seen in FIG. 27A. Then at some point, the clockwise rotation of the wheel member 252 is blocked by the offset mass 292 as can be seen in FIG. 27B. As a result, by blocking the rotation of the wheel member 252 before its offset mass reaches the provided release mechanism (e.g., the release mechanism 249 in FIG. 21), the next wheel assembly unit would not be activated.

It is appreciated that in general, a stop member (not shown) may be provided to limit the counterclockwise rotation of the "V" shaped link member 294.

It is appreciated that full activation of those wheel assembly units that have not yet been activated would also be similarly blocked by the provided "high G activation prevention mechanisms" 291. For example in the inertial mechanical delay mechanism embodiment 230 of FIG. 21, which is provided with a total of three wheel assembly units, depending on the magnitude and duration of the high G acceleration in the direction of the arrow 242, since there is a delay between the activation of the second wheel assembly unit 227 relative to the activation of the first wheel assembly 226, and similarly there is even a longer delay between the activation of the third wheel assembly unit 228 relative to the activation of the first wheel assembly 226, the "high G activation prevention mechanisms" 291 can always be configured to have enough time to at least prevent activation of one of the wheel assembly units. The provision of the "high G activation prevention mechanisms" 291 would therefore provide the inertial mechanical delay mechanism embodiment 230 of FIG. 21 with the capability of avoiding full activation when the applied acceleration in the intended direction of their operation is higher than their prescribed acceleration magnitude threshold, even if the duration of the applied high G acceleration is longer than the prescribed acceleration threshold duration.

It is appreciated that once the high G acceleration has ceased, the "V" shaped link member 294 of the "high G activation prevention mechanisms" 291 is rotated in the clockwise direction by the preloaded compressive spring 299 and is brought back to its initial positioning shown in the schematic of FIG. 27A. All activated wheel assembly units would also return to their initial positioning shown in FIG. 21.

It is appreciated that the "high G activation prevention mechanism" 291 of FIG. 27A is configured to reset, i.e., return to their initial positions shown once the applied relatively high G acceleration event has ceased. However, in certain applications, particularly if the experienced high G acceleration could have damaged the device in which the inertial mechanical delay mechanism is mounted, the inertial mechanical delay mechanism and the device(s) that it is used to operate may be desired to be rendered non-operative. In such applications, the "high G activation prevention mechanism" of FIG. 27A needs to be configured to be non-resettable, i.e., stay in the configuration of FIG. 27B, and continue to block at least one of the wheel members of the wheel assembly units from resetting.

It is appreciated that a method for preventing resetting of an inertial mechanical delay mechanism once it has been subjected to a relatively high G acceleration event was previously described for the "high G activation prevention mechanisms" 109 or 125 of FIGS. 12 and 14, respectively, as based on "locking" the deployed members of the "high G activation prevention mechanisms" that block at least one of the beam elements of the rotary beam assembly units of the delay mechanism, such as the members 114 and 130 of the "high G activation prevention mechanisms" 109 and 125 of FIGS. 12 and 14, respectively. The same method and mechanisms may also be used to "lock" the deployed member 297 of the "high G activation prevention mechanisms" 291 in its deployed position shown in FIG. 27B, thereby preventing the inertial mechanical delay mechanism embodiment 230 of FIG. 21 from resetting following subjection to a previously described relatively high G acceleration event.

It is appreciated that in the case of the "high G activation prevention mechanisms" 291, FIG. 27B, the cross-section 142 and 152 in FIGS. 16A and 16B, respectively, would indicate the cross-sectional views of the 297 branch of the "V" shaped link member 294, FIGS. 27A and 27B.

As it was previously indicated, the disclosed fully mechanical inertial delay mechanisms can be used in various devices, including "low G and long duration impulse switches" and inertial igniters for munitions that can satisfy the prescribed no-fire requirements while satisfying relatively low all-fire setback acceleration levels and long duration requirements. For initiation of percussion primer or other provided pyrotechnic materials, the inertial igniters would rely on potential energy stored in a spring (elastic) element, which is then released upon the detection of the prescribed all-fire conditions by the inertial mechanical delay mechanism of the device. These methods are particularly suitable for use in munitions that are subjected to very low setback accelerations with very long durations, particularly in the presence of available space constraints.

Figure 28:
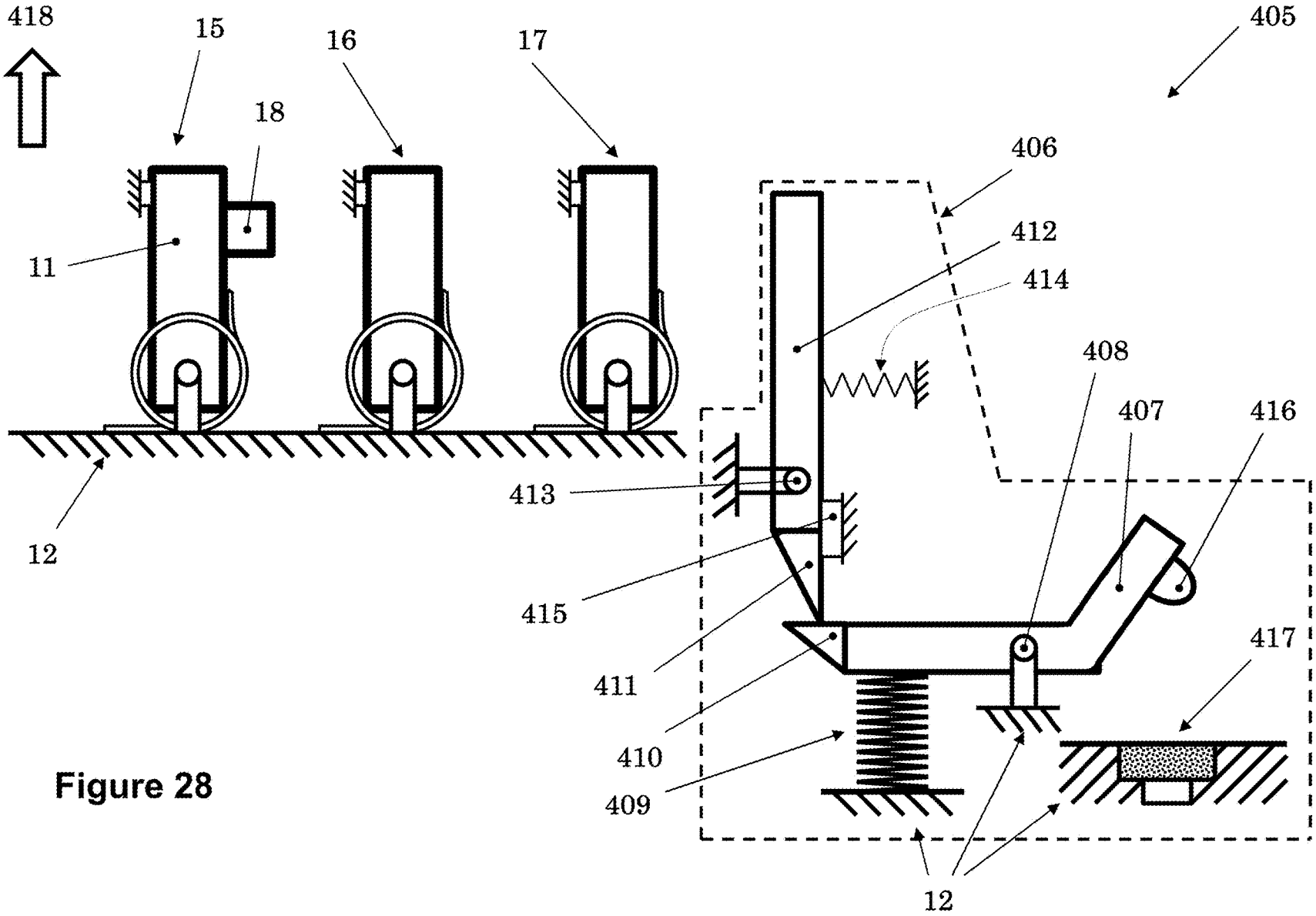
FIG. 28 illustrates the schematic of the first inertial igniter embodiment developed using the inertial mechanical delay mechanism embodiment of FIG. 6A for low setback accelerations with long durations.

The first inertial igniter embodiment 405, which uses the inertial mechanical delay mechanism embodiment 10 of FIG. 6A to provide the required acceleration duration is shown in FIG. 28. It is appreciated that the inertial mechanical delay mechanisms 48 and 60 of FIGS. 7, 8 and 10, respectively, can be similarly used for the construction of similar inertial igniters and such inertial igniters will therefore not be further described.

As can be seen in the schematic of FIG. 28, the inertial igniter 405 is constructed with the inertial mechanical delay mechanism 10 of FIG. 6A, consisting of the beam element assemblies 15, 16 and 17, and the addition of the igniter mechanism component with its potential energy storage and release mechanism shown as enclosed within the space defined by the dotted lines and indicated by the numeral 406.

The igniter mechanism component 406 of the inertial igniter 405 is provided with a striker mass member 407, which is attached to the inertial igniter body 12 (the base structure of the inertial mechanical delay mechanism) by the rotary joint 408. The striker mass member 407 is also provided with a preloaded compressive spring 409, which biases it to keep its tip 410 against the tip 411 of the striker mass release member 412 as shown in FIG. 28. The striker mass release member 412 is also attached to the inertial igniter body 12 by the rotary joint 413, and is provided with a preloaded compressive spring 414, which bias it against the stop 415 on the inertial igniter body 12 as shown in the configuration of FIG. 28. The striker mass member 407 is also provided with a sharp tip 416, which is configured to initiate the percussion primer 417 (or other appropriate pyrotechnic material) upon impact as described later. The percussion primer 417 is properly mounted in the base structure 12 of the inertial igniter.

It is appreciated that in the schematic of FIG. 28, the inertial igniter 405 is shown in its pre-activation (also indicated as initial, rest position or configuration) with the inertial mechanical delay mechanism component rotary beam assembly units 15, 16 and 17 in the rest configuration shown in FIG. 6A.

The inertial igniter embodiment 405 of FIG. 28 operates as follows. In the schematic of FIG. 28, the inertial igniter 405 is shown in its pre-initiation state. Now if the device to which the inertial igniter 405 is attached (for example a rocket or a missile) is accelerated in the direction of the arrow 418, if the acceleration is above the prescribed firing acceleration threshold, the dynamic force generated by the acceleration acting on the inertia of the offset mass 18 of the first rotary beam assembly 15 and as it was described for the embodiment 10 of FIG. 6A, if the acceleration in the direction of the arrow 418 is high enough to overcome the preloading torque of the spring 19, FIG. 6A, then the beam element 11 would begin to rotate in the clockwise direction.

Then, if the magnitude of the acceleration in the direction of the arrow 418 is high enough and its duration is long enough, then as it was described previously for the inertial igniter embodiment 10, the beam element 11 is rotationally accelerated in the clockwise direction until it strikes the beam element of the second rotary beam assembly 16, FIG. 6B, and eventually causing the beam element of the beam assembly 16 to sequentially cause clockwise rotation of the beam element of the rotary beam assembly 17 and any other provided rotary beam assemblies.

Now if the magnitude of the acceleration in the direction of the arrow 418 becomes relatively low and/or its duration is relatively short, then the activated rotary beam assemblies would return to their starting position shown in FIG. 28.

Figure 29:
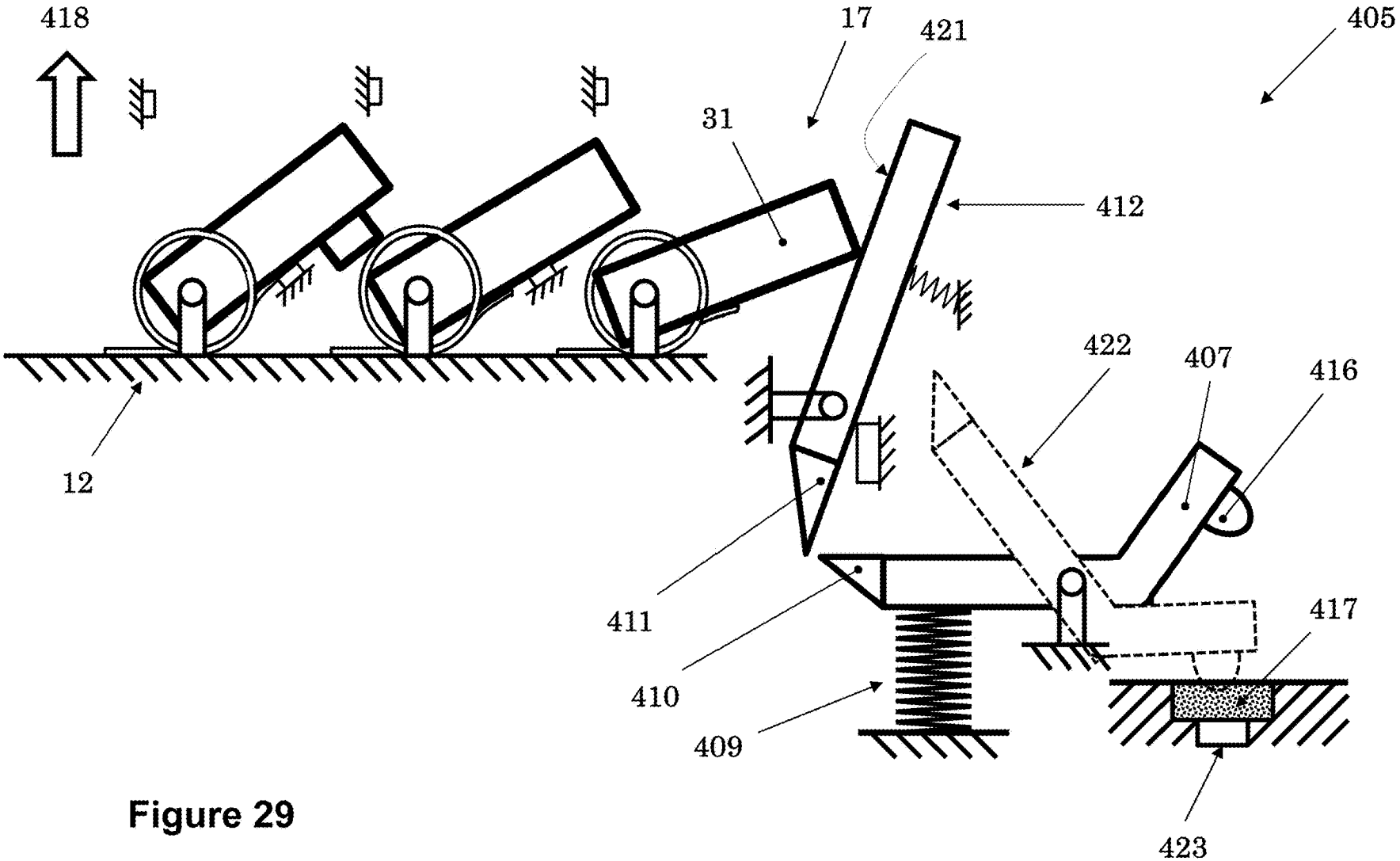
FIG. 29 illustrates the schematic of the first inertial igniter embodiment of FIG. 28 after initiation due to a prescribed acceleration magnitude threshold for a prescribed minimum duration.

However, if the magnitude of the acceleration in the direction of the arrow 418 is high enough and its duration is long enough, the rotary beam assembly 17, being the last rotary beam assembly of the delay mechanism as shown in FIG. 6D, it is used to actuate the release mechanism of the igniter mechanism component 406 of the inertial igniter 405 as can be seen in the schematic of FIG. 29. As can be seen in FIG. 29, the beam member 31 of the rotary beam assembly 17, as it rotates in the clockwise direction due to the acceleration in the direction of the arrow 418, it engages the side 421 of the striker mass release member 412 and forces it to rotate in the clockwise direction as viewed in the schematic of FIG. 29, which causes the tip 411 of the striker mass release member 412 to slide passed the surface of the tip 410 of the striker mass member 407 as shown in FIG. 29. The striker mass member 407 is thereby released and the preloaded compressive spring 409 begins to rotationally accelerate the striker mass member 407 in the clockwise direction. The preloaded compressive spring 409 is configured to accelerate the striker mass member 407 to the required kinetic energy for its ignition pin 416 to initiate the provided percussion primer 417 upon impact as shown by dashed lines in FIG. 29 and indicated by the numeral 422. The generated ignition flame and sparks would then exit from the provided opening 423 to perform its intended function, for example to enter a thermal battery and activate the battery by igniting the battery pyrotechnic pallets.

It is also appreciated that as it was previously indicated, it is highly desirable for any novel miniature inertial mechanical delay mechanism that is used directly for the development of mechanical inertial igniters and other similar devices to be capable of satisfying no activation requirements that may be experienced upon drops or other events that may subject the device to very high-G accelerations as compare to the prescribed activation acceleration magnitude threshold with relatively long durations, for example high-G acceleration levels that may be as high as 5000-10000 G and even higher in magnitude with durations that may be as long as 1-3 msec and sometimes more. It is also appreciated that following such drops, the device (e.g., inertial igniter for the case of munitions) may be required to be operational and activate when subjected to the prescribed (lower G) and (longer) duration acceleration thresholds (all-fire condition in munitions). Alternatively, following such drops, the device may be required to become inert, i.e., become incapable of being activated when subjected to any acceleration event, including the prescribed acceleration and duration thresholds.

It is appreciated by those skilled in the art that the inertial mechanical delay mechanism embodiment 10 of FIG. 6A and their implementation as the "high G activation prevention mechanism" embodiments of FIGS. 12 and 14 (high G activation prevention mechanism embodiments 109 and 125 of FIGS. 12 and 14, respectively) are readily applied to the inertial mechanical delay mechanism component of the inertial igniter embodiment 405 of FIG. 28. In the resulting "inertial igniter with high G activation prevention mechanism", at least one of the rotary beam assembly units of the inertial mechanical delay mechanism component of the inertial igniter is prevented from activation when subjected to such aforementioned relatively high G acceleration events in the direction of the arrow 418, thereby preventing the inertial igniter from being initiated.

It is appreciated that the "high G activation prevention mechanisms" 109 and 125 of FIGS. 12 and 14, respectively, are configured to reset, i.e., return to their initial positions shown once the applied relatively high G acceleration event has ceased, thereby also allowing the inertial igniter 405 of FIG. 28 to reset. However, in certain applications, particularly if the experienced high G acceleration could have damaged the device in which the inertial mechanical delay mechanism is mounted, the inertial igniter 405 or other devices using the inertial mechanical delay mechanism 10 of FIG. 6A may be desired to be rendered non-operative, i.e., be non-resettable. In such applications, the "high G activation prevention mechanisms" 109 and 125 of FIGS. 12 and 14, respectively, need to be non-resettable, i.e., stay in the configurations of FIGS. 13 and 15, respectively, and continue to block rotation of at least one of the beam elements of the rotary beam assembly units of the inertial mechanical delay mechanism component of the inertial igniter.

It is appreciated by those skilled in the art that the method of preventing resetting of the "high G activation prevention mechanisms" 109 or 125 of FIGS. 12 and 14, respectively, i.e., "locking" the deployed members of the "high G activation prevention mechanisms" that block at least one of the beam elements of the rotary beam assembly units of the delay mechanism, such as the members 114 and 130 of the "high G activation prevention mechanisms" 109 and 125 of FIGS. 12 and 14, respectively, may also be employed in the inertial mechanical delay mechanism component of the inertial igniter embodiment 405 of FIG. 28. As a result, the inertial mechanical delay mechanism component of the inertial igniter, thereby the inertial igniter embodiment 405 of FIG. 28 becomes inoperative when subjected to the any acceleration event in the direction of the arrow 418, FIG. 28, even if the acceleration satisfies the prescribed minimum magnitude and duration requirement (all-fire condition in munitions).

It is appreciated by those skilled in the art that the fully mechanical inertial delay mechanism embodiment 160 of FIG. 17 may also be used to construct various devices, including "low G and long duration impulse switches" and inertial igniters for munitions that can satisfy the prescribed no-fire requirements while satisfying relatively low all-fire setback acceleration levels and long duration requirements. For initiation of percussion primer or other provided pyrotechnic materials, the inertial igniters would also rely on potential energy stored in a spring (clastic) element, which is then released upon the detection of the prescribed all-fire conditions by the inertial mechanical delay mechanism of the device. These methods are particularly suitable for use in munitions that are subjected to very low setback accelerations with very long durations, particularly in the presence of available space constraints.

Figure 30:
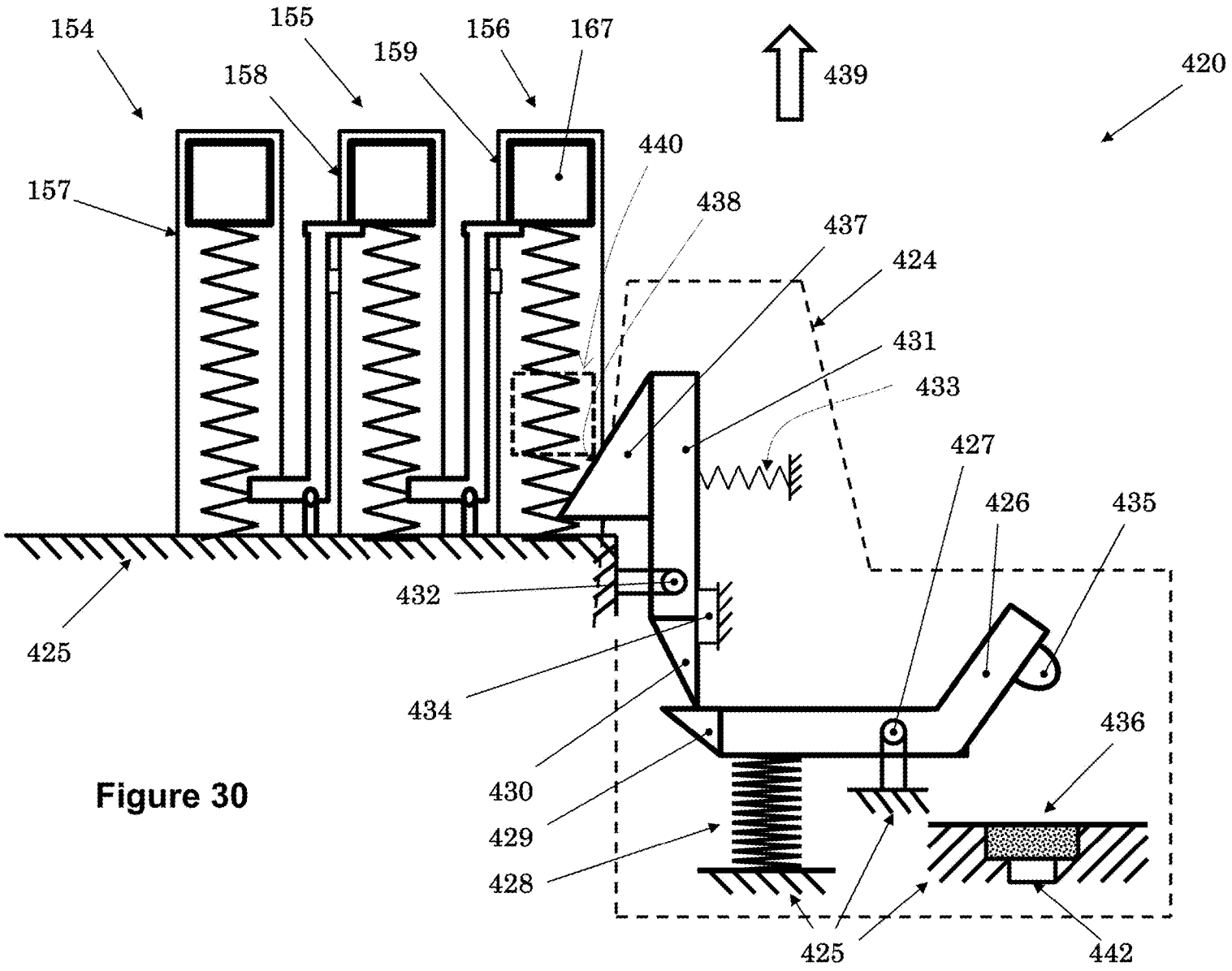
FIG. 30 illustrates the schematic of the second inertial igniter embodiment developed using the inertial mechanical delay mechanism embodiment of FIG. 17 for low setback accelerations with long durations in its pre-activation state.

The second inertial igniter embodiment 420, which uses the inertial mechanical delay mechanism embodiment 160 of FIG. 17 to provide the required acceleration duration is shown in FIG. 30.

As can be seen in the schematic of FIG. 30, the inertial igniter 420 is constructed with the inertial mechanical delay mechanism 160 of FIG. 17, consisting of three "sliding mass-spring assemblies" 154, 155 and 156, and the addition of the igniter mechanism component with its potential energy storage and release mechanism shown as enclosed within the space defined by the dotted lines and indicated by the numeral 424. The "sliding mass-spring assemblies" are fixedly attached by their relatively rigid housings 157, 158 and 159, respectively, to the base structure of the inertial igniter 425.

The igniter mechanism component 424 of the inertial igniter 420 is provided with a striker mass member 426, which is attached to the inertial igniter body 425 (the base structure of the inertial mechanical delay mechanism) by the rotary joint 427. The striker mass member 426 is also provided with a preloaded compressive spring 428, which biases it to keep its tip 429 against the tip 430 of the striker mass release member 431 as shown in FIG. 28. The striker mass release member 431 is also attached to the inertial igniter body 425 by the rotary joint 432, and is provided with a preloaded compressive spring 433, which bias it against the stop 434 on the inertial igniter body 425 as shown in the configuration of FIG. 28. The striker mass release member 431 is also provided with the extended member 437, which has a sloped edge 438 for engagement with the mass member 167 of the delay mechanism to initiate the inertial igniter as is described later.

The striker mass member 426 is also provided with a sharp tip 435, which is configured to initiate the percussion primer 436 (or other appropriate pyrotechnic material) upon impact as described later. The percussion primer 436 is properly mounted in the base structure 425 of the inertial igniter.

Now if the inertial igniter embodiment 420 of FIG. 30 is subjected to an acceleration in the direction of the arrow 439 which is at or above the prescribed operational magnitude and duration threshold for the delay mechanism (i.e., the inertial mechanical delay mechanism embodiment 160 of FIG. 17) of the inertial igniter 420, then the "sliding mass-spring assembly" units 154, 155 and 156 would sequentially activate as was previously described for the inertial mechanical delay mechanism embodiment 160. Then as the mass member 167 of the last "sliding mass-spring assembly" unit 156 moves down, at some point it engages the sloped edge 438 of the extended member 437 of the striker mass release member 431 (shown in dashed lines and indicated by the numeral 440) and forces the striker mass release member 431 to begin to rotate in the clockwise direction as viewed in FIG. 30.

Figure 31:
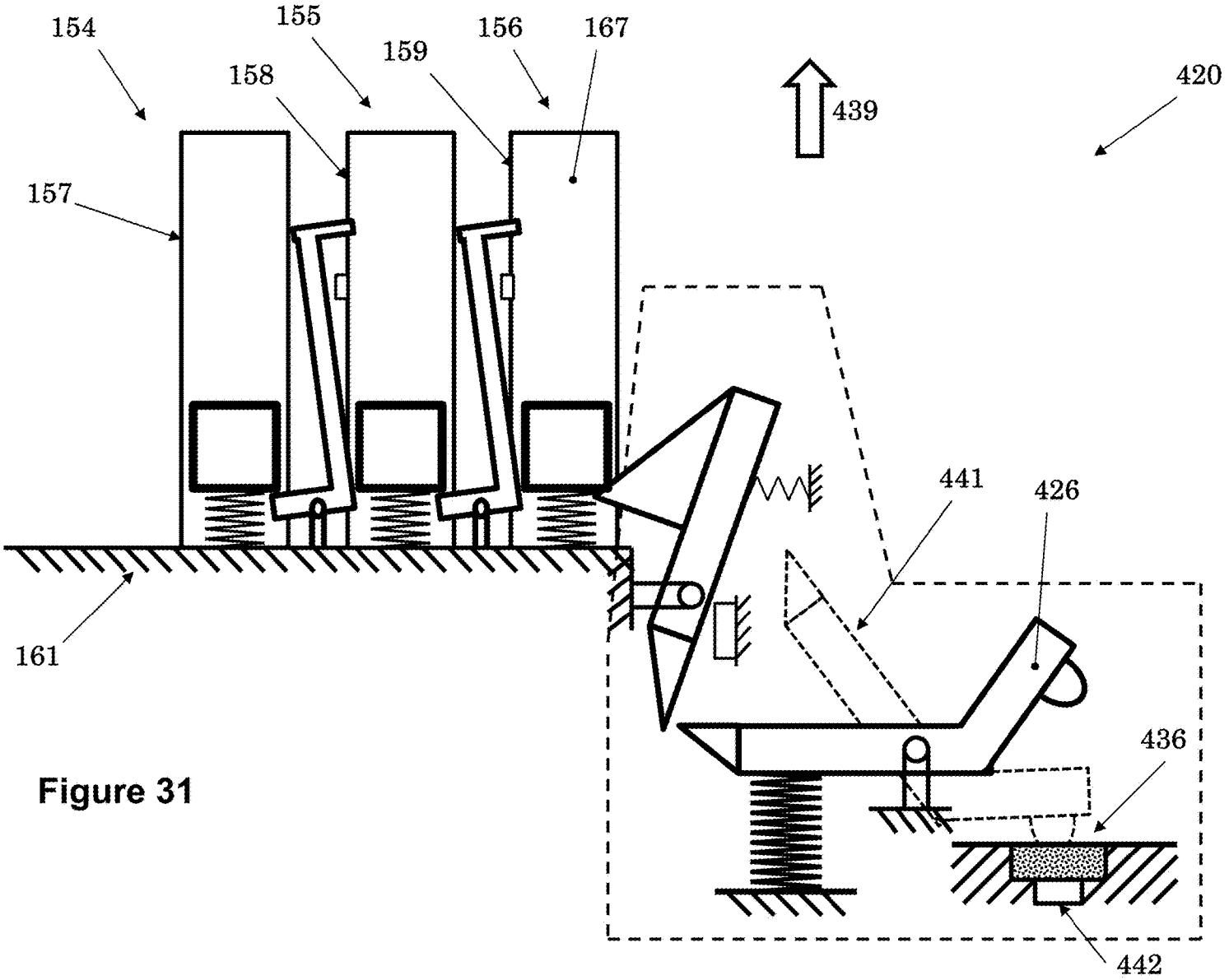
FIG. 31 illustrates the schematic of the inertial igniter embodiment of FIG. 30 developed using the inertial mechanical delay mechanism embodiment of FIG. 17 for low setback accelerations with long durations in its activated state.

Then if the prescribed acceleration in the direction of the arrow 439 persists, the mass member 167 of the last "sliding mass-spring assembly" unit 156 continues to move down and would eventually displace the extended member 437 of the striker mass release member 431 and thereby rotate the striker mass release member 431 in the clockwise direction enough to cause the tip 430 of the striker mass release member 431 to slide passed the surface of the tip 429 of the striker mass member 426 as shown in FIG. 31.

The striker mass member 426 is thereby released and the preloaded compressive spring 428 begins to rotationally accelerate the striker mass member 426 in the clockwise direction. The preloaded compressive spring 428 is configured to accelerate the striker mass member 426 to the required kinetic energy for its ignition pin 435 to initiate the provided percussion primer 436 upon impact as shown by dashed lines in FIG. 31 and indicated by the numeral 441. The generated ignition flame and sparks would then exit from the provided opening 442 to perform its intended function, for example to enter a thermal battery and activate the battery by igniting the battery pyrotechnic pallets.

It is appreciated that if the magnitude of the acceleration in the direction of the arrow 438 becomes relatively low and/or its duration is relatively short before the striker mass member 426 is released, then if the "Z" members (FIG. 17) of the delay mechanisms of the inertial igniter embodiment 420 of FIG. 30 are provided with the modifications shown in the schematic of FIG. 18A or 18B, then the activated sliding mass-spring assembly units would return to their starting position shown in FIG. 30.

It is also appreciated that as it was previously indicated, it is highly desirable for any novel miniature inertial mechanical delay mechanism that is used directly for the development of mechanical inertial igniters and other similar devices to be capable of satisfying no activation requirements that may be experienced upon drops or other events that may subject the device to very high-G accelerations as compare to the prescribed activation acceleration magnitude threshold with relatively long durations, for example high-G acceleration levels that may be as high as 5000-10000 G and even higher in magnitude with durations that may be as long as 1-3 msec and sometimes more. It is also appreciated that following such drops, the device (e.g., inertial igniter for the case of munitions) may be required to be operational and activate when subjected to the prescribed (lower G) and (longer) duration acceleration thresholds (all-fire condition in munitions). Alternatively, following such drops, the device may be required to become inert, i.e., become incapable of being activated when subjected to any acceleration event, including the prescribed acceleration and duration thresholds.

It is appreciated by those skilled in the art that the inertial mechanical delay mechanism embodiment 160 of FIG. 17 and their implementation as the "high G activation prevention mechanism" embodiments of FIGS. 19A, and 19B or in FIGS. 20A and 20B (high G activation prevention mechanism embodiments 200 and 211 of FIGS. 19A and 20A, respectively) can be readily applied to the inertial mechanical delay mechanism component of the inertial igniter embodiment 420 of FIG. 30. In the resulting "inertial igniters with high G activation prevention mechanism", at least one of the sliding mass-spring assembly units of the inertial mechanical delay mechanism component of the inertial igniter is prevented from activation when subjected to such aforementioned relatively high G acceleration events in the direction of the arrow 439, thereby preventing the inertial igniter from being initiated.

It is appreciated that the "high G activation prevention mechanisms" 200 and 211 of FIGS. 19A and 20A, respectively, are configured to reset, i.e., return to their initial positions shown once the applied relatively high G acceleration event has ceased, thereby also allowing the inertial igniter 420 of FIG. 30 to reset. However, in certain applications, particularly if the experienced high G acceleration could have damaged the device in which the inertial mechanical delay mechanism is mounted, the inertial igniter 420 or other devices using the inertial mechanical delay mechanism 160 of FIG. 17 may be desired to be rendered non-operative, i.e., be non-resettable. In such applications, the "high G activation prevention mechanisms" 200 and 211 of FIGS. 19A and 20A, respectively, need to be non-resettable, i.e., stay in the configurations of FIGS. 19B and 20B, respectively, and continue to block full displacement of the mass members of at least one of the "sliding mass-spring assembly" units of the inertial mechanical delay mechanism component of the inertial igniter.

It is appreciated by those skilled in the art that the method of preventing resetting of the "high G activation prevention mechanisms" 109 or 125 of FIGS. 12 and 14, respectively, i.e., "locking" the deployed members of the "high G activation prevention mechanisms" that block at least one of the beam elements of the rotary beam assembly units of the delay mechanism, such as the members 114 and 130 of the "high G activation prevention mechanisms" 109 and 125 of FIGS. 12 and 14, respectively, may also be employed in the inertial mechanical delay mechanism component of the inertial igniter embodiment 420 of FIG. 30. As a result, the inertial mechanical delay mechanism component of the inertial igniter, thereby the inertial igniter embodiment 420 of FIG. 30 becomes inoperative when subjected to the any acceleration event in the direction of the arrow 439, FIG. 30, even if the acceleration satisfies the prescribed minimum magnitude and duration requirement (all-fire condition in munitions).

It is appreciated that the "high G activation prevention mechanisms" 109 and 125 of FIGS. 12 and 14, respectively, are configured to reset, i.e., return to their initial positions shown once the applied relatively high G acceleration event has ceased, thereby also allowing the inertial igniter 420 of FIG. 30 to reset. However, in certain applications, particularly if the experienced high G acceleration could have damaged the device in which the inertial mechanical delay mechanism is mounted, in this case the inertial igniter 420, the inertial mechanical delay mechanism component of the inertial igniter, in this case the embodiment 160 of FIG. 17, may be desired to be rendered non-operative, i.e., be non-resettable. In such applications, the "high G activation prevention mechanisms" 109 and 125 of FIGS. 12 and 14, respectively, need to be non-resettable, i.e., stay in the configurations of FIGS. 13 and 15, respectively, and continue to block full displacement of at least one of the activated mass members of the sliding mass-spring assembly units of the inertial mechanical delay mechanism component of the inertial igniter.

It is appreciated by those skilled in the art that the method of preventing resetting of the "high G activation prevention mechanisms" 109 or 125 of FIGS. 12 and 14, respectively, i.e., "locking" the deployed members of the "high G activation prevention mechanisms" that block at least one of the beam elements of the rotary beam assembly units of the delay mechanism, such as the members 114 and 130 of the "high G activation prevention mechanisms" 109 and 125 of FIGS. 12 and 14, respectively, may also be employed in the inertial mechanical delay mechanism component of the inertial igniter embodiment 420 of FIG. 30. As a result, the inertial mechanical delay mechanism component of the inertial igniter, thereby the inertial igniter embodiment 420 of FIG. 30 becomes inoperative when subjected to the any acceleration event in the direction of the arrow 439, FIG. 30, even if the acceleration satisfies the prescribed minimum magnitude and duration requirement (all-fire condition in munitions).

Figure 32:
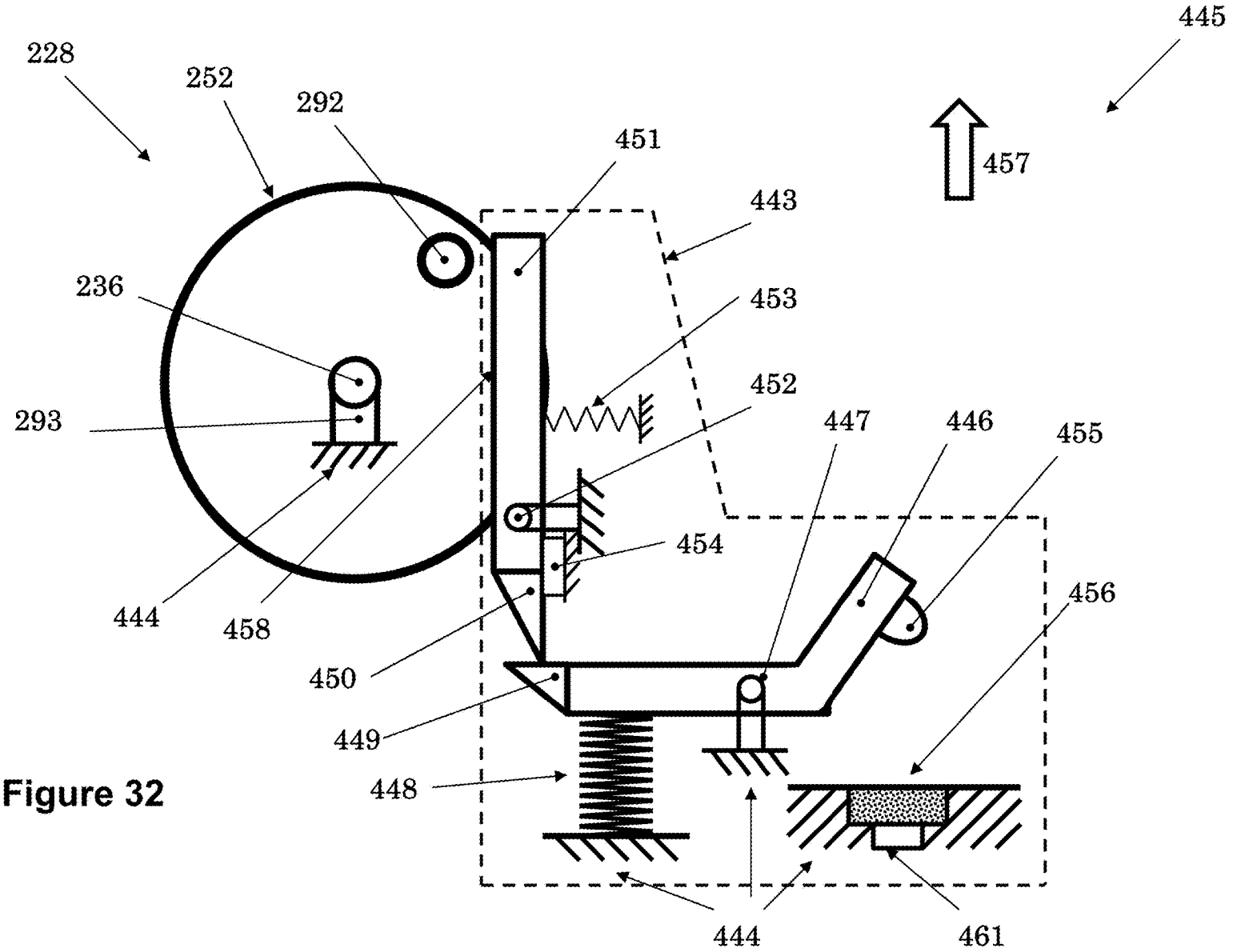
FIG. 32 illustrates the schematic of the third inertial igniter embodiment developed using the inertial mechanical delay mechanism embodiment of FIG. 21 for low setback accelerations with long durations in its pre-activation state.

The third inertial igniter embodiment 445, which uses the inertial mechanical delay mechanism embodiment 230 of FIG. 21 to provide the required acceleration duration for initiation is shown in FIG. 32.

As can be seen in the schematic of FIG. 32, the inertial igniter 445 is constructed with the inertial mechanical delay mechanism 230 of FIG. 21, showing its side view "BB". The inertial mechanical delay mechanism 230 may have at least one "wheel assembly" and side view "BB" is intended to show the last wheel assembly of the delay mechanism, in this case the third wheel assembly 228, FIG. 21. In addition to the inertial mechanical delay mechanism component, the inertial igniter is provided with the igniter mechanism component with its potential energy storage and release mechanism shown as enclosed within the space defined by the dotted lines and indicated by the numeral 443.

As can be seen in FIG. 32, the wheel assembly In FIG. 27A, the frontal view "BB" of the wheel assembly unit 228 of the inertial mechanical delay mechanism embodiment 230 of FIG. 21 is shown in the rest positioning of the inertial mechanical delay mechanism. The wheel member 252 of the wheel assembly 228 (and all other wheel assembly units of the delay mechanism) are attached to the inertial igniter base structure 444 by the rotary joint 236 in the support structure 293. The wheel assembly unit 228 is also similarly provided with the preloaded torsion spring 237 (not seen in the view "BB" of FIG. 32), which biases the wheel member 252 against the provided stop (240 in FIG. 22—not seen in FIG. 32).

The igniter mechanism component 443 of the inertial igniter 445 is provided with a striker mass member 446, which is attached to the inertial igniter body 444 by the rotary joint 447. The striker mass member 446 is also provided with a preloaded compressive spring 448, which biases it to keep its tip 449 against the tip 450 of the striker mass release member 451 as shown in FIG. 32. The striker mass release member 451 is also attached to the inertial igniter body 444 by the rotary joint 452, and is provided with a preloaded compressive spring 453, which bias it against the stop 454 on the inertial igniter body 444 as shown in the configuration of FIG. 32.

The striker mass member 446 is also provided with a sharp tip 455, which is configured to initiate the percussion primer 456 (or other appropriate pyrotechnic material) upon impact as described later. The percussion primer 456 is properly mounted in the base structure 444 of the inertial igniter.

Now if the inertial igniter embodiment 445 of FIG. 32 is subjected to an acceleration in the direction of the arrow 457 which is at or above the prescribed operational magnitude and duration threshold for the delay mechanism (i.e., the inertial mechanical delay mechanism embodiment 230 of FIG. 21) of the inertial igniter 445, then the wheel assembly units 226, 227 and 228 would sequentially activate as was previously described for the inertial mechanical delay mechanism embodiment 230. Then as the wheel member 252 of the wheel assembly unit 228 rotates in the clockwise direction as viewed in FIG. 32, then at some point the offset mass 292 of the wheel member 252 engages the surface 458 of the striker mass release member 451 and begin to force the striker mass release member to rotate in the clockwise direction as viewed in FIG. 32.

Figure 33:
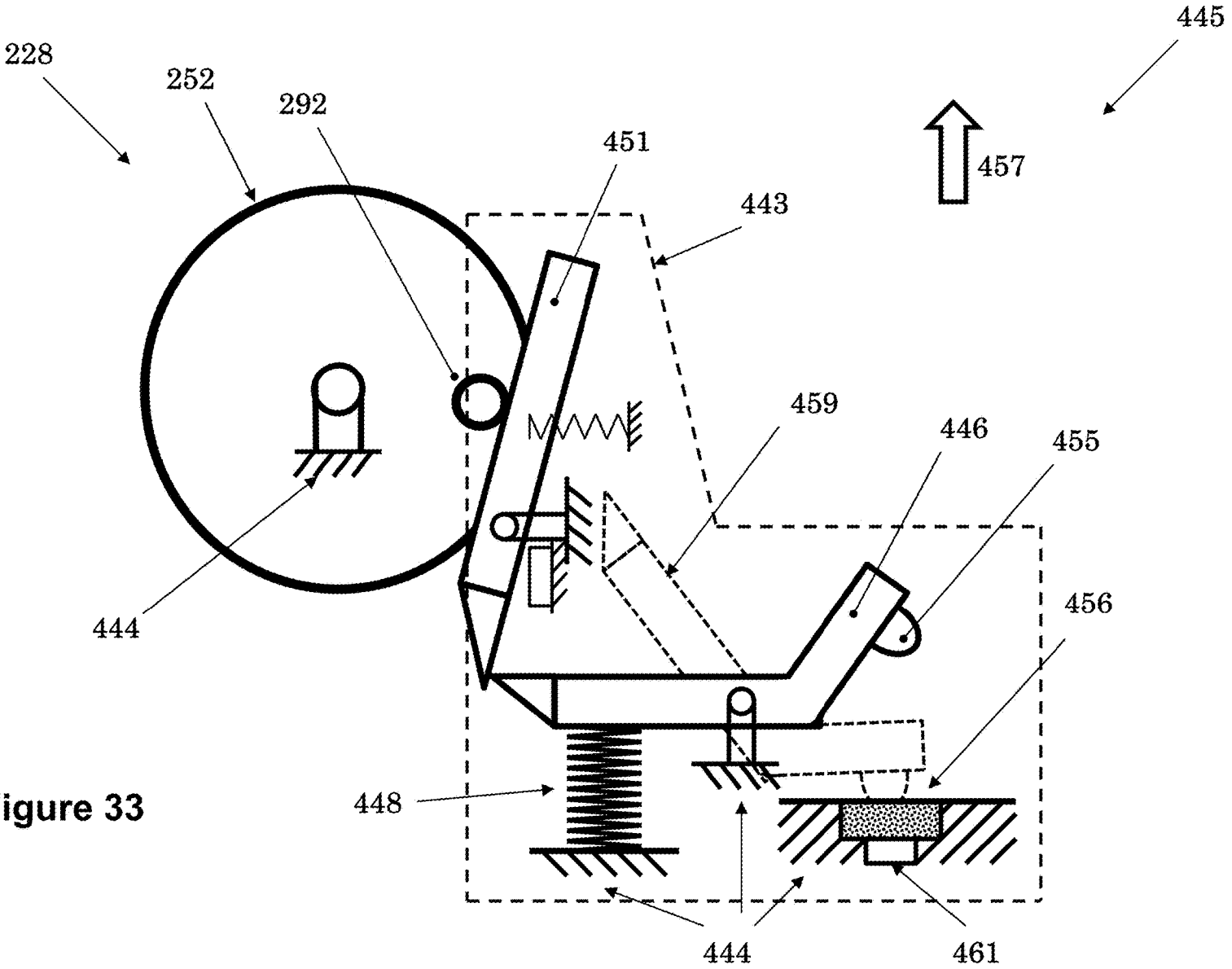
FIG. 33 illustrates the schematic of the inertial igniter embodiment of FIG. 31 developed using the inertial mechanical delay mechanism embodiment of FIG. 21 for low setback accelerations with long durations in its activated state.

Then if the prescribed acceleration in the direction of the arrow 457 persists, the wheel member 252 continues to rotate in the clockwise direction and its offset mass 292 continues to rotate the striker mass release member 451 in the clockwise direction until the tip 450 of the striker mass release member 451 slides passed the surface of the tip 449 of the striker mass member 446 as shown in FIG. 33.

The striker mass member 446 is thereby released and the preloaded compressive spring 448 begins to rotationally accelerate the striker mass member 446 in the clockwise direction. The preloaded compressive spring 448 is configured to accelerate the striker mass member 446 to the required kinetic energy for its ignition pin 445 to initiate the provided percussion primer 446 upon impact as shown by dashed lines in FIG. 33 and indicated by the numeral 459. The generated ignition flame and sparks would then exit from the provided opening 461 to perform its intended function, for example to enter a thermal battery and activate the battery by igniting the battery pyrotechnic pallets.

It is appreciated that if the magnitude of the acceleration in the direction of the arrow 457 becomes relatively low and/or its duration is relatively short before the striker mass member 446 is released, then the wheel assembly units 226, 227 and 228 of the inertial mechanical delay mechanisms of the inertial igniter embodiment 445 of FIG. 32 would return to their starting position shown in FIG. 21.

It is also appreciated that as it was previously indicated, it is highly desirable for any novel miniature inertial mechanical delay mechanism that is used directly for the development of mechanical inertial igniters and other similar devices to be capable of satisfying no activation requirements that may be experienced upon drops or other events that may subject the device to very high-G accelerations as compare to the prescribed activation acceleration magnitude threshold with relatively long durations, for example high-G acceleration levels that may be as high as 5000-10000 G and even higher in magnitude with durations that may be as long as 1-3 msec and sometimes more. It is also appreciated that following such drops, the device (e.g., inertial igniter for the case of munitions) may be required to be operational and activate when subjected to the prescribed (lower G) and (longer) duration acceleration thresholds (all-fire condition in munitions). Alternatively, following such drops, the device may be required to become inert, i.e., become incapable of being activated when subjected to any acceleration event, including the prescribed acceleration and duration thresholds.

The configuration of inertial mechanical delay mechanisms, an example of which was illustrated by its application to the inertial mechanical delay mechanism embodiment 230 of FIG. 21, may also be applied to the inertial mechanical delay mechanism component of the inertial igniter embodiment 445 of FIG. 32.

In the previously described example of the application of the above novel methods to the inertial mechanical delay mechanism embodiment 230 of FIG. 21, the "high G activation prevention mechanism" 125 of FIG. 14 was shown to be adapted to provide the delay mechanism embodiment 230 with high G activation prevention capability while rendering the delay mechanism resettable. It is appreciated that the "high G activation prevention mechanism" 109 of FIG. 12 could have been similarly used to provide the delay mechanism embodiment 230 with high G activation prevention capability while rendering the delay mechanism resettable.

It is appreciated by those skilled in the art that in the following description, the "high G activation prevention mechanism" 109 of FIG. 12 will be described as applied to the last wheel assembly unit 228 of the inertial delay mechanism component of the inertial igniter embodiment 445 of FIG. 32 only for the purpose of describing how such "high G activation prevention mechanisms" (109 of FIG. 12 or 125 of FIG. 14) is integrated into inertial igniter type of embodiment 445 of FIG. 32. However, as it will later be indicated, in practice such "high G activation prevention mechanisms" need only be provided to wheel assembly units behind the last wheel assembly. Thus, in the case of the inertial igniter embodiment 445 of FIG. 32, such "high G activation prevention mechanisms" (109 of FIG. 12 or 125 of FIG. 14) need only be provided to the wheel assembly units 226 and 227, FIG. 21, unless certain minor changes is made to the last wheel member 252 (or all wheel members) as will be described later.

In FIG. 27A, the frontal view "BB" of one of the wheel members of the inertial mechanical delay mechanism embodiment 230 of FIG. 21 is shown with the provided "high G activation prevention mechanism", which is indicated by the numeral 291.

In FIG. 32, the frontal view "BB" shown in FIG. 27A of the wheel assembly unit 228 of the inertial mechanical delay mechanism embodiment 230 of FIG. 21 can be seen. In FIG. 27A, the frontal view of the wheel member 252 is shown together with the "high G activation prevention mechanism" 291 (125 in FIG. 14) in the rest positioning of the inertial mechanical delay mechanism. In the inertial igniter embodiment 445 of FIG. 32, the "high G activation prevention mechanism" 291 would be similarly attached to the base structure 444 of the inertial igniter while being positioned as shown in the schematic of FIG. 27A.

In the schematic of FIG. 27A the "high G activation prevention mechanism" 291 is shown to consist of an "V" shaped link member 294. The branch 297 of the "V" shaped link member 294 is provided with the mass member 298 to shift the center of mass of the link 294 to the left of the joint 295 as viewed in the plane of the FIG. 27A. A preloaded compressive spring 299, which is attached to the inertial igniter base structure 444 (234 in FIG. 27A) on one end 400 and on the other end 401 to the "V" shaped link member 294 (via the branch 297 or the mass member 298), is used to bias the branch 402 of the link member 294 against the stop 403 as shown in the configuration of the FIG. 27A, i.e., when the inertial igniter is at rest.

When the inertial igniter 445 of FIG. 32 that is provided with at least one "high G activation prevention mechanism" 291 is subjected to acceleration in the direction of the arrow 457, the acceleration acts on the center of mass of the "V" shaped link member 294, which is located on the left side of the joint 296, applying a counterclockwise torque to the link member 294, which would tend to rotate it in the counterclockwise direction.

In general, inertial mechanical delay mechanisms, such as the embodiment 230 of FIG. 21, are configured with "high G activation prevention mechanisms" 291 in which the preloading level of their preloaded compressive springs are selected such that they would counter the aforementioned applied counterclockwise torque for accelerations that are at or below the prescribed delay mechanism activation acceleration magnitude threshold.

However, if the inertial igniter embodiment 445 of FIG. 32, which is provided with an inertial mechanical delay mechanism component of the type of embodiment 230 of FIG. 21 with at least one "high G activation prevention mechanism" 291 is subjected to an acceleration in the direction of the arrow 457 with a magnitude that is larger than the prescribed activation acceleration magnitude threshold ("relatively high G acceleration"), the previously indicated generated counterclockwise toque that is applied to the "V" shaped link member 294 would overcome the clockwise torque of the preloaded compressive spring 299, FIG. 27A, causing the link member 294 to begin to rotate in the counterclockwise direction.

It is appreciated that as can be observed in FIGS. 27A and 32, in the rest positioning of the inertial mechanical delay mechanism component of the inertial igniter embodiment 445. i.e., in the view of the wheel member 252 seen in FIG. 32, the branch 402 of the "V" shaped link member 294, FIG. 27A, is positioned slightly in front of the surface of the wheel member 252 of the wheel assembly unit 228. As a result, if the applied "relatively high G acceleration" in the direction of the arrow 457 persists long enough and/or the magnitude of the applied "relatively high G acceleration" is high enough, the "V" shaped link member 294 will continue its counterclockwise rotation and bring the front portion 402 of the "V" shaped link member 294 in in the path of the offset mass 292 of the wheel member 252 of the wheel assembly unit 228 as the wheel member 252 rotates in the clockwise direction due to the acceleration in the direction of the arrow 404 as seen in FIG. 27A.

It is appreciated that as it was previously indicated, with the wheel member configuration of the inertial mechanical delay mechanism wheel assembly units, the "high G activation prevention mechanism" 291 is only needed to be provided to the wheel assembly units that are positioned before the last wheel assembly unit, i.e., before the wheel assembly unit that is used to release the striker mass member 446 of the inertial igniter embodiment 445 of FIG. 32 since the offset mass of the wheel member 252 of the last wheel assembly 228 is configured to release the striker mass member 446 before engaging the "V" shaped link member 294 of the "high G activation prevention mechanism" 291.

Thus, in the inertial igniter embodiment 445 of FIG. 32, the inertial igniter is subjected to an aforementioned relatively high G acceleration event, the clockwise rotation of at least one of the wheel members of the wheel assembly units (before the last wheel assembly unit) would be blocked by the "high G activation prevention mechanism" 291 as shown in FIG. 27B. As a result, the wheel member 252 could not be released, therefore the offset mass 292 of the wheel member 252 could not engage the striker mass release member 451 to release the striker mass 446 to initiate the percussion primer 456.

It is appreciated that full activation of those wheel assembly units that have not yet been activated would also be similarly blocked by the provided "high G activation prevention mechanisms" 291. For example in the inertial igniter 445 of FIG. 32, inertial mechanical delay mechanism embodiment 230 of FIG. 21, depending on the magnitude and duration of the high G acceleration in the direction of the arrow 457, since there is a delay between the activation of the second wheel assembly unit 227 relative to the activation of the first wheel assembly 226, the "high G activation prevention mechanisms" 291 can always be configured to have enough time to at least prevent activation of one of the two wheel assembly units.

The provision of the "high G activation prevention mechanisms" 291 would therefore provide the inertial mechanical delay mechanism component of the inertial igniter embodiment 445 of FIG. 32 with the capability of avoiding percussion primer 456 initiation when the applied acceleration in the intended direction of their operation is higher than their prescribed acceleration magnitude threshold, even if the duration of the applied high G acceleration is longer than the prescribed acceleration threshold duration.

It is appreciated that once the high G acceleration has ceased, the "V" shaped link member 294 of the "high G activation prevention mechanisms" 291 is rotated in the clockwise direction by the preloaded compressive spring 299 and is brought back to its initial positioning shown in the schematic of FIG. 27A. All activated wheel assembly units would also return to their initial positioning shown in FIG. 21.

It is appreciated that the "high G activation prevention mechanism" 291 of FIG. 27A is configured to reset, i.e., return to their initial positions shown once the applied relatively high G acceleration event has ceased. However, in certain applications, particularly if the experienced high G acceleration could have damaged the device in which the inertial mechanical delay mechanism is mounted, the inertial mechanical delay mechanism and the device(s) that it is used to operate may be desired to be rendered non-operative. In such applications, the "high G activation prevention mechanism" of FIG. 27A needs to be configured to be non-resettable, i.e., stay in the configuration of FIG. 27B, and continue to block at least one of the wheel members of the wheel assembly units from resetting.

It is appreciated that a method for preventing resetting of the inertial mechanical delay mechanism component of the inertial igniter embodiment 445 of FIG. 32 once it has been subjected to a relatively high G acceleration event could be the one that was previously described for the "high G activation prevention mechanisms" 109 or 125 of FIGS. 12 and 14, respectively. As previously indicated, the method is based on "locking" the deployed members of the "high G activation prevention mechanisms" that blocks the offset mass of at least one of the wheel assembly units, such as the members 114 and 130 of the "high G activation prevention mechanisms" 109 and 125 of FIGS. 12 and 14, respectively. The same method and mechanisms may also be used to "lock" the deployed member 297 of the "high G activation prevention mechanisms" 291 in its deployed position shown in FIG. 27B, thereby preventing the inertial mechanical delay mechanism component of the inertial igniter embodiment 445 of FIG. 32 from resetting following subjection to a previously described relatively high G acceleration event.

As it was previously described, with the wheel member configuration of the inertial mechanical delay mechanism embodiment 230 of FIG. 21, the "high G activation prevention mechanism" 291, FIG. 27A, cannot be used in the inertial igniter embodiment 445 for preventing the wheel member of the last wheel assembly (in this case, wheel member 252 of the wheel assembly 228) from engaging the striker mass release member 451 to release the striker mass 446 to initiate the percussion primer 456, FIGS. 27A and 33. The wheel member may, however, be modified as described below to enable "high G activation prevention mechanisms" of the type 291 of FIG. 27A to prevent all wheel members of the inertial igniter embodiment 445 of FIG. 32 from activating and therefore preventing the inertial igniter from being initiated. The same modifications can obviously be made to the wheel members of the inertial mechanical delay mechanism embodiment 230 of FIG. 21.

Figures 34A, 34B:
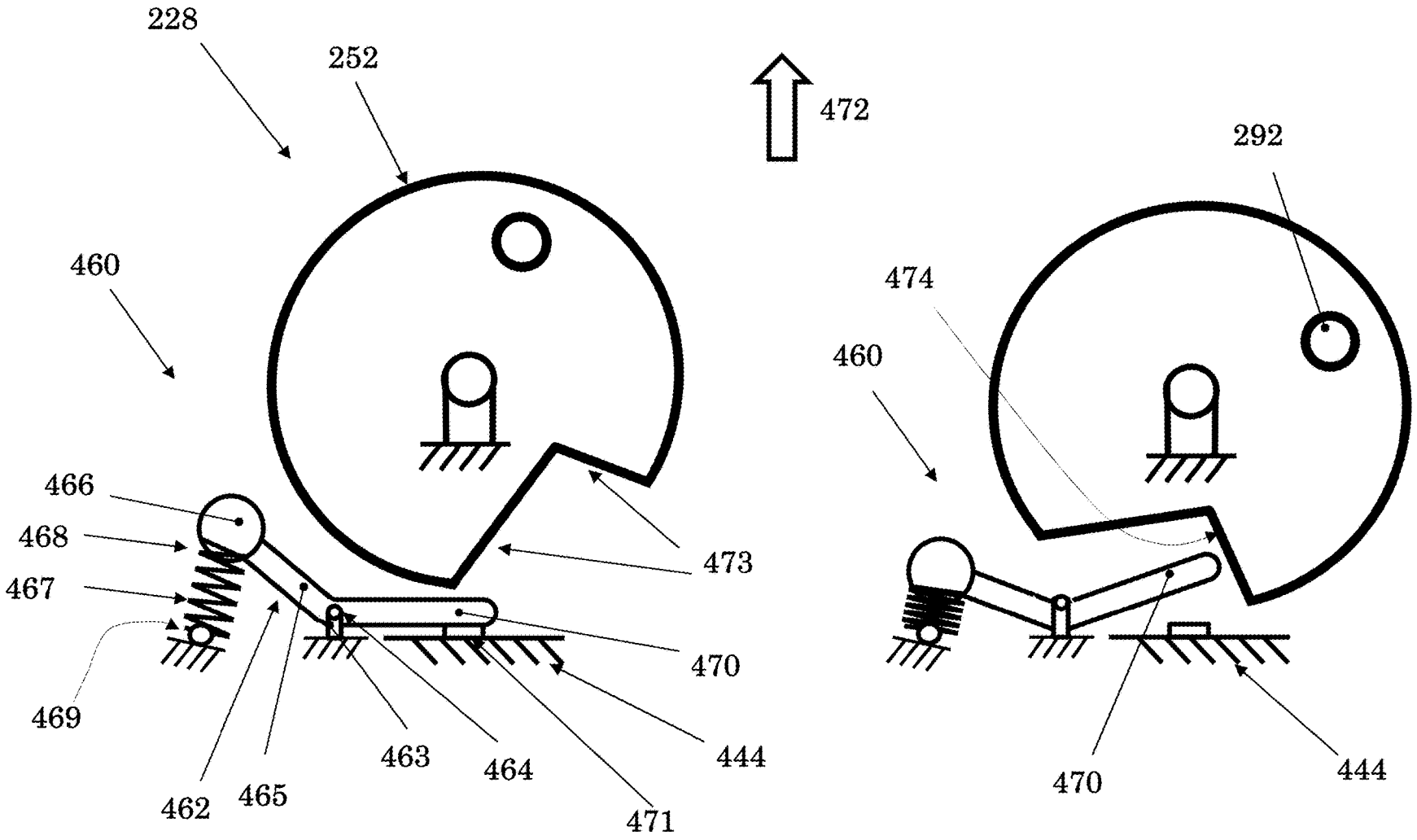
FIG. 34A illustrates the schematic of the wheel member modification for the inertial mechanical delay mechanism of FIGS. 21 and 32 for the activation prevention mechanism operation on all wheel members when subjected to relatively high G accidental acceleration events in its pre-activation state.
FIG. 34B illustrates the schematic of the activation prevention mechanism of FIG. 27A in its activated state.

The modified wheel member of a wheel assembly of the inertial mechanical delay mechanism embodiment 230 of FIG. 21 (and as used in the inertial igniter embodiment 445 of FIG. 32) together with the "high G activation prevention mechanism" 125 of FIG. 14 is shown in the schematic of FIG. 34A. Similar to the FIG. 27A, the frontal view "BB" of one of the wheel members of the inertial mechanical delay mechanism embodiment 230, in this case the wheel member 252 of the wheel assembly unit 282 is shown with the provided "high G activation prevention mechanism", which is indicated by the numeral 260. It is noted that in FIG. 34A, the inertial igniter embodiment 445 is in its rest position.

In the schematic FIG. 34A, the wheel member 252 of the wheel assembly unit 228, which as it was described for the embodiment 230 of FIG. 21, is attached to the inertial igniter base structure 444 by the rotary joint. The wheel assembly unit 228 is also similarly provided with the preloaded torsion spring 237 (not seen in FIG. 34A), which biases the wheel member 252 against the provided stop (240 in FIG. 22—not seen in FIG. 34A).

In the schematic of FIG. 34A and similar to the mechanism 125 of FIG. 14, the "high G activation prevention mechanism" 460 is shown to consist of an "V" shaped link member 462, which is attached to the support member 463 by the rotary joint 464. The branch 465 of the "V" shaped link member 462 is provided with the mass member 466 to shift the center of mass of the link 462 to the left of the joint 464 as viewed in the plane of the FIG. 34A. A preloaded compressive spring 367, which is attached to the inertial igniter base structure 444 on one end 469 and on the other end 468 to the "V" shaped link member 462 (via the branch 465 or the mass member 466), is used to bias the branch 470 of the link member 462 against the stop 471 as shown in the configuration of the FIG. 34A, i.e., when the inertial igniter is at rest.

When the inertial igniter embodiment 445 of FIG. 32 that is provided with at least one "high G activation prevention mechanism" 460, FIG. 34A, is subjected to acceleration in the direction of the arrow 472, the acceleration acts on the center of mass of the "V" shaped link member 462, which is located on the left side of the joint 464, applying a counterclockwise torque to the link member 462, which would tend to rotate it in the counterclockwise direction.

In general, inertial igniters, such as the embodiment 445 of FIG. 32, are configured with "high G activation prevention mechanisms" 460 in which the preloading level of their preloaded compressive springs 467 are selected such that they would counter the aforementioned applied counterclockwise torque for accelerations that are at or below the prescribed delay mechanism activation acceleration magnitude threshold.

However, if the inertial igniter embodiment 445 of FIG. 32 that is provided with at least one "high G activation prevention mechanism" 460 is subjected to an acceleration in the direction of the arrow 472 which has a magnitude that is larger than the prescribed activation acceleration magnitude threshold ("relatively high G acceleration"), the previously indicated generated counterclockwise toque that is applied to the "V" shaped link member 462 would overcome the clockwise torque of the preloaded compressive spring 467, causing the link member 462 to begin to be rotated in the counterclockwise direction.

It is appreciated that in the resting positioning of the inertial igniter embodiment 445 of FIG. 32, the branch 470 of the "V" shaped link member 462 is positioned slightly under the wheel member 252 of the wheel assembly unit 228. Thus, the wheel member 252 is free to undergo full rotation. The wheel member 252 is, however, provided with the cutout section 473, which would not prevent free clockwise rotation of the wheel member 252, but would limit clockwise rotation of the wheel 252 when the inertial igniter is subjected to an aforementioned "relatively high G acceleration" in the direction of the arrow 472. When the inertial igniter embodiment 445 is subjected to a "relatively high G acceleration" in the direction of the arrow 472, the "V" shaped link member 462 will begin to rotate in the counterclockwise direction as was previously indicated, and at some point bring the front portion of the branch 470 of the "V" shaped link member 462 inside the cutout section 473 of the wheel member 252 as can be seen in FIG. 34B. Then at some point, the clockwise rotation of the wheel member 252 is blocked by the branch 470 of the "V" shaped link member 462 as it comes into contact with the surface 474 of the wheel member cutout 473. As a result, by blocking the rotation of the wheel member 252 before its offset mass 292 engages the striker mass release member 451, FIG. 33, the striker mass 446 is not released and the inertial igniter is not initiated.

It is appreciated that in general, a stop member (not shown) may be provided to limit the counterclockwise rotation of the "V" shaped link member 462.

It is appreciated that full activation of those wheel assembly units that have not yet been activated would also be similarly blocked by the provided "high G activation prevention mechanisms" 460.

For example, in the inertial igniter embodiment 445 of FIG. 32, which is provided with a total of three wheel assembly units in the mechanical delay component of the inertial igniter, FIG. 21, depending on the magnitude and duration of the high G acceleration in the direction of the arrow 439, since there is a delay between the activation of the second wheel assembly unit 227 relative to the activation of the first wheel assembly 226, and similarly there is even a longer delay between the activation of the third wheel assembly unit 228 relative to the activation of the first wheel assembly 226, the "high G activation prevention mechanisms" 460 can always be configured to have enough time to at least prevent activation of one of the wheel assembly units. The provision of the "high G activation prevention mechanisms" 460 would therefore provide the inertial mechanical delay mechanism component of the inertial igniter embodiment 445 with the capability of preventing full activation when the applied acceleration in the intended direction of their operation is higher than their prescribed acceleration magnitude threshold, even if the duration of the applied high G acceleration is longer than the prescribed acceleration threshold duration.

It is appreciated that once the high G acceleration in the direction of the arrow 472 has ceased, the "V" shaped link member 462 of the "high G activation prevention mechanisms" 460 is rotated in the clockwise direction by the preloaded compressive spring 467 and is brought back to its initial positioning shown in the schematic of FIG. 34A. All activated wheel assembly units of the inertial igniter 445 would also return to their initial positioning shown in FIG. 21 for the delay mechanism component of the inertial igniter.

It is appreciated that the "high G activation prevention mechanism" 460 of FIG. 34A is configured to reset, i.e., return to their initial positions shown once the applied relatively high G acceleration event has ceased. However, in certain applications, particularly if the experienced high G acceleration could have damaged the device in which the inertial mechanical delay mechanism is mounted, the inertial mechanical delay mechanism and the device(s) that it is used to operate may be desired to be rendered non-operative. In such applications, the "high G activation prevention mechanism" of FIG. 34A needs to be configured to be non-resettable, i.e., stay in the configuration of FIG. 34B, and continue to block at least one of the wheel members of the wheel assembly units from resetting.

It is appreciated that a method for preventing resetting of an inertial mechanical delay mechanism component of the inertial igniter embodiment 445 of FIG. 32 once it has been subjected to a relatively high G acceleration event was previously described. The method was described as previously shown to be applied to the "high G activation prevention mechanisms" 109 or 125 of FIGS. 12 and 14, respectively, and was based on "locking" the deployed members of the "high G activation prevention mechanisms" that blocks at least one of the wheel members of the wheel assembly units, in this case, the branch 465 of the "V" shaped link 462, as was described for the members 114 and 130 of the "high G activation prevention mechanisms" 109 and 125 of FIGS. 12 and 14, respectively.

The same method and mechanisms may therefore be used to "lock" the deployed branch 470 of the "V" shaped link 462 of the "high G activation prevention mechanisms" 460 in its deployed position shown in FIG. 34B, thereby preventing the inertial mechanical delay mechanism component of the inertial igniter embodiment 445 of FIG. 32 from resetting following subjection to a previously described relatively high G acceleration event.

It is appreciated that in the case of the "high G activation prevention mechanisms" 291, FIG. 34B, the cross-section 142 and 152 in FIGS. 16A and 16B, respectively, would indicate the cross-sectional views of the 470 branch of the "V" shaped link member 462, FIGS. 34A and 34B.

It is appreciated by those skilled in the art that the modification to the wheel members 252, 250 and 233 by the provision of cutout 473 shown in FIG. 34A is not intended to move the center of mass of the wheel members away from the centers of their respective rotary joints (excluding the offset their provided masses). This is readily accomplished by, for example, providing a symmetrical cutoff on the opposite side of the wheel members or addition of opposite masses or the like. It is also appreciated by those skilled in the art that even though the wheel members are drawn to be circular in shape in the present illustrations, they do not have to be necessarily circular in shape as long as they are provided with their functional features, i.e., have their center of mass to be located on the axis of rotation of their respective rotary joints (not including the offset mass elements); provide a location for attachment of offset masses, and provide the stopping surface 474 (FIG. 34B) for the modified wheel members.

It is appreciated by those skilled in the art that in many applications, inertial mechanical delay mechanisms and other devices that use them in their construction, such as reserve liquid or reserve thermal batteries, are packaged in enclosures that prevents inspection of their status unless, for example, the device is x-rayed. In such applications, it is highly desirable if the device can enable the user to determine the status of the device, i.e., whether the delay mechanism has partially or fully activated as well as if the device in which the delay mechanism is integrated has been activated.

It is appreciated by those skilled in the art, that in many applications, the user only needs to know if the device (in this case the inertial mechanical delay mechanism component) has been fully or partially activated after being subjected to acceleration, particularly an aforementioned "relatively high G acceleration" event. In particular, when the device is subjected to an aforementioned "relatively high G acceleration" event, the user may want to know if the device has successfully reset and for the devices that are provided with the aforementioned "high G activation prevention mechanisms", the user may want to know if the device is no loner operational. The above two cases are of particular importance to munitions for safety and operational reasons.

In all the disclosed inertial mechanical delay mechanism embodiments and inertial igniter or other device embodiments that use such mechanical delay mechanisms may readily be provided with the capability that would allow the user to determine partial or full activation of the assembly units of the inertial mechanical delay mechanism component of the device. The basic method used to provide inertial mechanical delay mechanism with this capability consists of detecting the motion of inertial components (e.g., the beam element 11, mass member 162 and wheel member 233 of the embodiments 10, 160 and 230 of FIGS. 6A, 17 and 21, respectively) of the inertial mechanical delay mechanism in each device. This method is described below by its application to the inertial mechanical delay mechanism embodiment 10 of FIG. 6A.

Figure 35:
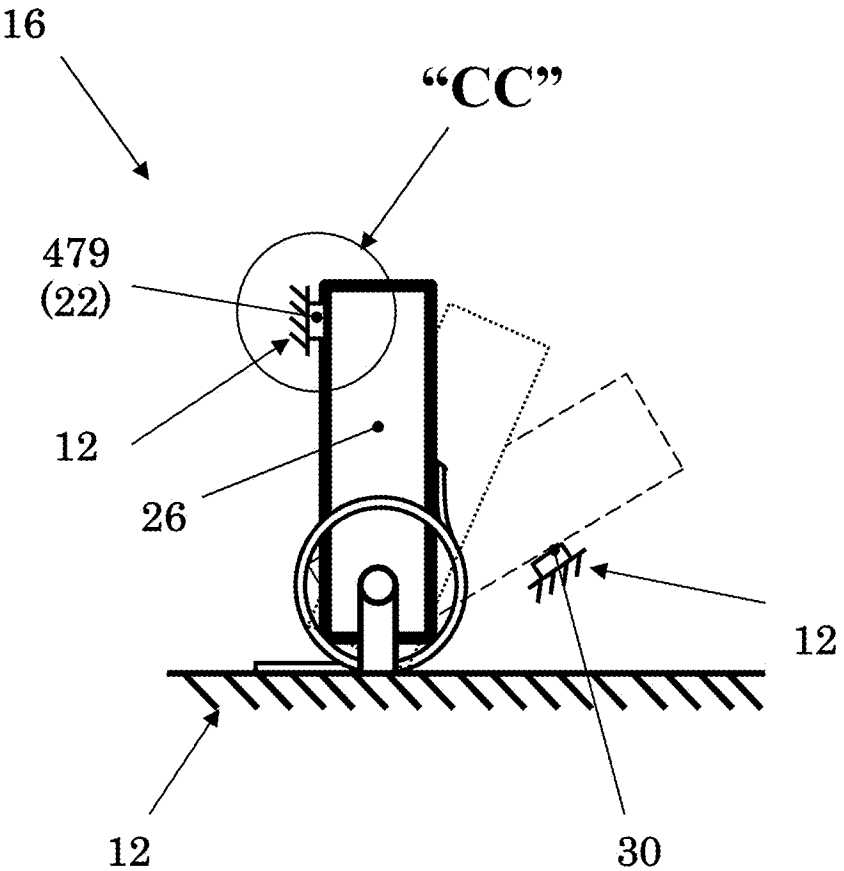
FIG. 35 illustrates the schematic of one of the wheel assemblies of the inertial mechanical delay mechanism of FIG. 6A for activation detection switching.

The schematic of the rotary beam assembly 16 of the inertial mechanical delay mechanism 10 of FIG. 6A is shown in FIG. 35. In FIG. 35, the rotary beam assembly 16 is shown in its rest (pre-activation) state and its members are indicated with the same numerals as in FIG. 6A. The blow-up view "CC" of FIG. 35, showing details of the stop member and the beam element 26 region and the formation of electrical contact members, are shown in detail in FIG. 36.

Figure 36:
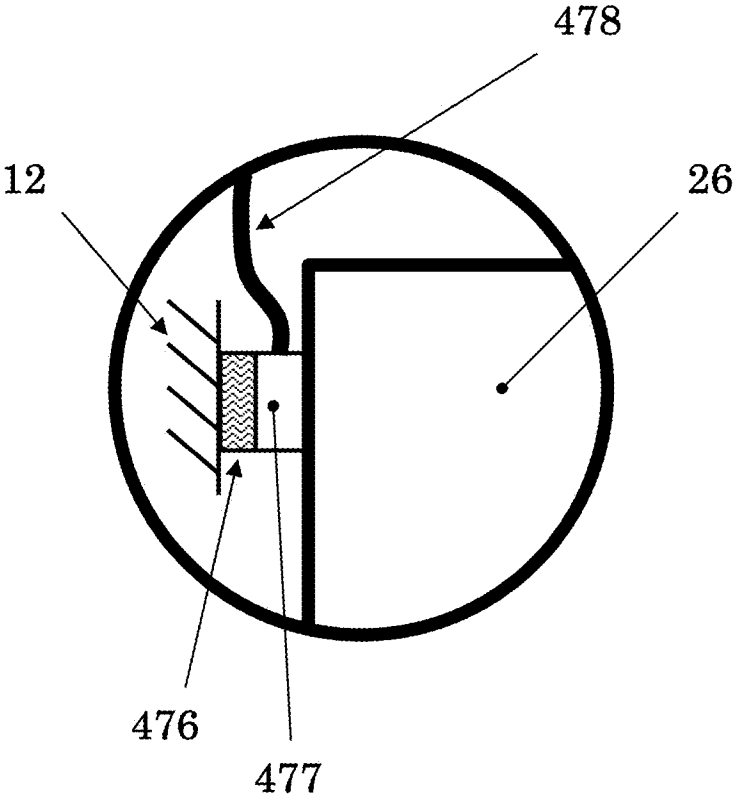
FIG. 36 illustrates the blow up "CC" of FIG. 35 showing a stop member with electrical contact for activation event detection.

As can be seen in the blow-up view of FIG. 36, following the aforementioned method, the stop member 22 (indicated as the member 479 in FIG. 35) is now constructed with an electrically non-conductive material 476, which is fixedly attached to the base structure 12 of the inertial mechanical delay mechanism embodiment 10 of FIG. 6A, to which an electrically conductive member 477 is fixedly attached. An electrical wire is also attached to the electrically conductive member 477 as can be seen in FIG. 36.

It is appreciated that since all members of the inertial mechanical delay mechanism embodiment 10 of FIG. 6A, including its base structure 12 and its rotary beam assemblies and their beam members are usually metallic and electrically conductive. Thus, in the configuration shown in FIG. 35 and the blow-up view of FIG. 36, i.e., in the rest positioning of the inertial mechanical delay mechanism embodiment 10 illustrated in FIG. 6A, the wire 478 and the base structure 12 (and other members of the delay mechanism) are in electrical contact. Identical stop members (not shown) are used for the beam elements 11 and 31 of the rotary beam assemblies 15 and 17. Identically configured stop members (not shown) may also be used for the stop members 30 and 29, FIGS. 6D, which are used to limit the rotation of the beam elements 26 and 11, respectively.

In the present embodiment would then function as follows. In the rest position of the beam elements of the rotary beam assembly units of the inertial mechanical delay mechanism embodiment 10 of FIG. 6A, as indicated above, the wire 478 and the base structure 12 (and other members of the delay mechanism) are in electrical contact. However, when the delay mechanism 10, FIG. 6A, is subjected to an acceleration in the direction of the arrow 23, then depending on the magnitude and duration of the acceleration, the first beam element 11 and sequentially the beam elements of the rotary beam assembly units 16 and 17 may begin to rotate in the clockwise direction as viewed in FIGS. 6B-6D. Then as the beam elements begin to rotate in the clockwise direction, as can be seen in the example of FIG. 36, contact between the beam element 26 and the electrically conductive member 477 is lost, and a circuit detecting this electrical contact is opened, indicating the start of clockwise rotation of the beam element of the affected rotary beam assembly unit. Therefore, by monitoring the of the said circuit, the user can determine the status of each rotary beam assembly and if desired as a function of time during acceleration events.

It is appreciated that as it was previously indicated, the same electrical contact arrangement shown in FIG. 36 can be provided at the beam element rotation limiting stops (stop 30 for beam element 26 of the rotary beam assembly unit 16, FIG. 35). As a result, the user can similarly monitor when each beam element has been fully deployed.

It is also appreciated that once the applied acceleration in the direction of the arrow that can activate one or more of the rotary beam assembly units of the inertial mechanical delay mechanism embodiment 10 of FIG. 6A has ceased, the monitoring of the open and closed circuits across the beam member stops (479 for beam member 26, FIG. 35) would indicate if each beam member has returned to its rest position shown in FIG. 6A in addition to their timing.

It is appreciated by those skilled in the art that all disclosed inertial mechanical delay mechanism embodiments, alone or as integrated with other devices such as the disclosed inertial igniters and impulse switches, may be provided with electrical contacts of the type shown in FIG. 36 so that the status of their assembly units can be monitored. For example, in the "sliding mass-spring assembly" units 154, 155 and 156 of the inertial mechanical delay mechanism embodiment 160 of FIG. 17, activation of the assembly units, i.e., the start of downward motion of the mass members 162, 166 and 167, respectively, can be detected by the provision of electrical contacts of the type shown in FIG. 36 between the mass members and the assembly housings 196, 197 and 198, respectively. Similarly, in the inertial mechanical delay mechanism embodiment 230 of FIG. 21, the activation status of the wheel assembly units 226, 227 and 228 can be detected by the provision of electrical contacts of the type shown in FIG. 36 between the wheel member offset mass and the provided stop as shown in FIG. 22 for the offset mass 241 and the stop 240.

It is appreciated by those skilled in the art that the disclosed inertial mechanical delay mechanisms may also be used to construct electrical impulse switches, which are activated like the so-called electrical G switches but with the added time delays to account for the activation shock level duration requirement, i.e., when a prescribed minimum shock loading (acceleration) level is experienced for a prescribed minimum length of time (duration). The electrical "impulse switches" may be configured as normally open or closed and with or without latching mechanisms. Such impulse switch embodiments that combine such safety mechanisms with electrical switching mechanisms are described herein together with alternative methods of their construction.

The above disclosed inertial igniter embodiments are configured to initiate a percussion primer or some other appropriate pyrotechnic material when subjected to an acceleration that is at or above a prescribed magnitude threshold for a minimum prescribed duration (all-fire condition for munitions). The basic operating mechanism of these embodiments may also be used to construct normally open (closed) electrical switches ("impulse switches") that close (open) a circuit when subjected to similar accelerations that are at or above a prescribed threshold for a prescribed duration (all-fire condition for munitions). In addition, the "impulse switches" may also be provided with previously described "high G activation prevention mechanisms" so that when the impulse switch is subjected to an aforementioned "relatively high G acceleration" event, the impulse switch is prevented from being activated. It is also appreciated that an impulse switch may be configured to become inoperative, i.e., do not perform its switching action, once it is subjected to a "relatively high G acceleration" event.

In the above disclosed inertial igniter embodiments, a striker mass member is released once an acceleration in the intended direction (direction of firing for munitions) that has a magnitude that is at or above a prescribed threshold for a prescribed minimum duration is detected. At which time, the released striker mass is accelerated to the required velocity by a preloaded spring (elastic) member to initiate the provided percussion primer or other pyrotechnic material upon impact. In the disclosed inertial igniter embodiments, the disclosed inertial mechanical delay mechanisms are employed to achieve the configured, relatively long, prescribed acceleration magnitude threshold duration for activation, i.e., for releasing the striker mass of the inertial igniter. The same inertial igniter configurations may be used to develop "impulse switches" to achieve switching only the prescribed acceleration magnitude threshold with prescribed, relatively long duration is detected. Other functionalities described for the disclosed inertial igniters, such as "high G activation prevention mechanisms" for "relatively high G acceleration" events and resetting or non-resetting features may also be implemented in the disclosed "impulse switches".

It is appreciated that as it was indicated above, the configuration and operation of the following "impulse switch" embodiment are identical to those of the disclosed inertial igniters, except that in place of the percussion primers in the inertial igniters, electrical switching elements are provided to achieve various normally open or normally closed impulse switches with or without latching capability. For this reason, the configuration and operation of only one impulse switch embodiment in which the inertial igniter embodiment 445 of FIG. 32 is shown to be converted to an impulse switch is described. It is, however, appreciated that all other disclosed inertial igniter embodiments can be similarly converted to impulse switches of the above types.

The resulting impulse switches would then activate only if they are subjected to the prescribed minimum acceleration threshold for the prescribed minimum duration, while staying inactive during all other "impulse" conditions as described for the other above inertial mechanical delay mechanism and inertial igniter embodiments.

Such "impulse switches" also have numerous non-munitions applications. For example, such impulse switches can be used to detect events such as impacts, falls, structural failure, explosions, etc., to open or close electrical circuits to initiate prescribed actions.

The basic configuration of such impulse switches using the configuration and functionalities of the disclosed inertial igniter embodiments is herein described using the inertial igniter embodiment 445 of FIG. 32. The schematic of such as impulse switch 480, obtained by conversion of the inertial igniter embodiment 445 to an impulse switch is shown in FIG. 37A.

Figure 37A:
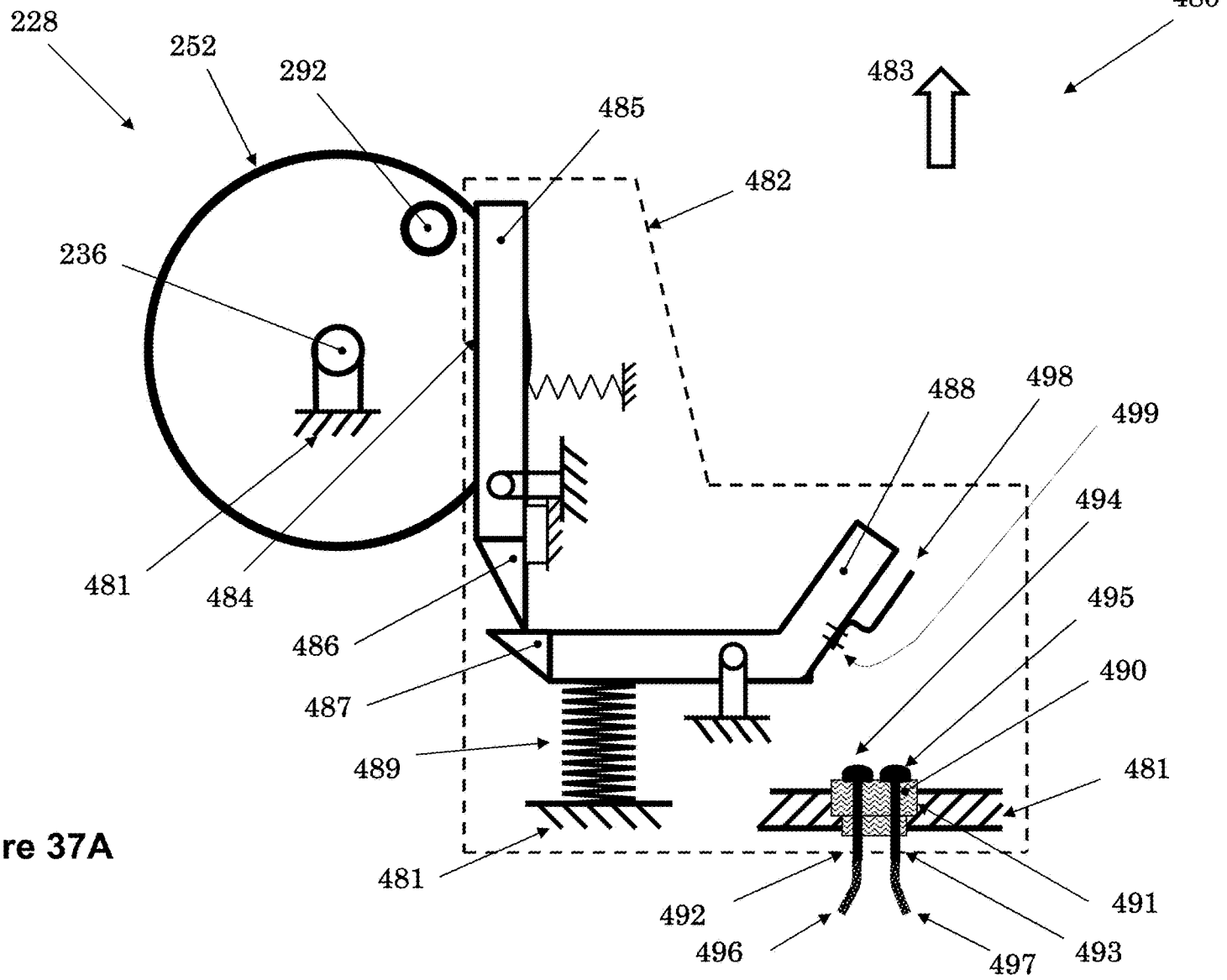
FIG. 37A illustrates the schematic of the normally open impulse switch embodiment developed using the inertial igniter embodiment of FIG. 28 for low setback accelerations with long durations in its pre-activation state.

The impulse switch embodiment 480 shown in FIG. 37A uses the inertial mechanical delay mechanism embodiment 10 of FIG. 6A as previously described for the inertial igniter embodiment 445 of FIG. 32. In FIG. 37A, the last wheel member 252 of the wheel assembly 228 of the delay mechanism embodiment 10 is shown to be used for actuation of the impulse switch 480. The wheel member 252 is similarly attached to the base structure 481 of the impulse switch 480 via the rotary joint 236. The impulse switch mechanism component of the impulse switch embodiment 480 is shown as enclosed with dashed line and indicated by the numeral 482, and are identical to the inertial igniter component of the inertial igniter embodiment 445 of FIG. 32, except for the tip 455 of the striker mass 446 and the percussion primer 456, which are replaced by the components of the normally open and normally closed electrical switches as described below.

In the impulse switch embodiment 480 of FIG. 37A, an element 490, which is constructed of an electrically non-conductive material is fixed to the impulse switch body 481. The electrically non-conductive element 490 may be attached to the impulse switch body 481 by fitting it into a provided pocket 491 in impulse switch body. The element 490 is provided with two electrically conductive elements 492 and 493 with contact ends 494 and 495, respectively. The electrically conductive elements 492 and 493 may be provided with the extended ends to form contact "pins" for direct insertion into provided holes in a circuit board or may alternatively be provided with wires 496 and 497, respectively, for connection to appropriate circuit junctions. Previously described striker mass member 488 is provided with a flexible strip of electrically conductive material 498, FIG. 37A, instead of the sharp pin 455, FIG. 33. The flexible strip of electrically conductive material 498 is fixedly attached to the surface of the striker mass member 488 as shown in FIG. 37A, for example, with fasteners 499 or by soldering or other methods known in the art.

The disclosed "impulse switch" embodiments function as was described for the inertia igniter embodiment 445 of FIG. 32. When the impulse switch embodiment 480 of FIG. 37A is subjected to an acceleration in the direction of the arrow 483 which is at or above the prescribed operational magnitude and duration threshold for the delay mechanism component (i.e., the inertial mechanical delay mechanism embodiment 230 of FIG. 21) of the impulse switch embodiment 480, then the wheel assembly units 226, 227 and 228 would sequentially activate as was previously described for the inertial mechanical delay mechanism embodiment 230. Then as the wheel member 252 of the wheel assembly unit 228 rotates in the clockwise direction as viewed in FIG. 37A, then at some point the offset mass 292 of the wheel member 252 engages the surface 484 of the striker mass release member 485 and begin to force the striker mass release member to rotate in the clockwise direction as viewed in FIG. 37A.

Figure 37B:
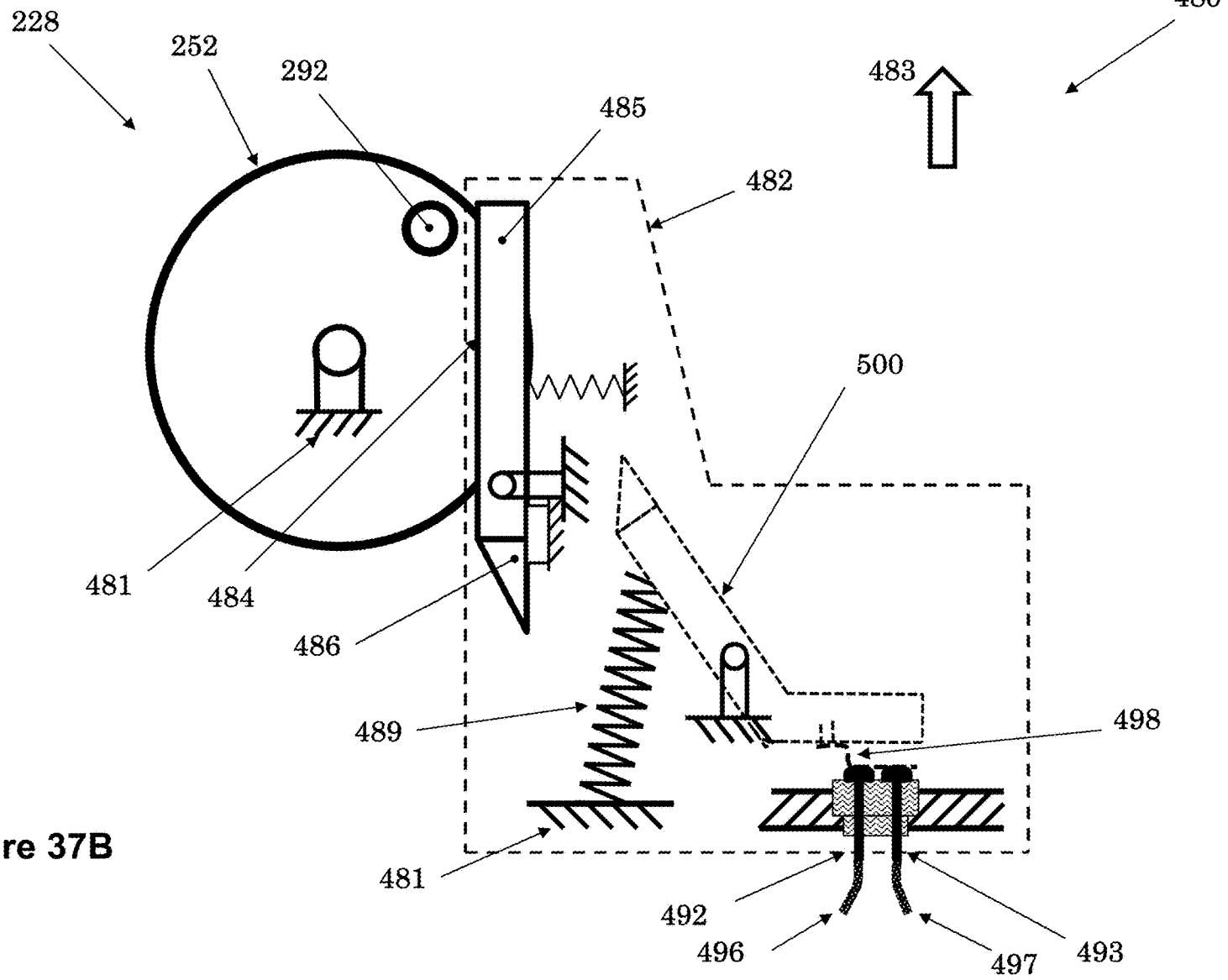
FIG. 37B illustrates the schematic of the normally open impulse switch embodiment of FIG. 37A in its activated state.

Then if the prescribed acceleration in the direction of the arrow 483 persists, the wheel member 252 continues to rotate in the clockwise direction and its offset mass 292 continues to rotate the striker mass release member 485 in the clockwise direction until the tip 486 of the striker mass release member 485 slides passed the surface of the tip 487 of the striker mass member 488 as can be seen in FIGS. 37A and 37B.

The striker mass member 488 is thereby released and the preloaded compressive spring 489 begins to rotationally accelerate the striker mass member 488 in the clockwise direction and rotates it until the strip of the electrically conductive material 498 comes into contact with the contact ends 494 and 495, thereby closing the circuit to which the impulse switch 480 is connected through the electrically conductive elements 492 and 493 or wires 496 and 497 as shown in the schematic view of FIG. 37B, in which the striker mass member in its activated configuration is shown with dashed lines and indicated by the numeral 500.

It is appreciated by those skilled in the art that the impulse switch 480 of FIGS. 37A-37B is a "normally open impulse switch" and once activated due to the prescribed minimum acceleration level and duration thresholds in the direction of the arrow 483, it would close the circuit to which it is connected as described above. The "normally open impulse switch" 480 may also be configured to be a "latching" type, i.e., keep the circuit closed after activation, or be a "non-latching" type, i.e., close the switch and momentarily open it.

To make the impulse switch 480 into a "latching normally open impulse switch" type, the level of preload in the compressive spring 489 is selected such that once the impulse switch is activated as shown in its activated state in the schematic of FIG. 37B, the compressive spring 489 is still in its preloaded compressive state. As a result, following activation, as is seen in the schematic of FIG. 37B, the electrically conductive material strip 498 is still forced against the contacts 494 and 495 by the still compressively preloaded spring 489.

However, to make the impulse switch 480 into a "non-latching normally open impulse switch" type, the level of preload in the compressive spring 489 is selected such that once the impulse switch is activated as shown in its activated state in the schematic view of FIG. 37B, the compressive spring 489 has passed its free length (not loaded) state, i.e., it is loaded in tension, thereby moments after closing the circuit as shown in the schematic of FIG. 37B, the striker mass 488 is rotated back in the counterclockwise direction as viewed in FIG. 37A, and the contact between the electrically conductive material strip 498 and the contacts 494 and 495 is lost, thereby the circuit using the impulse switch 480 with such preloading level of the spring 489 is open again.

Figure 38A:
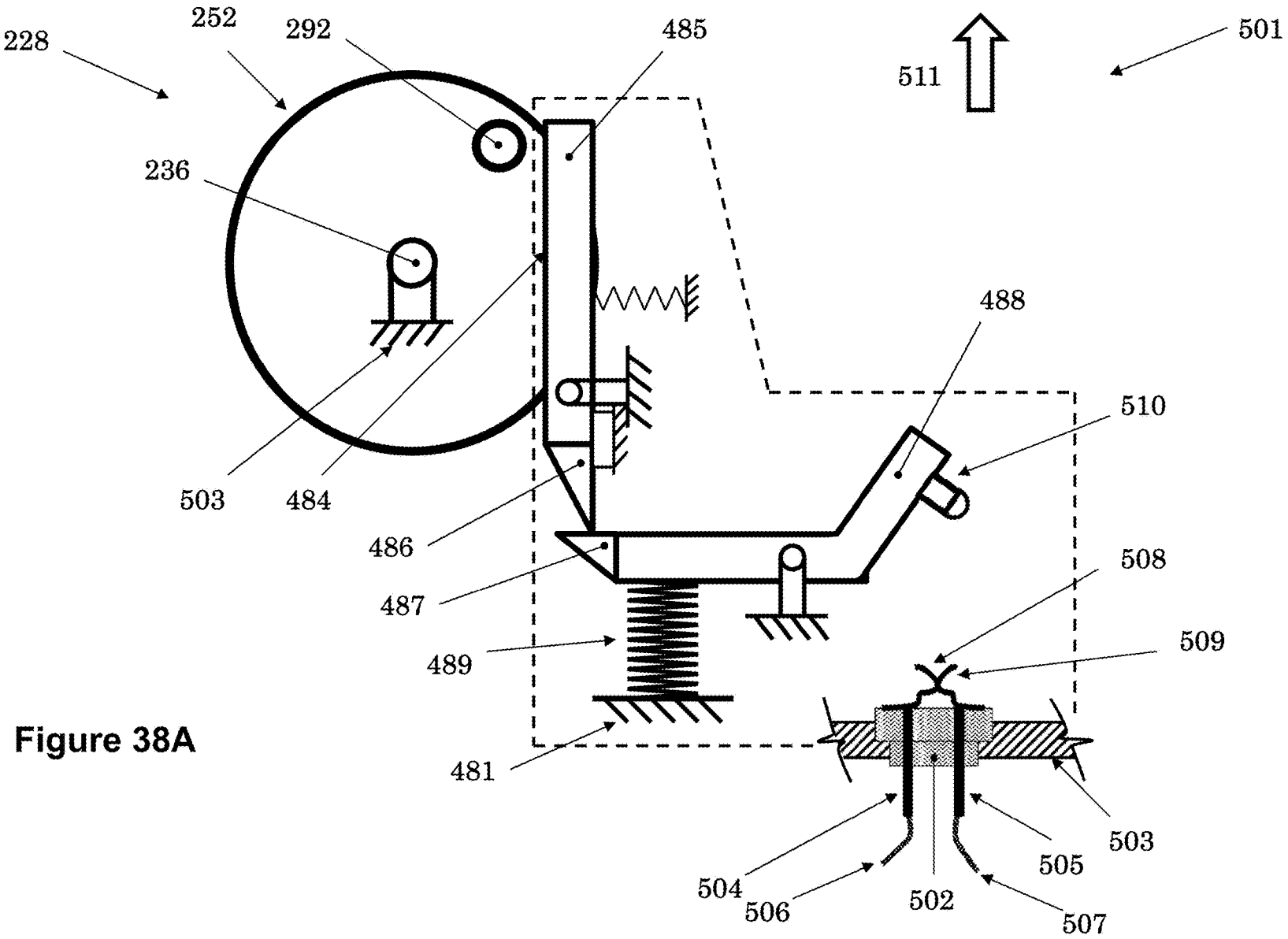
FIG. 38A illustrates the schematic of the normally closed impulse switch embodiment developed using the inertial igniter embodiment of FIG. 28 for low setback accelerations with long durations in its pre-activation state.

The normally open impulse switch 480 of FIGS. 37A-37B may also be modified to function as a normally closed impulse switch. The schematic of such a normally closed impulse switch embodiment 501 is shown in FIG. 38A. The basic configuration and operation of the impulse switch 501 is identical to that of the normally open impulse switch embodiment 480 of FIGS. 37A-37B, except for its electrical switching contacts and related elements described below to convert it from a normally open to a normally closed impulse switch.

In the normally closed impulse switch embodiment 501 of FIG. 38A, like the normally open impulse switch 480 of FIG. 37A, an element 502, which is constructed of an electrically non-conductive material is fixed to the impulse switch body 503. The electrically non-conductive element 502 may be attached to the impulse switch body 503 by fitting it into a provided pocket in the impulse switch body as shown in FIG. 38A. The element 502 is provided with two electrically conductive elements 504 and 505 with flexible contact ends 508 and 509, respectively. The flexible electrically conductive contact ends 508 and 509 are biased to press against each other as seen in the schematic of FIG. 38A. As a result, a circuit connected to the electrically conductive elements 504 and 505 is normally closed in the pre-activation state of the impulse switch 501 as shown in the configuration of FIG. 38A.

The electrically conductive elements 504 and 505 may be provided with the extended ends to form contact "pins" for direct insertion into provided holes in a circuit board or may alternatively be provided with wires 506 and 507, respectively, for connection to appropriate circuit junctions.

The previously described striker mass member 488 is provided with an electrically nonconductive wedge element 510, which is fixed to the surface of the striker mass member 486 as shown in FIG. 38A, for example, by an adhesive or using other methods known in the art.

The basic operation of the impulse switch 501 of FIG. 38A is very similar to that of the impulse switch 480 of FIG. 37A. Here again and as was described for the impulse switch 480, when the impulse switch 501 is accelerated in the direction of the arrow 511 at or above the prescribed magnitude threshold for the prescribed duration threshold, the striker mass release member 485 is rotated in the clockwise direction by the clockwise rotation of the wheel member 252 as was previously described for the impulse switch 480 until the striker mass member 488 is released.

Figure 38B:
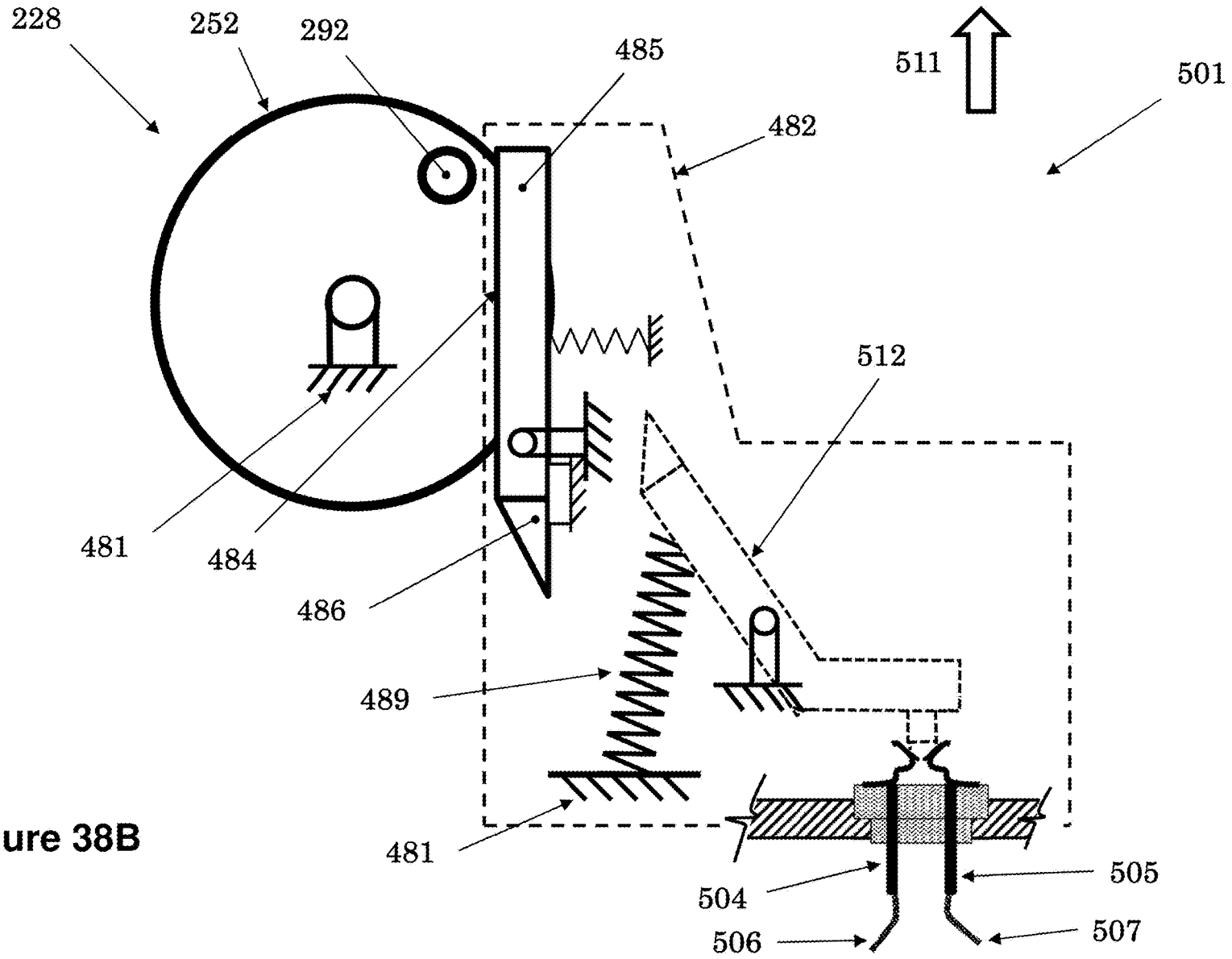
FIG. 38B illustrates the schematic of the normally closed impulse switch embodiment of FIG. 37A in its activated state.

At this point, as was described for the impulse switch 480 of FIG. 37A, the mechanical potential energy stored in the preloaded compressive spring 489 begins to rotationally accelerate the striker mass 488 in the clockwise direction until the electrically nonconductive wedge element 510 is inserted between the contacting surfaces of the flexible electrically conductive contact ends 508 and 509, thereby opening the circuit to which the impulse switch 501 is connected (through the electrically conductive elements 504 and 505 or wires 506 and 507) as shown in the schematic view of FIG. 38B. In FIG. 38B, the striker mass is shown with dashed lines and indicated by the numeral 512.

It is appreciated by those skilled in the art that the impulse switch 501 of FIGS. 38A-38B is a "normally closed impulse switch" and once activated due to the prescribed minimum acceleration level threshold in the direction of the arrow 511 for the prescribed duration threshold, it would open the circuit to which it is connected as described above. The "normally closed impulse switch" 501 may also be configured to be a "latching" type, i.e., keep the circuit open after activation, or be a "non-latching" type, i.e., open the switch momentarily and then close it as described below.

To make the impulse switch 501 into a "latching normally closed impulse switch" type, the level of preload in the compressive spring 489 is selected such that once the impulse switch is activated as shown in its activated state in the schematic of FIG. 38B, the compressive spring 489 is still in its preloaded compressive state. As a result, following activation, as is seen in the schematic of FIG. 38B, the electrically nonconductive wedge element 510 would thereby stay inserted between the contacting surfaces of the flexible electrically conductive contact ends 508 and 509 and the circuit stays open.

However, to make the impulse switch 501 into a "non-latching normally closed impulse switch" type, the level of preload in the compressive spring 489 is selected such that once the impulse switch is activated as shown in its activated state in the schematic view of FIG. 38B, the compressive spring 489 has passed its free length (not loaded) state, i.e., it is loaded in tension, thereby moments after closing the circuit as shown in the schematic of FIG. 38B, the striker mass 488 is rotated back in the counterclockwise direction as viewed in FIG. 38B, and the flexible electrically conductive contact ends 508 and 509 come into contact and the impulse switch is closed again.

The embodiments 480 and 501 of FIGS. 37A-37B and 38A-38B, respectively, illustrate how the inertial igniter embodiment 445 of FIGS. 32-33 can be converted to normally open and normally closed electrical "impulse switches" of latching and non-latching types. It is appreciated by those skilled in the art that all other disclosed inertial igniters embodiments may also be similarly converted to any of the above electrical "impulse switch" types.

It is appreciated by those skilled in the art that similar to the inertial igniter 445 of FIG. 32, if the acceleration in the direction of the arrow 483 and 511 ceases before the impulse switches 480 and 501, respectively, activate, i.e., before the striker mass 488 is released, then the impulse switches would return to their pre-activation states shown in FIGS. 37A and 38A.

It is appreciated by those skilled in the art that similar to the inertial igniter embodiment 445 of FIG. 32, the impulse switches 480 and 501 of FIGS. 37A and 38A may also be provided with the modified wheel member configuration described for the embodiment of FIG. 34A and with at least one "high G activation prevention mechanism" 460. Then if the impulse switches 480 and 501 of FIGS. 37A and 38A, respectively, are subjected to aforementioned "relatively high G acceleration" events in the direction of the arrows 483 and 511, respectively, the acceleration acts on the center of mass of the "V" shaped link member 462, which is located on the left side of the joint 464, applying a counterclockwise torque to the link member 462, which would tend to rotate it in the counterclockwise direction.

In general, as it was indicated for the disclosed inertial igniter embodiments, the disclosed impulse switches are also configured with "high G activation prevention mechanisms" 460 in which the preloading level of their preloaded compressive springs (467 in FIG. 34A) are selected such that they would counter the aforementioned applied counterclockwise torque for accelerations that are at or below the prescribed delay mechanism activation acceleration magnitude threshold.

However, if the impulse switches 480 and 501 of FIGS. 37A and 38A, which are provided with at least one "high G activation prevention mechanism" 460, FIG. 34A are subjected to aforementioned "relatively high G acceleration" events in the direction of the arrows 483 and 511, respectively, with a magnitude that is larger than the prescribed activation acceleration magnitude threshold ("relatively high G acceleration"), the previously indicated generated counterclockwise toque that is applied to the "V" shaped link member 462 would overcome the clockwise torque of the preloaded compressive spring 467, FIG. 34A, causing the link member 294 to begin to rotate in the counterclockwise direction and at some point the tip of the branch 470 of the "V" shaped link member 462 would engage the surface 474 of the cutout 473 of the wheel member 252, FIG. 34B, thereby preventing the offset mass 292 of the wheel member to engage the surface 484 of the striker mass release member 485 to rotate it in the clockwise direction, FIGS. 37A and 38A, and cause the corresponding impulse switches to be activated.

The provision of the "high G activation prevention mechanisms" 460 would therefore provide the impulse switches 480 and 501 of FIGS. 37A and 38A, respectively, with the capability of avoiding activation when the applied acceleration in the intended direction of their operation is higher than their prescribed acceleration magnitude threshold, even if the duration of the applied high G acceleration is longer than the prescribed acceleration threshold duration.

It is appreciated that once the high G acceleration has ceased, the "V" shaped link member 462 of the "high G activation prevention mechanisms" 460 is rotated in the clockwise direction by the preloaded compressive spring 467 and is brought back to its initial positioning shown in the schematic of FIG. 34A. All activated wheel assembly units would also return to their initial positioning shown in FIG. 21.

It is appreciated that the "high G activation prevention mechanism" 460 of FIG. 34A is configured to reset, i.e., return to their initial positions shown once the applied relatively high G acceleration event has ceased. However, in certain applications, particularly if the experienced high G acceleration could have damaged the device in which the impulse switch is mounted, the impulse switch embodiments 480 and 501 of FIGS. 37A and 38A, respectively, may be desired to be rendered non-operative. In such applications, the "high G activation prevention mechanism" 460 of FIG. 34A that are used in these impulse switches need to be configured to be non-resettable, i.e., stay in the configuration of FIG. 34B, and continue to block at least one of the wheel members of the wheel assembly units from resetting.

It is appreciated that a method for preventing resetting of the inertial mechanical delay mechanism component of the impulse switch embodiments 480 and 501 of FIGS. 37A and 38A, respectively, once it has been subjected to a relatively high G acceleration event could be the one that was previously described for the "high G activation prevention mechanisms" 109 or 125 of FIGS. 12 and 14, respectively. As previously indicated, the method is based on "locking" the deployed members of the "high G activation prevention mechanisms" that blocks the offset mass of at least one of the wheel assembly units, such as the members 114 and 130 of the "high G activation prevention mechanisms" 109 and 125 of FIGS. 12 and 14, respectively. The same method and mechanisms may also be used to "lock" the deployed member 470 of the "high G activation prevention mechanisms" 460 in its deployed position shown in FIG. 34B, thereby preventing the inertial mechanical delay mechanism component of the impulse switch embodiments 480 and 501 from resetting following subjection to a previously described relatively high G acceleration event.

While there has been shown and described what is considered to be preferred embodiments of the invention, it will, of course, be understood that various modifications and changes in form or detail could readily be made without departing from the spirit of the invention. It is therefore intended that the invention be not limited to the exact forms described and illustrated but should be constructed to cover all modifications that may fall within the scope of the appended claims.

What is claimed is:

1. An inertial mechanical delay mechanism comprising:

a first rotary assembly comprising:

a first rotary member configured to be rotatable about a first rotary axis in a first rotation direction relative to a base, the first rotary member having a first center of mass offset from a line parallel to a direction of acceleration of the base and perpendicular from the first rotary axis of the first rotary member; and a first elastic material configured to exert a first biasing force to the first rotary member to bias the first rotary member in a second rotation direction opposite to the first rotation direction; and a second rotary assembly comprising:

a second rotary member configured to be rotatable about a second rotary axis in a third rotation direction relative to the base, the second rotary member being rotatable in the third rotation direction by at least indirect interaction with the first rotary member when the first rotary member rotates a first predetermined angle in the first rotation direction;

a second elastic material configured to exert a second biasing force to the second rotary member to bias the second rotary member in a fourth rotation direction opposite to the third rotation direction;

wherein the first rotary assembly is configured to rotate the first predetermined angle when the acceleration is greater than a predetermined magnitude and duration; and an activation prevention mechanism having a blocking member movable into a movable path of one or more of the first and second rotary members to block movement of the one or more of the first and second rotary members upon an acceleration in the direction higher than an acceleration magnitude threshold.

2. The inertial mechanical delay mechanism of claim 1, wherein the activation prevention mechanism comprises a rotatable member having a first portion with the blocking member and a second portion offset from an extending direction of the first portion, the rotatable member being rotatable about an axis positioned between the first and second portions;

a biasing material connected to the second portion and to the base for biasing the first portion out of the movable path of the one or more of the first and second rotary members; and the center of gravity of the rotatable member relative to the axis is such that the first portion moves, against a biasing force of the biasing material, into the movable path of the one or more of the first and second rotary members when the acceleration is higher than the acceleration magnitude threshold.

3. The inertial mechanical delay mechanism of claim 1, wherein the elastic material is a spring.

4. The inertial mechanical delay mechanism of claim 1, wherein the activation prevention mechanism comprises a first stop limiting a movement of the first portion of the rotatable member.

5. The inertial mechanical delay mechanism of claim 1, wherein the activation prevention mechanism comprises a second stop limiting a movement of the second portion of the rotatable member.

6. The inertial mechanical delay mechanism of claim 1, wherein the center of gravity of the rotatable member being on a side of the axis having the first portion.

7. The inertial mechanical delay mechanism of claim 1, wherein the center of gravity of the rotatable member being on a side of the axis having the second portion.

* * * * *